US010434784B2

(12) United States Patent
Hirata et al.

(10) Patent No.: US 10,434,784 B2
(45) Date of Patent: Oct. 8, 2019

(54) CARTRIDGE AND CONNECTOR

(71) Applicant: Seiko Epson Corporation, Tokyo (JP)

(72) Inventors: Kazuyuki Hirata, Matsumoto (JP); Masahiro Karasawa, Matsumoto (JP); Hiroshi Nose, Shiojiri (JP); Takeshi Komaki, Shiojiri (JP); Naoki Natio, Matsumoto (JP); Yuji Aoki, Hara (JP); Tomoji Suzuki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/717,571

(22) Filed: Sep. 27, 2017

(65) Prior Publication Data

US 2018/0093481 A1 Apr. 5, 2018

(30) Foreign Application Priority Data

Sep. 30, 2016 (JP) ..... 2016-193083
Sep. 30, 2016 (JP) ..... 2016-193100

(51) Int. Cl.
*B41J 2/14* (2006.01)
*B41J 2/175* (2006.01)
*B41J 3/407* (2006.01)

(52) U.S. Cl.
CPC ..... *B41J 2/1752* (2013.01); *B41J 2/175* (2013.01); *B41J 2/1753* (2013.01); *B41J 2/17503* (2013.01); *B41J 2/17513* (2013.01); *B41J 2/17526* (2013.01); *B41J 2/17543* (2013.01); *B41J 2/17546* (2013.01);
(Continued)

(58) Field of Classification Search
USPC ..... 347/50, 86
See application file for complete search history.

(56) References Cited

U.S. PATENT DOCUMENTS 8,807,723 B2 8/2014 Aoki et al.
9,044,972 B2 6/2015 Aoki et al.
(Continued)

FOREIGN PATENT DOCUMENTS

EP 0 986 481 A1 3/2000
EP 2 803 488 A2 11/2014
JP H11-058765 A 3/1999
(Continued)

*Primary Examiner* — Lam S Nguyen
(74) *Attorney, Agent, or Firm* — Foley & Lardner LLP

(57) ABSTRACT

There is provided with a cartridge comprising a liquid supply portion; a contact portion that is located on a +Z-axis direction side of the liquid supply portion and that is arranged to contact with an electrical connecting element; and a positioning structure that is located between the liquid supply portion and the contact portion in a Z-axis direction. The liquid supply portion is configured to receive a first external force in a −Y-axis direction from the liquid introducing structure when the liquid supply portion is connected with the liquid introducing structure. The contact portion is configured to receive a second external force in a direction including a −Y-axis direction component from the electrical connecting element when the contact portion comes into contact with the electrical connecting element. This configuration suppresses position misalignment of the cartridge or a connector to a mounting structure.

13 Claims, 46 Drawing Sheets

(52) U.S. Cl.
CPC ..... *B41J 2/17553* (2013.01); *B41J 2/17596* (2013.01); *B41J 3/4078* (2013.01)

(56) References Cited

U.S. PATENT DOCUMENTS

| | | | | |
|---|---|---|---|---|
| 9,487,014 | B2 | 11/2016 | Aoki et al. | |
| 2002/0196312 | A1* | 12/2002 | Ishizawa ..... | B41J 2/175 347/50 |

FOREIGN PATENT DOCUMENTS

| | | | |
|---|---|---|---|
| JP | 2006-015644 | A | 1/2006 |
| JP | 2011-056830 | A | 3/2011 |
| JP | 2012-040711 | A | 3/2012 |
| JP | 2013-240924 | A | 12/2013 |
| WO | WO-98/55324 | A1 | 12/1998 |

* cited by examiner

CARTRIDGE AND CONNECTOR

FIELD

The present disclosure relates to a technique regarding a cartridge and a connector.

BACKGROUND

A conventionally known cartridge is detachably mounted to a mounting structure of a liquid consuming apparatus, such as a printer (as described in JP 2013-240924A). In the technique disclosed in JP 2013-240924A, the mounting structure includes electrical connecting elements and a liquid introducing structure. In the technique disclosed in JP 2013-240924A, the cartridge includes contact portions arranged to come into contact with the electrical connecting elements, and a liquid supply portion connected with the liquid introducing structure to supply a liquid to the liquid introducing structure.

A conventionally known liquid container is detachably mounted to a mounting structure of a liquid consuming apparatus (as described in, for example, JP 2006-15644A). The prior art liquid container includes a liquid container body having a liquid pack and a liquid supply port, and a sealing case provided to cover the entire liquid container body to prevent leakage of a liquid to outside.

SUMMARY

The prior art technique is, however, likely to cause the position of the cartridge relative to the mounting structure to be deviated from the correct position by an external force applied from the mounting structure to the cartridge in a mounting process or in a mounting state. There is accordingly a demand for suppressing position misalignment of the cartridge relative to the mounting structure.

This problem is not characteristic of the cartridge that is detachably mounted to the mounting structure but is common to any member (for example, connector) that is detachably mounted to the mounting structure.

The prior art technique covers the entire liquid container body with the sealing case to suppress leakage of the liquid to outside. In the configuration that uses the sealing case to suppress leakage of the liquid to outside, however, a gap is likely to be formed due to position misalignment between members included in the sealing case or tolerance of the sealing case. The presence of such a gap is likely to cause the liquid to be leaked from inside of the sealing case to outside. There is accordingly a demand for reducing the possibility of leakage of the liquid to outside.

This problem is not characteristic of the liquid container that is detachably mounted to the mounting structure of the liquid consuming apparatus but is common to any member (for example, connector) that is detachably mounted to the mounting structure and that includes a supply flow path arranged to supply a liquid from a liquid supply source to the mounting structure.

In order to solve at least part of the problems described above, the disclosure may be implemented by aspects or configurations described below.

(1) According to one aspect of the present disclosure, there is provided a cartridge detachably mounted to a mounting structure of a liquid consuming apparatus that is provided with a liquid introducing structure, an electrical connecting element and an engagement structure. An X axis, a Y axis and a Z axis are three spatial axes that are orthogonal to one another. An X-axis direction is a direction along the X axis, a Y-axis direction is a direction along the Y axis, and a Z-axis direction is a direction along the Z axis. In a mounting state that the cartridge is mounted to the mounting structure, direction of gravity is defined as −Z-axis direction, an opposite direction of gravity is defined as +Z-axis direction, one direction in the X-axis direction is defined as +X-axis direction, and the other direction in the X-axis direction is defined as −X-axis direction. This cartridge comprises a liquid supply portion detachably connected with the liquid introducing structure to supply a liquid to the liquid introducing structure, the liquid supply portion including a base end portion, a leading end portion that forms an opening to receive the liquid introducing structure in the liquid supply portion, and a center axis that is extended in a direction along a +Y-axis direction from the base end portion toward the leading end portion; a contact portion that is located on the +Z-axis direction side of the liquid supply portion and that is arranged to contact with the electrical connecting element in the mounting state; and a positioning structure that is located between the liquid supply portion and the contact portion in the Z-axis direction and that is engaged with the engagement structure to restrict motion of the cartridge relative to the mounting structure in the mounting state. The liquid supply portion is configured to receive a first external force in the −Y-axis direction from the liquid introducing structure when the liquid supply portion is connected with the liquid introducing structure. The contact portion is configured to receive a second external force in a direction including the −Y-axis direction component from the electrical connecting element when the contact portion contacts with the electrical connecting element.

According to this aspect, the first external force causes a first moment in a first rotating direction having a −Y-axis direction component to be generated about the positioning structure as a supporting point in the cartridge. The second external force causes a second moment in a second rotating direction having a −Y-axis direction component to be generated about the positioning structure as a supporting point in the cartridge. According to this aspect, the positioning structure is placed between the liquid supply portion and the contact portion in the Z-axis direction. This configuration causes the first moment in the first rotating direction and the second moment in the second rotating direction to be applied to the cartridge in the directions of cancelling each other. This configuration reduces the possibility of position misalignment of the cartridge relative to the mounting structure in the mounting process and in the mounting state. According to this aspect, the liquid supply portion is provided on the −Z-axis direction side that is the direction of gravity side of the contact portion. This configuration reduces the possibility that the contact portion is stained with the liquid even when the liquid is leaked out from the liquid supply portion.

(2) In the cartridge of the above aspect, a plurality of the contact portions may be provided at different positions in the X-axis direction, and the plurality of the contact portions may include a first contact portion that is located on a most +X-axis direction side and a second contact portion that is located on a most −X-axis direction side in the X-axis direction among the plurality of the contact portions. When the cartridge is viewed from the +Y-axis direction side, a center of an interval between the first contact portion and the second contact portion in the X-axis direction may be located on a virtual straight line that runs through the center axis of the liquid supply portion and is parallel to the Z-axis direction.

According to this aspect, the cartridge is rotated about the center axis relative to the mounting structure along an X-Z plane that is parallel to the X-axis direction and the Z-axis direction. Such rotation suppresses position misalignment of the contact portion relative to the electrical connecting element on the X-Z plane even when the cartridge has position misalignment relative to the mounting structure on the X-Z plane. The state that the "center of an interval between the first contact portion and the second contact portion is located on the virtual straight line" is not limited to the case where the center is located exactly on the virtual straight line but includes the case where there is a slight deviation of the center of an interval between the first contact portion and the second contact portion from the virtual straight line by taking into account the capability of suppressing position misalignment of the contact portion relative to the electrical connecting element on the X-Z plane.

(3) In the cartridge of the above aspect, the positioning structure may be engaged with the engagement structure to restrict motion of the cartridge relative to the mounting structure in the X-axis direction. When the cartridge is viewed from the +Y-axis direction side, a center of the positioning structure in the X-axis direction may be located on the virtual straight line.

According to this aspect, the configuration that the center of the positioning structure is located on the virtual straight line more effectively suppresses position misalignment of the contact portion relative to the electrical connecting element. The state that the "center of the positioning structure is located on the virtual straight line" is not limited to the case where the center is located exactly on the virtual straight line but includes the case where there is a slight deviation of the center of the positioning structure from the virtual straight line by taking into account the capability of suppressing position misalignment of the contact portion relative to the electrical connecting element.

(4) In the cartridge of the above aspect, the engagement structure may include a first engagement structure and a second engagement structure. The positioning structure may include a first engaged element that is engaged with the first engagement structure in the mounting state; and a second engaged element that is arranged to be away from the first engaged element across an interval in the X-axis direction and that is engaged with the second engagement structure in the mounting state. When the cartridge is viewed from the +Y-axis direction side, the first engaged element and the second engaged element may be located across the virtual straight line.

According to this aspect, the first engaged element and the second engaged element are located across the virtual straight line. This configuration suppresses position misalignment of the cartridge by the first external force or by the second external force and position misalignment of the contact portion about the center axis in the mounting state.

(5) In the cartridge of the above aspect, the positioning structure may include a first protruded guide element that is formed to be located on a −Y-axis direction side toward the −X-axis direction and that is configured to guide the first engagement structure to the first engaged element; and a second protruded guide element that is formed to be located on the −Y-axis direction side toward the +X-axis direction and that is configured to guide the second engagement structure to the second engaged element. The first engaged element may be connected with a −X-axis direction side end of the first protruded guide element, and the second engaged element may be connected with a +X-axis direction side end of the second protruded guide element.

According to this aspect, the first protruded guide element and the second protruded guide element respectively serve to guide the first engagement structure to the first engaged element and to guide the second engagement structure to the second engaged element in the process of mounting the cartridge to the mounting structure. This configuration ensures engagement of the first engagement structure with the first engaged element and engagement of the second engagement structure with the second engaged element with higher reliability.

(6) The cartridge of the above aspect may further comprise a liquid injection portion that is configured to inject the liquid into the cartridge and that is located at an identical position in the Z-axis direction with the positioning structure.

According to this aspect, the liquid injection portion is provided with suppressing size expansion of the cartridge in the Z-axis direction. The term "identical position" is not limited to the case where the center of the positioning structure and the liquid injection portion are located at the same position in the Z-axis direction but also includes the case where the center of the positioning structure in the Z-axis direction is located in a range where the liquid injection portion is located.

(7) The cartridge of the above aspect may further comprise a main body member that is placed inside of the mounting structure in the mounting state and that is provided with the liquid supply portion, the contact portion and the positioning structure. The main body member may include a projection that is located opposed to an inner face of the mounting structure either in the Z-axis direction or in the X-axis direction.

According to this aspect, in the mounting state and in the process of mounting the cartridge to the mounting structure, when the main body member starts rotating about the center axis, the projection hits against the inner face of the mounting structure and thereby suppresses rotation of the main body member. This configuration further reduces the possibility of position misalignment of the main body member relative to the mounting structure in the mounting state and in the mounting process.

(8) The cartridge of the above aspect may further comprise a main body-side identification member that is fit in a mounting structure-side identification member provided on the mounting structure, so as to identify a type of the liquid contained inside of the cartridge. The main body-side identification member may include at least one projection, and at least one of number of the projections, shape of the projection and position of the projection may differ according to the type of the liquid.

According to this aspect, the main body-side identification member prevents the cartridge from being mistakenly inserted into a mounting structure that is different from the correct mounting structure. The configuration that the projection of the main body-side identification member is fit in the mounting structure-side identification member further reduces the possibility of position misalignment of the cartridge relative to the mounting structure.

(9) The cartridge of the above aspect may further comprise a main body member that is placed inside of the mounting structure in the mounting state and that is provided with the liquid supply portion, the contact portion and the positioning structure. The main body member may include a first surface that forms a +Z-axis direction side end face; a second surface that forms a −Z-axis direction side end face; a third surface that forms a −X-axis direction side end face; a fourth surface that forms a +X-axis direction side end face; a fifth surface that forms a +Y-axis direction side end face; and a contact portion placement structure which the contact portion is placed on. The contact portion placement structure may include an upper protruded portion that is protruded from the first surface in the +Z-axis direction. In the mounting state, at least part of the upper protruded portion may be placed in a recess that is provided in the mounting structure to be recessed in the +Z-axis direction.

According to this aspect, in the mounting state, the upper protruded portion is placed in the recess of the mounting structure. Even when the cartridge starts rotating about the center axis, the upper protruded portion hits against the wall surface of the recess and thereby suppresses the rotation. This configuration further reduces the possibility of position misalignment of the cartridge relative to the mounting structure in the mounting state.

(10) In the cartridge of the above aspect, the contact portion may be located on a placement surface arranged to intersect with an X-Y plane that is parallel to the X-axis direction and the Y-axis direction and to intersect with a Y-Z plane that is parallel to the Y-axis direction and the Z-axis direction.

According to this aspect, the placement surface which the contact portion is placed on is arranged to intersect with the X-Y plane and to intersect with the Y-Z plane and is accordingly inclined to the +Y-axis direction that is the moving direction of the cartridge relative to the mounting structure. This configuration causes the electrical connecting element and the contact portion to slightly rub against each other immediately before completion of mounting of the cartridge to the mounting structure. Even when there is any extraneous substance (for example, dust) in the neighborhood of the electrical connecting element or the contact portion, this configuration exerts the effect of discharging the extraneous substance from between the electrical connecting element and the contact portion (wiping effect).

(11) In the cartridge of the above aspect, the contact portion may be located on a placement surface arranged to be parallel to an X-Z plane that is parallel to the X-axis direction and the Z-axis direction.

According to this aspect, the placement surface which the contact portion is placed on is arranged to be parallel to the X-Z plane and is thereby perpendicular to the +Y-axis direction that is the moving direction of the cartridge relative to the mounting structure. This configuration reduces the possibility of significant misalignment of the contact position of the contact portion with the electrical connecting element.

(12) The cartridge of the above aspect may further comprise a guide structure that is configured to guide the electrical connecting element to the contact portion. The guide structure may include a groove that is extended along the Y-axis direction and that is configured to receive part of the mounting structure. The groove may be formed at an identical position in the Z-axis direction with the contact portion.

According to this aspect, the guide structure serves to guide the electrical connecting element to the contact portion and thereby suppresses position misalignment of the contact portion relative to the electrical connecting element in the mounting process. The configuration that the groove is formed at the same position in the Z-axis direction with the contact portion further reduces position misalignment of the contact portion relative to the electrical connecting element. The state that the "groove is formed at the same position in the Z-axis direction with the contact portion" means that part of the contact portion is located in a range where the groove is located in the Z-axis direction.

(13) The cartridge of the above aspect may further comprise a main body member that is placed inside of the mounting structure in the mounting state and that is provided with the liquid supply portion, the contact portion and the positioning structure. An odd number of the contact portions may be arranged along the X-axis direction. A center contact portion that is located at a center among the odd number of the contact portions and the center axis may be located at a center of the main body member in the X-axis direction.

According to this aspect, the center contact portion and the center axis are located at the center of the main body member in the X-axis direction. This configuration suppresses position misalignment of the contact portion relative to the electrical connecting element even when the cartridge is rotated about the center axis in the mounting process or in the mounting state.

(14) In the cartridge of the above aspect, the liquid introducing structure may include a liquid injection needle that is connected with the liquid supply portion and that is configured to cause the liquid from the liquid supply portion to flow inside thereof, and a mounting structure-side cylindrical member that is provided to surround an outer circumference of the liquid injection needle and that is configured to place the liquid injection needle therein. The liquid supply portion may include a flow portion in a cylindrical shape that includes the base end portion and the leading end portion and that is configured to form a flow path which the liquid flows in; and a supply portion protrusion that is protruded outward from an outer surface of the flow portion that forms an outer circumference of the flow portion. The liquid supply portion may be inserted into the mounting structure-side cylindrical member in the mounting state.

According to this aspect, the cartridge has the supply portion protrusion that is protruded outward from the outer surface of the flow portion. This configuration suppresses position misalignment of the flow portion relative to the liquid injection needle in the process of mounting the cartridge to the mounting structure.

(15) In the cartridge of the above aspect, the supply portion protrusion may be formed in a ring shape around entire circumference of the outer surface of the flow portion.

The configuration of this aspect further suppresses position misalignment of the flow portion relative to the liquid injection needle in the process of mounting the cartridge to the mounting structure.

(16) In the cartridge of the above aspect, the liquid supply portion may further include a valve mechanism that is placed in the flow portion and that is configured to open and close the flow path. The valve mechanism may include a valve seat that is configured to form a valve hole; a valve element that is provided to close the valve hole and that is configured to be displaced in the −Y-axis direction by an external force input from the liquid injection needle and to be separated from the valve seat; and a pressing member that is provided to press the valve element toward the valve seat. The valve seat, the valve element and the pressing member may be arranged sequentially from a leading end side. A +Y-axis direction side end of the valve element may be located on a +Y-axis direction side of a +Y-axis direction side end of the supply portion protrusion. A distance L2 may be shorter than a distance L1, where the distance L1 denotes a distance between a −Y-axis direction side end of the mounting structure-side cylindrical member and a −Y-axis direction side end of the liquid injection needle in the Y-axis direction, and the distance L2 denotes a distance between a +Y-axis direction side end of the supply portion protrusion and a +Y-axis direction side end of the valve element in the Y-axis direction.

According to this aspect, the configuration that the distance L2 is shorter than the distance L1 causes the supply portion protrusion to be located in the mounting structure-side cylindrical member before the liquid injection needle comes into contact with the valve element, in the process of mounting the cartridge to the mounting structure. This configuration suppresses position misalignment of the flow portion relative to the liquid injection needle when the liquid injection needle presses in the valve element in the mounting process.

(17) According to another aspect of the present disclosure, there is provided a connector detachably mounted to a mounting structure of a liquid consuming apparatus that is provided with a liquid introducing structure, an electrical connecting element and an engagement structure. An X axis, a Y axis and a Z axis are three spatial axes that are orthogonal to one another. An X-axis direction is a direction along the X axis, a Y-axis direction is a direction along the Y axis, and a Z-axis direction is a direction along the Z axis. In a mounting state the connector is mounted to the mounting structure, direction of gravity is defined as −Z-axis direction, an opposite direction of gravity is defined as +Z-axis direction, one direction in the X-axis direction is defined as +X-axis direction, and the other direction in the X-axis direction is defined as −X-axis direction. The connector comprises a liquid supply portion that is detachably connected with the liquid introducing structure to supply a liquid to the liquid introducing structure; a contact portion that is located on the +Z-axis direction side of the liquid supply portion and that is arranged to contact with the electrical connecting element in the mounting state; and a positioning structure that is located between the liquid supply portion and the contact portion in the Z-axis direction and that is engaged with the engagement structure to restrict motion of the connector relative to the mounting structure in the mounting state. The liquid supply portion includes a leading end portion that forms an opening to receive the liquid introducing structure therein. The liquid supply portion is configured to receive a first external force in a direction including a −Y-axis direction component when the liquid supply portion is connected with the liquid introducing structure. The contact portion is configured to receive a second external force in a direction including the −Y-axis direction component when the contact portion contacts with the electrical connecting element.

According to this aspect, the first external force causes a first moment in a first rotating direction having a −Y-axis direction component to be generated about the positioning structure as a supporting point in the connector. The second external force causes a second moment in a second rotating direction having a −Y-axis direction component to be generated about the positioning structure as a supporting point in the connector. According to this aspect, the positioning structure is placed between the liquid supply portion and the contact portion in the Z-axis direction. This configuration causes the first moment in the first rotating direction and the second moment in the second rotating direction to be applied to the connector in the directions of cancelling each other. This configuration reduces the possibility of position misalignment of the connector relative to the mounting structure in the mounting process and in the mounting state. According to this aspect, the liquid supply portion is provided on the −Z-axis direction side that is the direction of gravity side of the contact portion. This configuration reduces the possibility that the contact portion is stained with the liquid even when the liquid is leaked out from the liquid supply portion.

(18) According to another aspect of the present disclosure, there is provided a connector that is detachably mounted to a mounting structure of a liquid consuming apparatus and that includes a supply flow path configured to supply a liquid from a liquid supply source to the mounting structure. This connector comprises a supply member that forms an upstream end of the supply flow path in a flow direction of the liquid that flows from the connector toward the mounting structure; and a connection main body member that forms a downstream end of the supply flow path in the flow direction and that is connected with the mounting structure. The supply member has a first supply opening portion that includes the upstream end, and a second supply opening portion that is located on a downstream side of the first supply opening portion in the flow direction. The connection main body member has an insertion structure that is inserted in the second supply opening portion and that forms part of the supply flow path, and a sealing main body structure that is provided to surround the insertion structure and that is configured to press the second supply opening portion toward a location where the insertion structure is located, such that an outer circumferential surface of the insertion structure and an inner circumferential surface of the second supply opening portion come into contact with each other in a circumferential direction. The connector further includes a first elastic seal member that is located on a first supply opening portion side of a contact position of the outer circumferential surface of the insertion structure with the inner circumferential surface of the second supply opening portion and that is located between the outer circumferential surface of the insertion structure and the inner circumferential surface of the second supply opening portion to seal a gap between the outer circumferential surface of the insertion structure and the inner circumferential surface of the second supply opening portion.

According to this aspect, the connector forming the supply flow path which the liquid from the liquid supply source flows in includes the sealing main body structure and the first elastic seal member. The sealing main body structure causes the outer circumferential surface of the insertion structure and the inner circumferential surface of the second supply opening portion to come into contact with each other in the circumferential direction. The first elastic seal member serves to seal the gap between the outer circumferential surface of the insertion structure and the inner circumferential surface of the second supply opening portion. This configuration suppresses leakage of the liquid to outside by a narrower required space, compared with a configuration that the liquid supply source and the connector are covered by a sealed case to suppress leakage of the liquid to outside. This configuration accordingly reduces the possibility of a failure to sufficiently exert the function of suppressing leakage of the liquid to outside, due to position misalignment between the members or a tolerance of the member. The connector has the double seal structure formed by the first elastic seal member and by the contact of the outer circumferential surface of the insertion structure with the inner circumferential surface of the second supply opening portion in the circumferential direction by the sealing main body structure and thereby more effectively suppresses leakage of the liquid to outside.

(19) In the connector of the above aspect, the insertion structure of the connection main body member may include an insertion structure inner circumferential surface that defines part of the supply flow path formed by the insertion structure and that is located on an opposite side to the outer circumferential surface of the insertion structure where the first elastic seal member is located, a first rib that has respective ends connected with the insertion structure inner circumferential surface, and a second rib that has two second rib ends connected with the insertion structure inner circumferential surface and that is arranged to intersect with the first rib.

According to this aspect, the insertion structure has the first rib and the second rib and accordingly suppresses deformation of the insertion structure caused by an external force applied from the first elastic seal member to the insertion structure. This configuration reduces the possibility of leakage of the liquid from the gap between the insertion structure and the supply member to outside.

(20) The connector of the above aspect may further comprise a filter that is located on a downstream side of the insertion structure in the supply flow path in the flow direction and that is configured to prevent an extraneous substance from passing through.

Even when an extraneous substance is mixed into the liquid that flows from the upstream side of the filter toward the downstream side of the filter, the configuration of this aspect reduces the possibility that the extraneous substance reaches the mounting structure

(21) In the connector of the above aspect, the connection main body member may include a first projection that is located on an outer circumference of the filter and that is configured to restrict motion of the filter in a direction that is perpendicular to the flow direction.

According to this aspect, the first projection serves to restrict the motion of the filter and thereby suppresses position misalignment of the filter. This accordingly further reduces the possibility that the extraneous substance reaches the mounting structure.

(22) In the connector of the above aspect, the connection main body member may have an intermediate member that includes the insertion structure, and a connection member that forms the downstream end in the flow direction and that is connected with the intermediate member. The connector may further comprise a second elastic seal member configured to seal a gap between the intermediate member and the connection member.

According to this aspect, the presence of the second elastic seal member further reduces the possibility of leakage of the liquid to outside.

(23) In the connector of the above aspect, the connection member may include a second projection that is located on an intermediate member side of the second elastic seal member and that is connected with the intermediate member.

According to this aspect, the second projection causes the connection member to be connected with the intermediate member.

(24) In the connector of the above aspect, the connection main body member may include an injection flow path that is arranged to cause a liquid to flow from outside toward the liquid supply source and that joins the supply flow path on an upstream side of the filter in the flow direction. The connection member may include a recess that has a bottom wall provided with a supply path opening that forms the supply flow path and an injection path opening that forms the injection flow path, and a groove that is provided to surround an outer circumference of the recess. The recess may include a partition wall in a frame-like shape that rises from the bottom wall to surround the supply path opening and that has the filter attached at an end opposite to a side where the bottom wall is located. The second elastic seal member may be placed in the groove to be pressed by the groove and the intermediate member, so as to seal a gap between the groove and the intermediate member.

According to this aspect, the groove is provided to surround the outer circumference of the recess in which the supply path opening and the injection path opening are formed. The second elastic seal member is pressed by the groove and the intermediate member to seal the gap between the groove and the intermediate member. This configuration accordingly reduces the possibility of leakage of the liquid to outside when the liquid flows in the injection flow path and when the liquid from the liquid supply source flows in the supply flow path.

(25) In the connector of the above aspect, the connection main body member may include an intermediate member that includes the insertion structure, and a connection member that forms the downstream end of the supply flow path in the flow direction and that is connected with the intermediate member. The intermediate member and the connection member may be welded to each other to surround a circumference of the supply flow path.

According to this aspect, the intermediate member and the connection member are welded to each other to surround the circumference of the supply flow path. This configuration reduces the possibility of leakage of the liquid in the supply flow path from the boundary between the intermediate member and the connection member to outside.

The present disclosure may be implemented by any of various aspects other than the cartridge and the connector described above. For example, the present disclosure may be implemented by a liquid container including the connector and a liquid supply source, a connector unit including the connector and a case, a manufacturing method of the cartridge or the connector, a liquid consumption system including the cartridge (liquid container) and a liquid consuming apparatus, a liquid consumption system including the connector and a liquid consuming apparatus, and a liquid consumption system including the connector unit and a liquid consuming apparatus.

DESCRIPTION OF EMBODIMENTS

A. First Embodiment

A-1. Configuration of Liquid Consumption System

Figure 1:
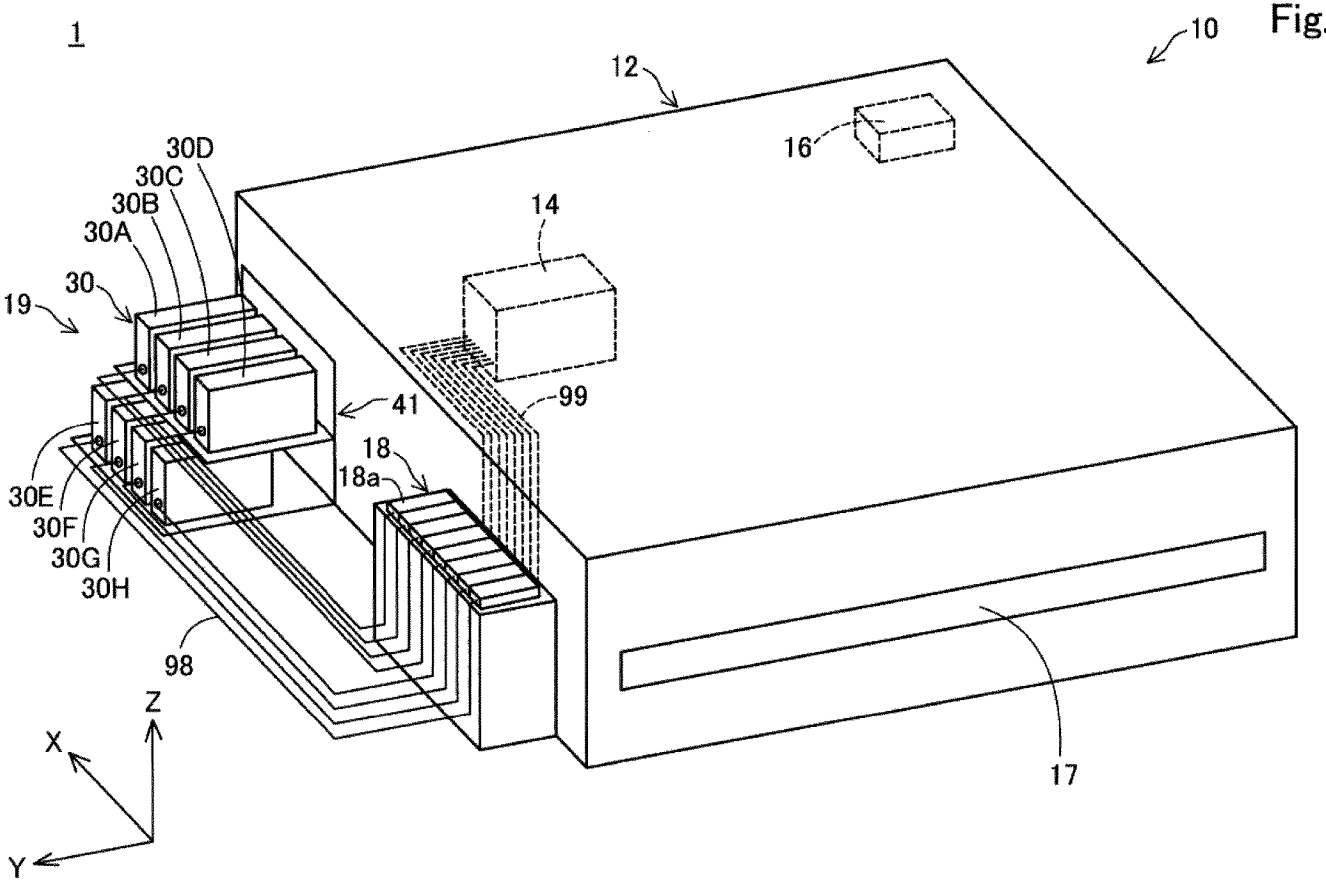
FIG. 1 is a schematic diagram illustrating a liquid consumption system according to a first embodiment of the present disclosure.

FIG. 1 is a schematic diagram illustrating a liquid consumption system 1 according to a first embodiment of the present disclosure. An X axis, a Y axis and a Z axis that are three spatial axes orthogonal to one another are illustrated in FIG. 1. A direction along the X axis is an X-axis direction, a direction along the Y axis is a Y-axis direction, and a direction along the Z axis is a Z-axis direction. In a mounting state that a cartridge (also called "liquid container") 30 described later is mounted to a mounting structure 20, the direction of gravity is defined as −Z-axis direction, and an opposite direction of gravity is defined as +Z-axis direction. In the mounting state, one direction in the X-axis direction is defined as +X-axis direction, and the other direction in the X-axis direction is defined as −X-axis direction. In the mounting state, the liquid consumption system 1 is placed on a plane parallel to the X-axis direction and the Y-axis direction (X-Y plane). In the other drawings described later, the X axis, the Y axis and the Z axis in the mounting state are illustrated as needed basis.

The liquid consumption system 1 includes a liquid consuming apparatus 10, cartridges 30, a main placement rack 19 and a sub placement rack 18. The liquid consuming apparatus 10 is an inkjet textile printing machine configured to perform recording (printing) by ejecting ink as one example of a liquid onto a medium such as a fabric product. According to another embodiment, the liquid consuming apparatus 10 may be a printer configured to perform recording (printing) by ejecting ink on paper.

Eight cartridges 30 are provided. The eight cartridges 30 respectively contain different colors of liquids (inks). Reference signs 30A to 30H are used for discrimination of the eight cartridges 30. The cartridge (liquid container) 30A contains a liquid of cyan (C) color. A cartridge (liquid container) 30B contains liquid of a magenta (M) color. A cartridge (liquid container) 30C contains a liquid of yellow (Y) color. A cartridge (liquid container) 30D contains a liquid of black (K) color. A cartridge (liquid container) 30E contains a liquid of red (R) color. A cartridge (liquid container) 30F contains a liquid of blue (B) color. A cartridge (liquid container) 30G contains a liquid of orange (O) color. A cartridge (liquid container) 30H contains a liquid of gray (LK) color. According to another embodiment, the number of the cartridges 30 may be less than 8 or greater than 8.

The main placement rack 19 is provided outside of the liquid consuming apparatus 10 and is used to place the eight cartridges 30 thereon. The main placement rack 19 has a two-shelf structure. The cartridges 30A to 30D are placed on an upper shelf, and the cartridges 30E to 30H are placed on a lower shelf. Respective one ends of first tubes 98 described later are placed on the main placement rack 19.

The sub placement rack 18 is used to place eight sub-tanks 18*a* thereon. The eight sub-tanks 18*a* are provided corresponding to the eight cartridges 30A to 30H. The cartridges 30A to 30H are arranged to communicate with the corresponding sub-tanks 18*a* by means of flexible first tube 98. Eight first tubes 98 are provided corresponding to the cartridges 30A to 30H. The liquid contained in each of the cartridges 30A to 30H is flowed through the first tube 98 and is supplied to the corresponding sub-tank 18*a* by a suction mechanism (not shown) (for example, a pump (not shown) placed on the sub placement rack 18) included in the liquid consumption system 1.

The liquid consuming apparatus 10 includes an outer shell 12, a liquid consuming portion 14, a controller 16, first tubes 98, mounting structures 20 and second tubes 99. The outer shell 12 is formed in an approximately rectangular parallelepiped external shape. The outer shell 12 forms an outer surface of the liquid consuming apparatus 10.

The liquid consuming portion 14 is placed inside of the outer shell 12. The liquid consuming portion 14 is arranged to communicate with the sub-tanks 18*a* by flexible second tubes 99 provided for the respective sub-tanks 18*a*. The liquids flowed through the respective second tubes 99 are supplied to the liquid consuming portion 14. According to this embodiment, the liquids contained in the sub-tanks 18*a* are supplied through the second tubes 99 to the liquid consuming portion 14 by a pressurization mechanism (not shown) (for example, a pump) included in the liquid consuming apparatus 10. The liquid consuming portion 14 has an ejection head that is configured to eject the liquids onto a medium such as a fabric product. The liquid consuming portion 14 moves back and forth along the Y-axis direction by means of a drive mechanism (not shown) included in the liquid consuming apparatus 10. While the liquid consuming portion 14 moves back and forth along the Y-axis direction with ejecting the liquids, the medium is moved inside of the outer shell 12 from a +X-axis direction side toward a −X-axis direction side by means of a conveyance mechanism (not shown) of the liquid consuming apparatus 10. This configuration causes the liquid to be ejected onto the medium. After ejection of the liquids, the medium is discharged from an ejection slot 17 provided on a −X-axis direction side face (front face) of the outer shell 12 to outside of the outer shell 12. According to another embodiment, the liquid consuming portion 14 may be a line head that does not move back and forth but is fixed in position.

The controller 16 is placed inside of the outer shell 12. The controller 16 controls the operations of the liquid consuming apparatus 10. The controller 16 controls, for example, the operations of the drive mechanism and the conveyance mechanism mentioned above. The controller 16 is also electrically connected with the cartridges 30 to transmit various information to and from the cartridges 30. The various information include, for example, color information regarding the colors of the liquids contained in the respective cartridges 30 and information regarding the state of mounting or non-mounting of the respective cartridges 30 to the liquid consuming apparatus 10.

Figure 2:
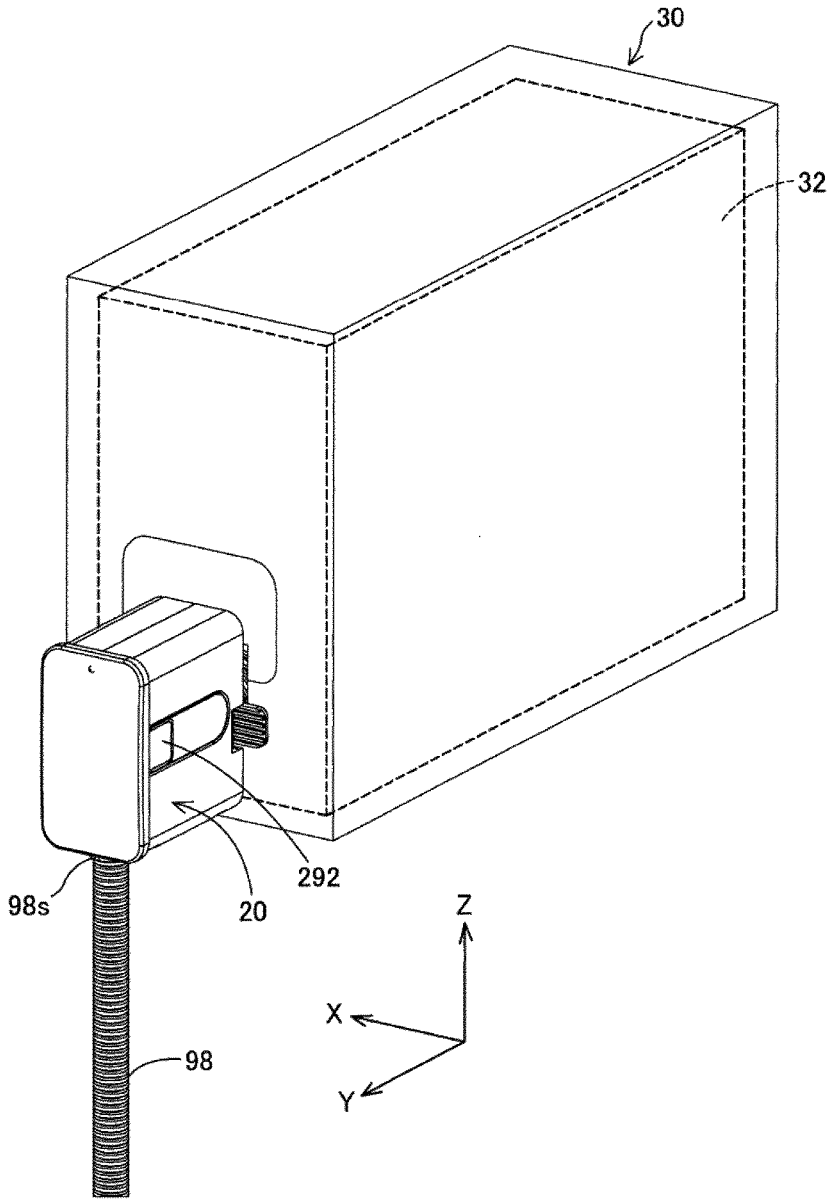
FIG. 2 is a perspective view illustrating a cartridge and a one end side of a first tube.

FIG. 2 is a perspective view illustrating the cartridge 30 and one end 98*s*-side of the first tube 98. FIG. 2 illustrates the mounting state that the cartridge 30 is mounted to the mounting structure 20. The mounting structure 20 is connected with one end 98*s* of the first tube 98. The mounting structure 20 is configured to be detachably mounted to the cartridge 30. More specifically, the mounting structure 20 is moved toward a cartridge main body (described later) of the cartridge 30 placed on the main placement rack 19 (shown in FIG. 1) and is mounted to the cartridge 30. The mounting direction of the mounting structure 20 to the cartridge 30 is a −Y-axis direction, and the detachment direction of the mounting structure 20 from the cartridge 30 is a +Y-axis direction. The mounting direction is on the basis of a direction immediately before the mounting structure 20 is mounted to the cartridge 30. The detachment direction is on the basis of a direction immediately after the mounting structure 20 is detached from the cartridge 30. In other words, when the cartridge 30 is mounted to the mounting structure 20, the moving direction of the cartridge 30 relative to the mounting structure 20 (mounting direction) is the +Y-axis direction. When the cartridge 30 is detached from the mounting structure 20, the moving direction of the cartridge 30 relative to the mounting structure 20 (detachment direction) is the −Y-axis direction.

The mounting structure 20 includes release elements 292 provided on respective sides in the X-axis direction (only one release element is shown in FIG. 2). Pressing the release elements 292 releases the engagement of the mounting structure 20 with the cartridge 30 and enables the mounting structure 20 to be detached from the cartridge 30. In the mounting state, the liquid contained in a liquid container body 32 of the cartridge 30 is supplied to the mounting structure 20. The liquid supplied to the mounting structure 20 is flowed through the first tube 98.

A-2. Configuration of Mounting Structure

Figure 3:
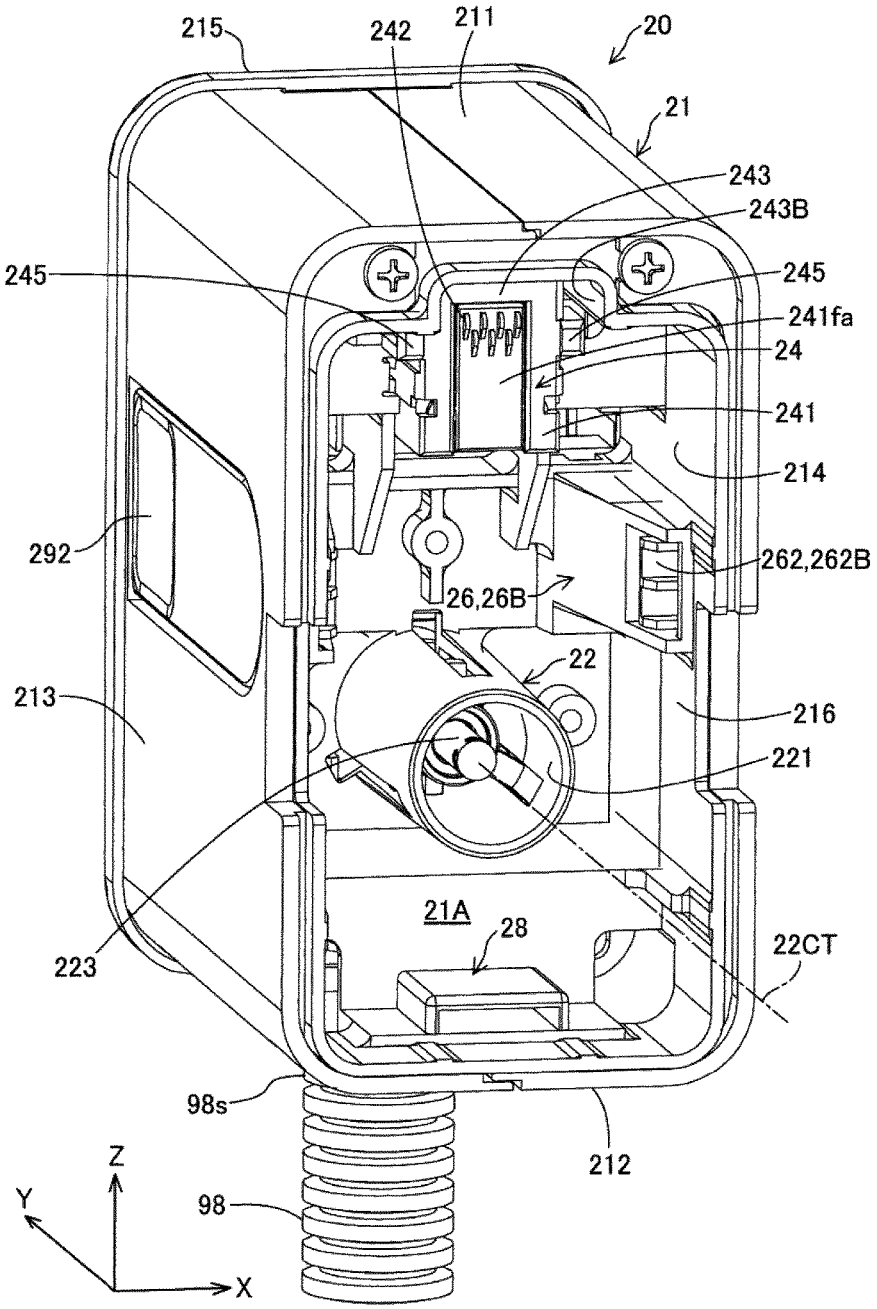
FIG. 3 is a first perspective view illustrating a mounting structure.
Figure 4:
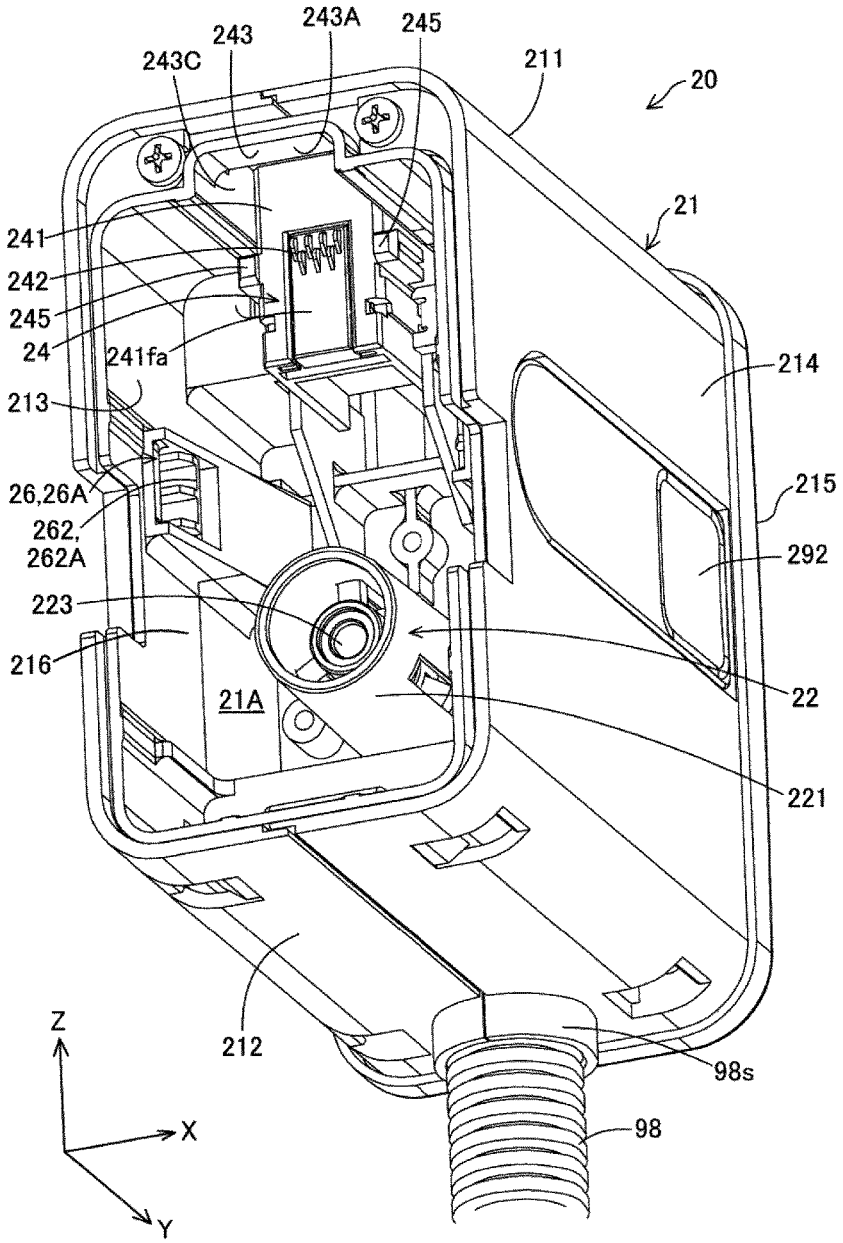
FIG. 4 is a second perspective view illustrating the mounting structure.
Figure 5:
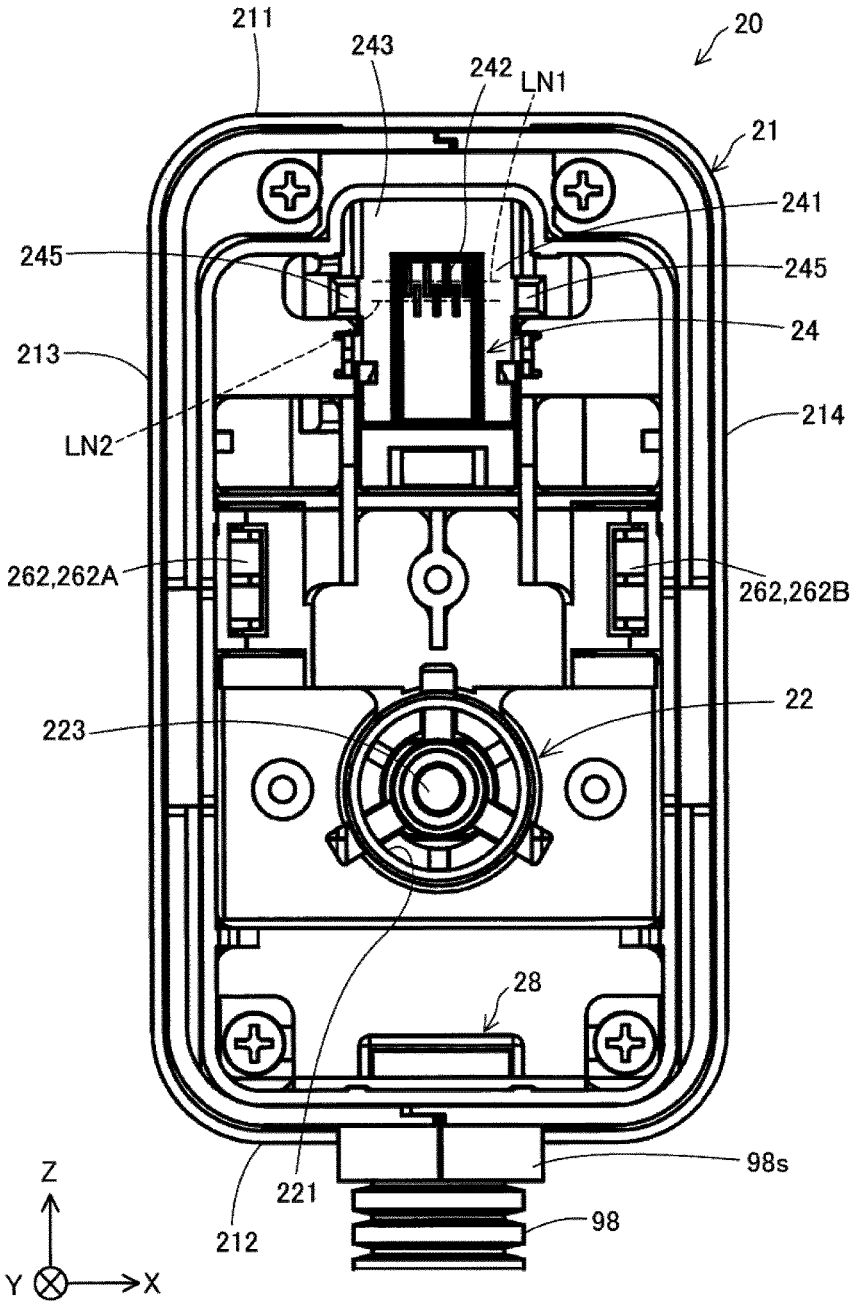
FIG. 5 is a front view illustrating the mounting structure.

FIG. 3 is a first perspective view illustrating the mounting structure 20. FIG. 4 is a second perspective view illustrating the mounting structure 20. FIG. 5 is a front view illustrating the mounting structure 20. The one end 98*s*-side of the first tube 98 is also illustrated in FIGS. 3 to 5 in order to facilitate understanding.

The mounting structure 20 (shown in FIG. 3) has a mounting structure outer shell 21 that forms its outer surface. The mounting structure outer shell 21 is formed in an approximately rectangular parallelepiped external shape. The mounting structure outer shell 21 is provided as a recess that is open on its −Y-axis direction side. The mounting structure outer shell 21 includes a mounting structure first surface (mounting structure first wall) 211, a mounting structure second surface (mounting structure second wall) 212, a mounting structure third surface (mounting structure third wall) 213, a mounting structure fourth surface (mounting structure fourth wall) 214, a mounting structure fifth surface (mounting structure fifth wall) 215 and an opening 216.

In the mounting state that the cartridge 30 is mounted to the mounting structure 20, the mounting structure first surface 211 forms an upper face, and the mounting structure second surface 212 forms a bottom face. The mounting structure third surface 213 forms one side face, and the mounting structure fourth surface 214 forms the other side face. The mounting structure fifth surface 215 forms a bottom of the recess. The opening 216 is opposed to the mounting structure fifth surface 215 and defines an opening which part of the cartridge 30 (more specifically, a cartridge main body described later) passes through in the mounting process. The mounting structure first surface 211 and the mounting structure second surface 212 are opposed to each other in the Z-axis direction. The mounting structure third surface 213 and the mounting structure fourth surface 214 are opposed to each other in the X-axis direction. The mounting structure fifth surface 215 and the opening 216 are opposed to each other in the Y-axis direction. The mounting structure first surface 211 to the mounting structure fifth surface 215 define a housing space 21A to place the cartridge main body therein as described above.

The mounting structure 20 (shown in FIG. 3) further includes a liquid introducing structure 22, an apparatus-side electrical mechanism 24, engagement structures 26 and a mounting structure-side identification member 28. The liquid introducing structure 22, the apparatus-side electrical mechanism 24, the engagement structures 26 and the mounting structure-side identification member 28 are placed in the housing space 21A that is inside of the mounting structure 20.

The liquid introducing structure 22 includes a liquid injection needle 223 and a mounting structure-side cylindrical member 221. The liquid injection needle 223 has a center axis 22CT that is extended along the Y-axis direction. The liquid injection needle 223 is hollow inside and has a flow path that is formed inside thereof to allow the liquid to flow in. In the mounting state, the liquid injection needle 223 is connected with a liquid supply portion of the cartridge 30 described later and causes the liquid supplied from the liquid supply portion to flow inside of the liquid injection needle 223. A base end (+Y-axis direction side end) of the liquid injection needle 223 is arranged to communicate with the first tube 98.

The mounting structure-side cylindrical member 221 is arranged to surround the outer circumference of the liquid injection needle 223 about the center axis 22CT. The mounting structure-side cylindrical member 221 is also arranged to place the liquid injection needle 223 inside thereof. The mounting structure-side cylindrical member 221 has a −Y-axis direction side end that is open. The center axis of the mounting structure-side cylindrical member 221 is identical with the center axis 22CT of the liquid injection needle 223.

The apparatus-side electrical mechanism 24 includes electrical connecting elements 242 as terminals, a placement base 241 which the electrical connecting elements 242 are placed on, and mounting structure-side projections 245. In the mounting state, the apparatus-side electrical mechanism 24 is located on an opposite direction of gravity side (+Z-axis direction side) of the liquid introducing structure 22.

Figure 7:
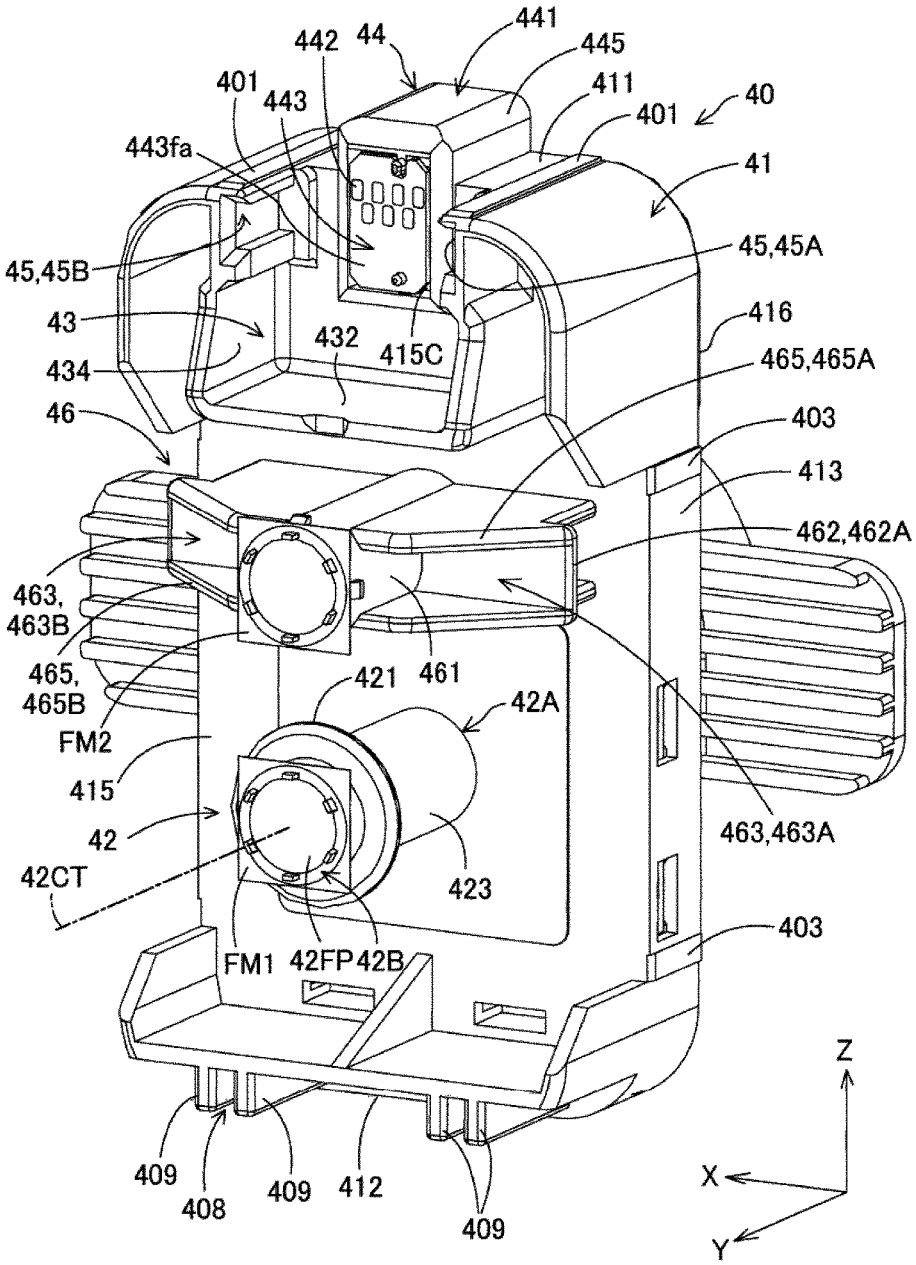
FIG. 7 is a first perspective view illustrating a connector.

The electrical connecting element 242 is a metal plate-like member that is elastically deformable. Part of the electrical connecting element 242 is exposed on a surface 241*fa* of the placement base 241. The surface 241*fa* is a plane parallel to the X-axis direction and the Z-axis direction in the mounting state. The electrical connecting element 242 is elastically deformed about a bend formed inside of the placement base 241 as a supporting point, so that the exposed part on the surface 241*fa* is displaced in a direction including a Y-axis direction component. Seven electrical connecting elements 242 are provided (as shown in FIG. 7) and are comprised of four electrical connecting elements 242 forming a line LN1 along the X-axis direction and three electrical connecting elements 242 forming a line LN2 that is located below (on a −Z-axis direction side of) the line LN1 and is along the X-axis direction. The electrical connecting elements 242 are electrically connected with the controller 16 (shown in FIG. 1) by wiring (not shown).

The placement base 241 (shown in FIG. 3) has an approximately rectangular parallelepiped external shape. The electrical connecting elements 242 are arranged on the placement base 241 such that part of each electrical connecting element 242 is exposed on the surface 241*fa*. An upper side portion of the placement base 241 is placed inside of a recess 243 provided in the mounting structure 20. The recess 243 is a portion that forms part of the housing space 21A and that is recessed toward the +Z-axis direction side from its periphery in the mounting state.

The mounting structure-side projections 245 (shown in FIG. 5) are provided on respective side faces in the X-axis direction of the placement base 241. In other words, two mounting structure-side projections 245 are provided. The mounting structure-side projection 245 is a columnar member that is extended along the Y-axis direction. In the mounting state, with regard to the Z-axis direction, at least parts of the mounting structure-side projections 245 are located in a range where the electrical connecting elements 242 are located. The two mounting structure-side projections 245 are members configured to restrict the motion of the cartridge 30 in the X-axis direction and in the Y-axis direction in the mounting process of the cartridge 30 and thereby position contact portions (described later) relative to the electrical connecting elements 242 in the X-axis direction and in the Z-axis direction.

Two engagement structures 26 (shown in FIGS. 3 and 4) are provided. In the mounting state of the cartridge 30, the engagement structures 26 engage with part of the cartridge 30 (described later in detail), so as to restrict the motion of the cartridge 30 relative to the mounting structure 20 in the −Y-axis direction and in the X-axis direction.

Out of the two engagement structures 26, the engagement structure 26 located on a −X-axis direction side (mounting structure third surface 213—side) of the electrical connecting elements 242 and the liquid introducing structure 22 is called "first engagement structure 26A". Out of the two engagement structures 26, the engagement structure 26 located on a +X-axis direction side (mounting structure fourth surface 214—side) of the electrical connecting elements 242 and the liquid introducing structure 22 is called "second engagement structure 26B". In the mounting state, with regard to the Z-axis direction, the engagement structures 26 are located between the electrical connecting elements 242 and the liquid introducing structure 22. The engagement structure 26 is a columnar member that is extended from the mounting structure fifth surface 215 toward the opening 216—side (−Y-axis direction side). The engagement structure 26 has an engagement claw 262 on its −Y-axis direction side end. The engagement claw 262 is formed to be bent inward in the housing space 21A. When two engagement claws 262 are to be distinguished from each other, the two engagement claws 262 are respectively expressed by reference signs "262A" and "262B".

The engagement claw 262B of the second engagement structure 26B (shown in FIG. 3) is provided on its −Y-axis direction side end and is bent in the −X-axis direction. The engagement claw 262A of the first engagement structure 26A (shown in FIG. 4) is provided on its −Y-axis direction side end and is bent in the +X-axis direction. The engagement structure 26 includes a compression coil spring that is provided on its +Y-axis direction side end and serves as a pressing member to displace the engagement claw 262 in a direction including an X-axis direction component. The compression coil springs are compressed by pressing the release elements 292 provided in the mounting structure third surface 213 and the mounting structure fourth surface 214. This displaces the engagement claw 262B in the +X-axis direction and the engagement claw 262A in the −X-axis direction and thereby releases the engagement with the cartridge 30. The details of the engagement and the release of engagement will be described later.

The mounting structure-side identification member 28 (shown in FIG. 3) includes a projection (projections) protruded from a bottom face of the housing space 21A toward the opposite direction of gravity (+Z-axis direction). The mounting structure-side identification member 28 is a member used to identify whether the cartridge 30 that is to be mounted to the mounting structure 20 is a correct cartridge 30 configured to supply a corresponding type of liquid that corresponds to the mounting structure 20. In the case of the cartridge 30 configured to supply a non-corresponding type of liquid, the cartridge 30 collides with the mounting structure-side identification member 28 and is thus not mountable to the mounting structure 20. The mounting structure-side identification member 28 differs in at least one of the number of the projections, the shape of the projection and the position of the projection according to the type of the liquid (for example, the color of the liquid) that is flowed in the liquid introducing structure 22. In other words, the mounting structure-side identification member 28 has a different shape pattern of projections according to the type of the liquid that is flowed in the liquid introducing structure 22.

A-3. Configuration of Cartridge

Figure 6:
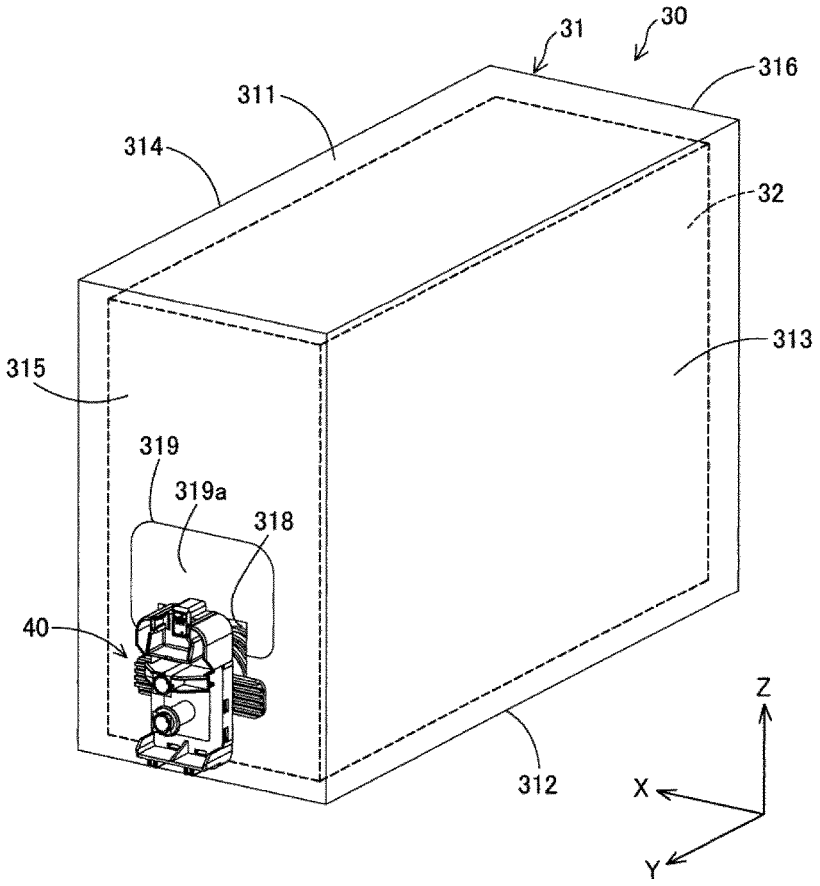
FIG. 6 is an external view illustrating the cartridge.

FIG. 6 is an external view illustrating the cartridge 30. The cartridge 30 includes a liquid container body 32, a liquid container case 31 configured to place the liquid container body 32 therein, and a connector 40 configured to be connected with the mounting structure 20.

The liquid container case 31 is formed in an approximately rectangular parallelepiped external shape. According to this embodiment, the liquid container case 31 is made of cardboard. According to another embodiment, the liquid container case 31 may be made of another material (for example, a synthetic resin such as polypropylene or polyethylene). The liquid container case 31 includes a case first surface (case first wall) 311, a case second surface (case second wall) 312, a case third surface (case third wall) 313, a case fourth surface (case fourth wall) 314, a case fifth surface (case fifth wall) 315, and a case sixth surface (case sixth wall) 316.

In the mounting state of the cartridge 30, the case first surface 311 forms an upper face, the case second surface 312 forms a bottom face. The case third surface 313 forms one side face, and the case fourth surface 314 forms the other side face. The case fifth surface 315 forms a front face that is opposed to the mounting structure 20, and the case sixth surface 316 form a rear face. The case first surface 311 and the case second surface 312 are opposed to each other in the Z-axis direction. The case third surface 313 and the case fourth surface 314 are opposed to each other in the X-axis direction. The case fifth surface 315 and the case sixth surface 316 are opposed to each other in the Y-axis direction. An opening 318 is formed in the case fifth surface 315 to place the connector 40 inserted therein. In use of the cartridge 30 to supply the liquid contained in the liquid container body 32 to the mounting structure 20, part of the connector 40 is exposed outside of the liquid container case 31. In non-use of the cartridge 30, for example, during transportation of the cartridge 30, on the other hand, the entire connector 40 may be placed inside of the liquid container case 31. For example, the connector 40 may be placed inside of the liquid container case 31 by opening an openable lid 319*a* provided by a cut line 319 formed in the case fifth surface 315. According to another embodiment, the cartridge 30 may not be provided with the liquid container case 31.

The liquid container body 32 is configured to contain the liquid (ink) that is to be supplied to the mounting structure 20. The liquid container body 32 is a bag body that is filled with the liquid. The liquid container body 32 is arranged to communicate with a liquid supply portion of the connector 40 described later. When the liquid contained in the liquid container body 32 is consumed and used up to no remaining amount or little remaining amount, the liquid container body 32 and the connector 40 are replaced with new ones.

The connector 40 is electrically connected with the electrical connecting elements 242 of the mounting structure 20 and is connected with the liquid injection needle 223 of the mounting structure 20. This configuration enables the cartridge 30 to transmit electrical signals to and from the controller 16 (shown in FIG. 1) and causes the liquid contained in the liquid container body 32 to be supplied to the liquid consuming portion 14.

Figure 8:
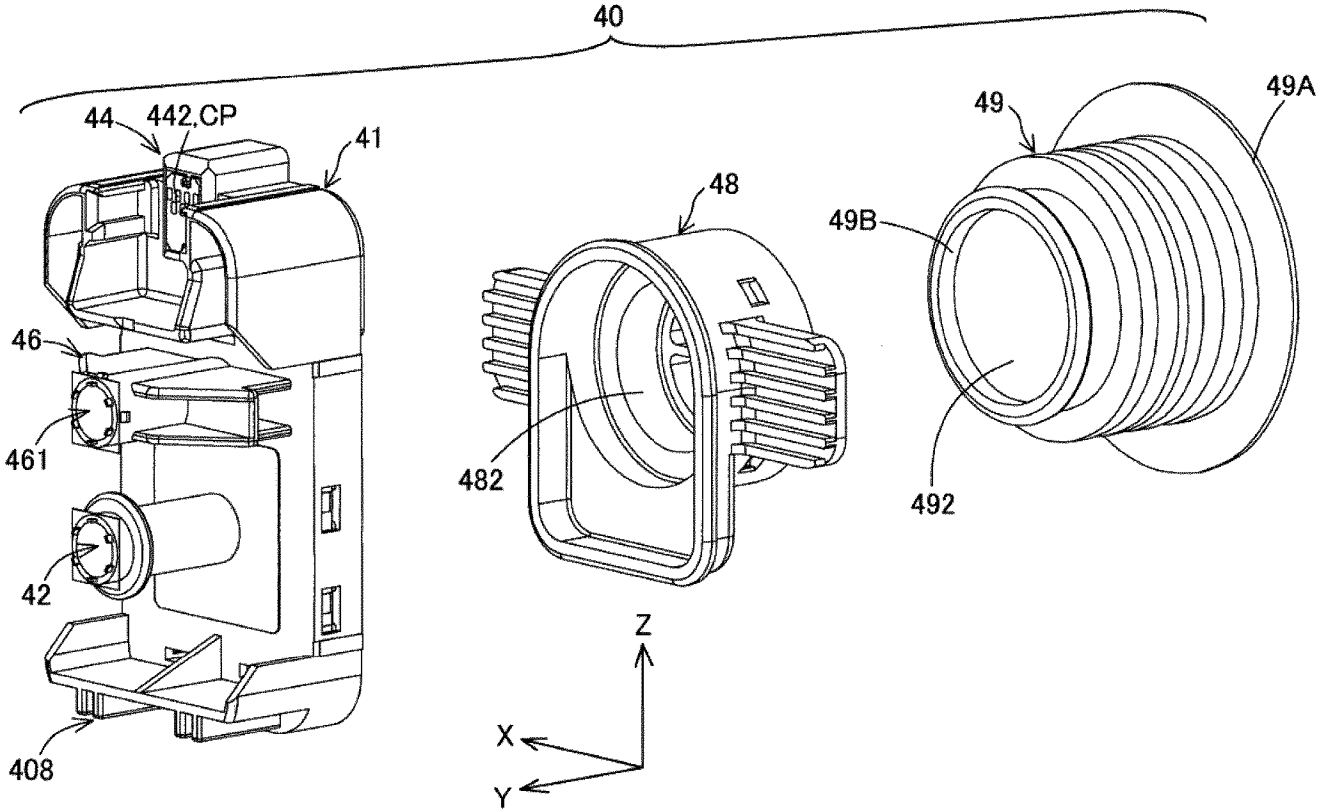
FIG. 8 is an exploded perspective view illustrating the connector.
Figure 9:
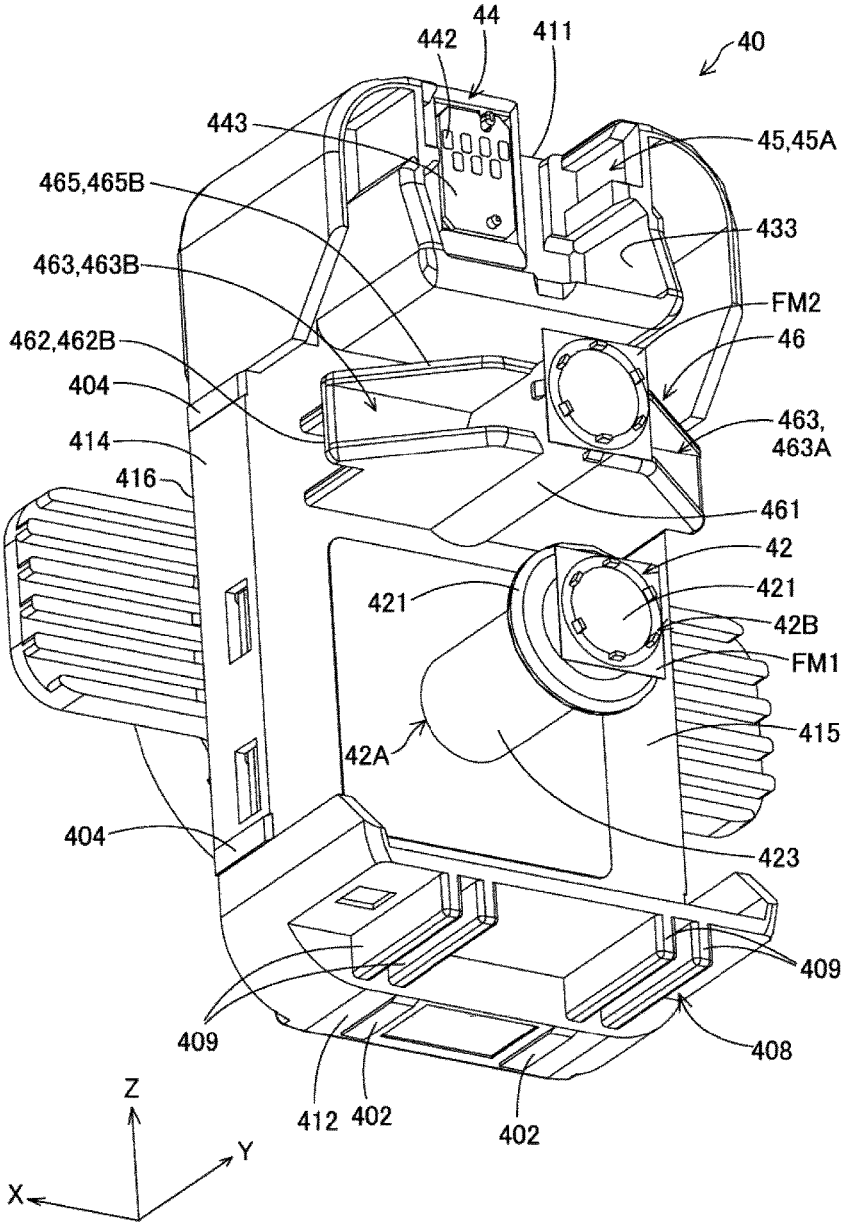
FIG. 9 is a second perspective view illustrating the connector.
Figure 10:
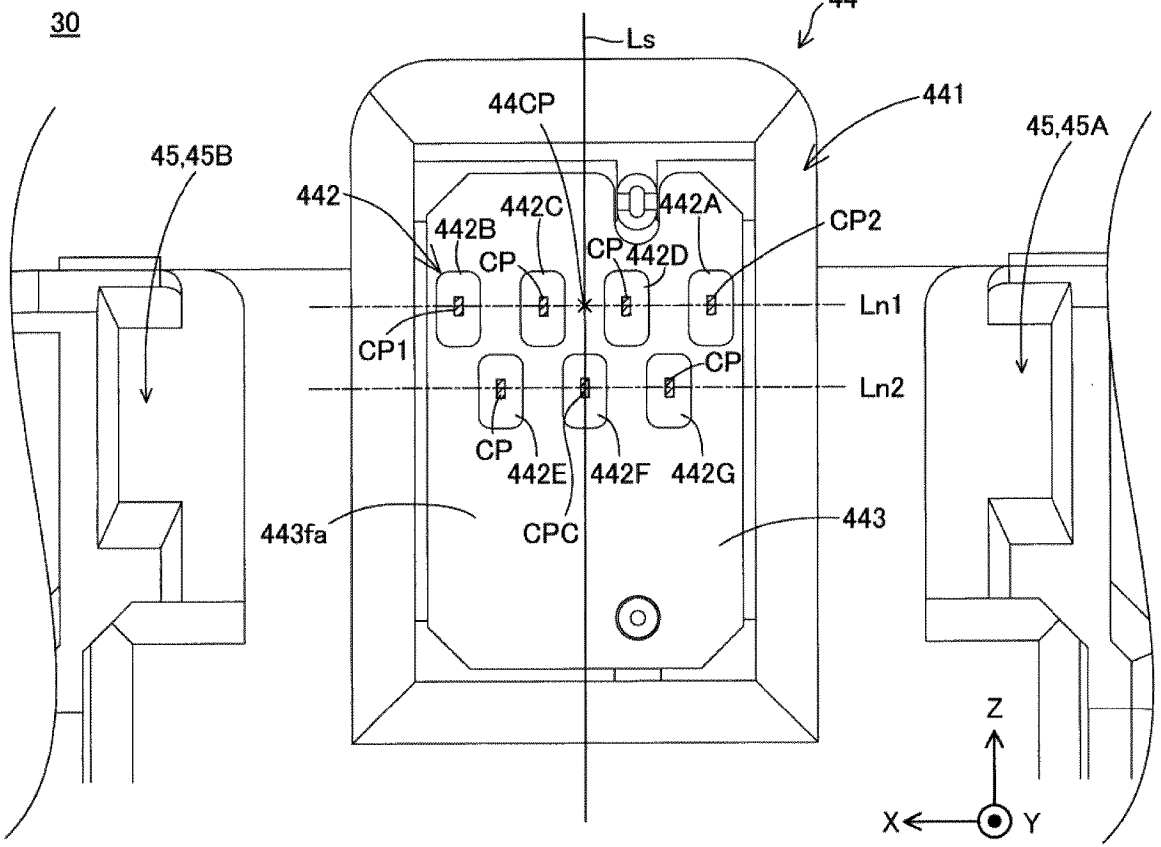
FIG. 10 is a front view illustrating the periphery of a circuit board of the connector.
Figure 11:
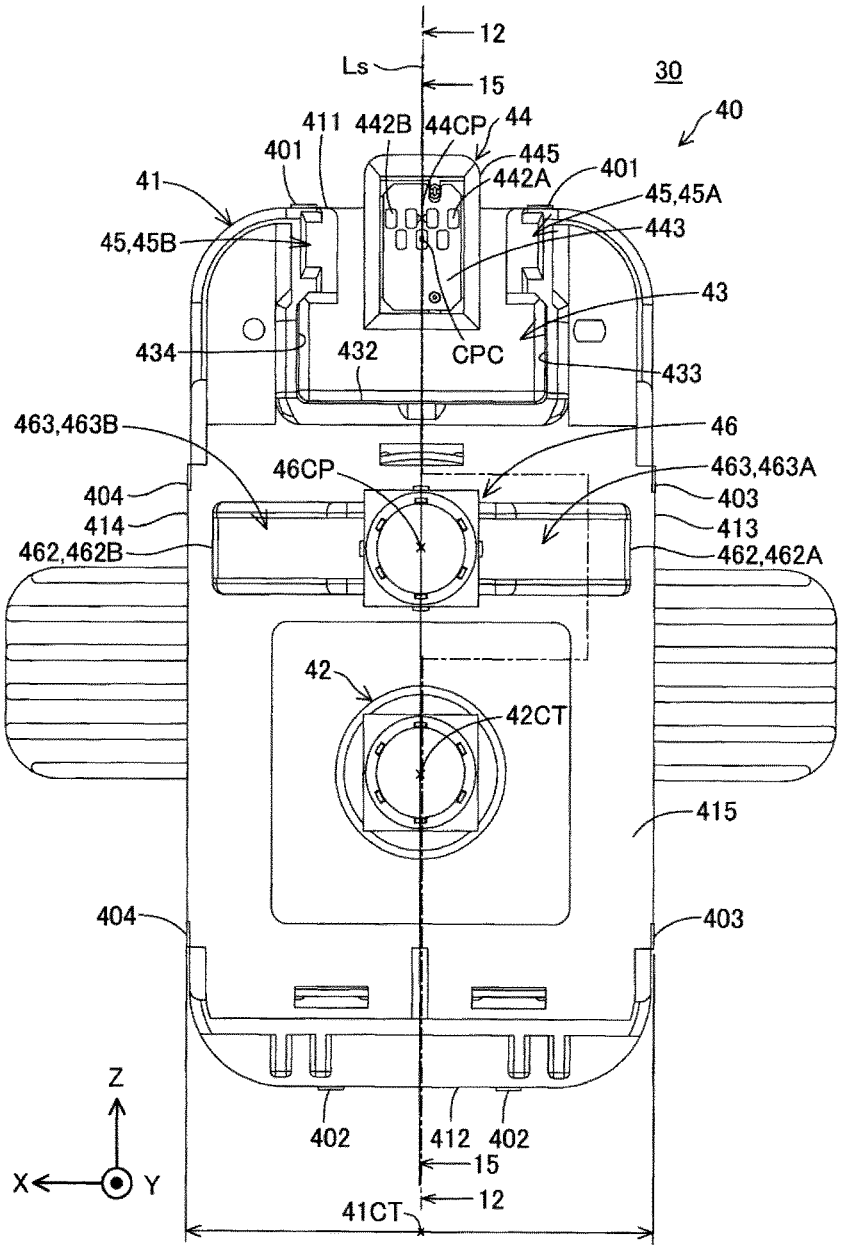
FIG. 11 is a front view illustrating the connector.
Figure 12:
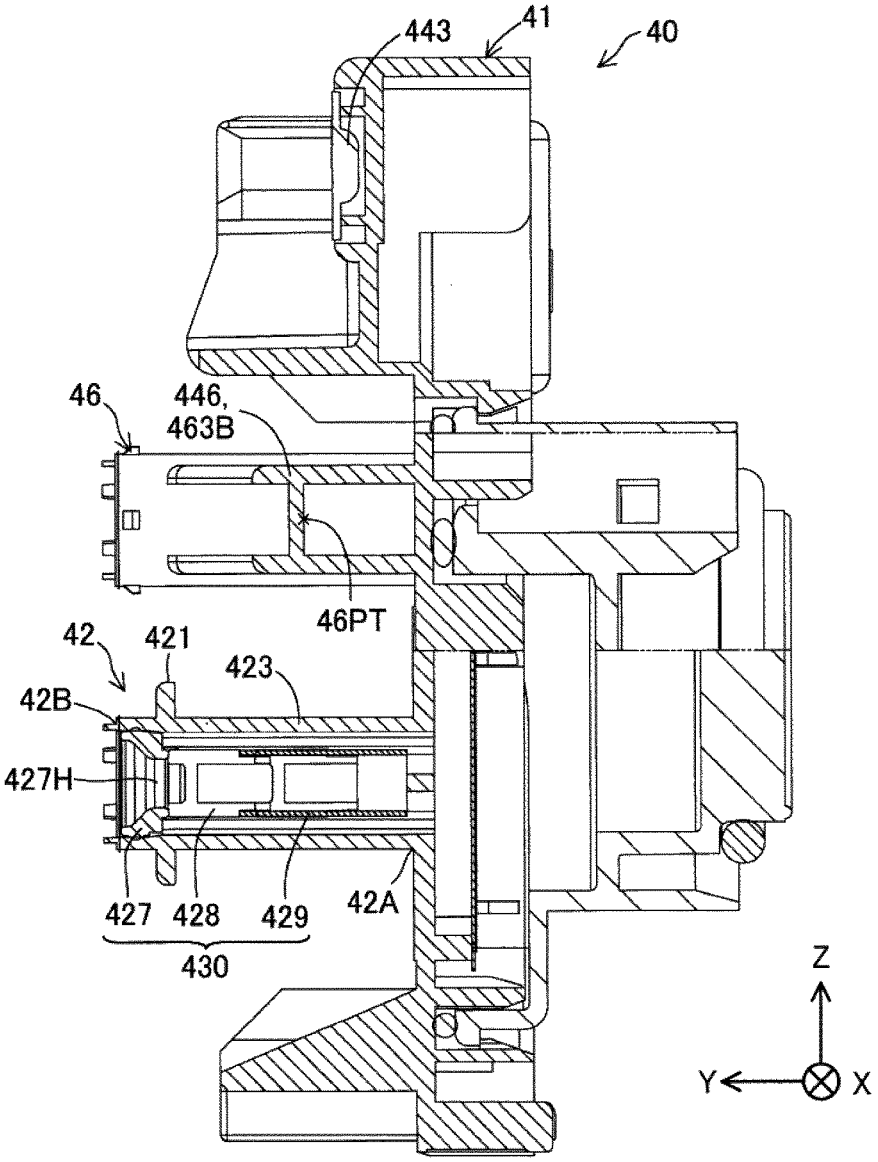
FIG. 12 is a sectional view taken on a line 12-12 of FIG. 11.
Figure 13:
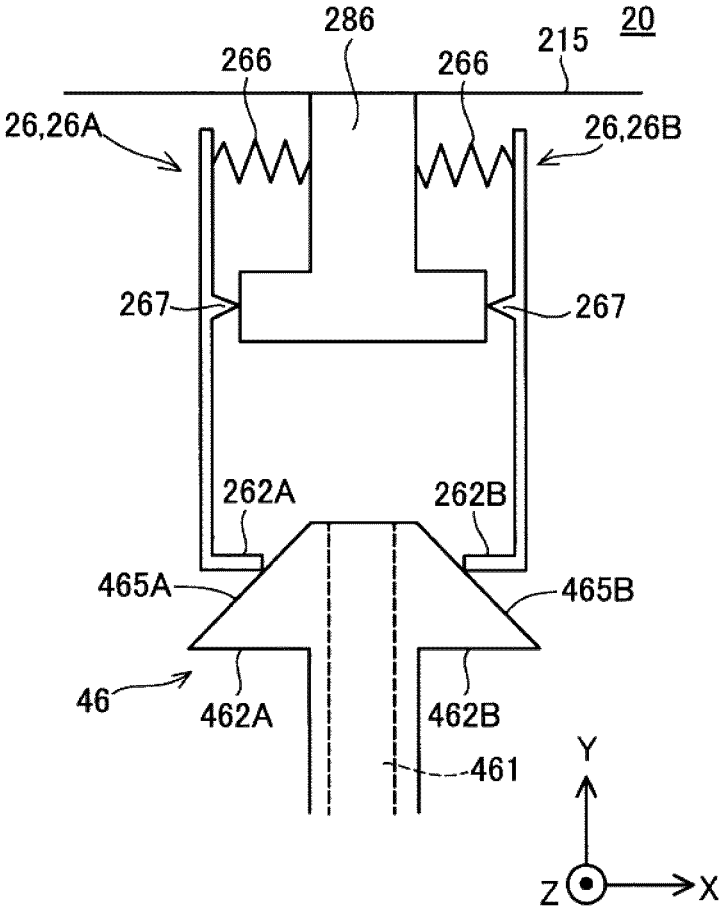
FIG. 13 is a diagram illustrating a mounting process of the cartridge.
Figure 14:
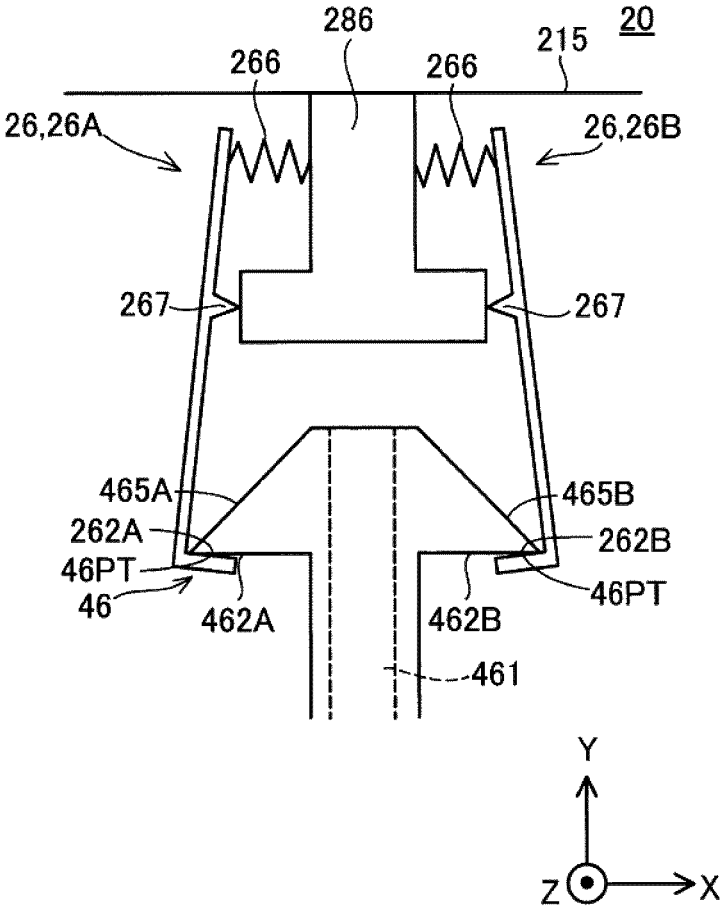
FIG. 14 is a diagram illustrating the mounting state of the cartridge.

FIG. 7 is a first perspective view illustrating the connector 40. FIG. 8 is an exploded perspective view illustrating the connector 40. FIG. 9 is a second perspective view illustrating the connector 40. FIG. 10 is a front view illustrating the periphery of a circuit board 443 of the connector 40. FIG. 11 is a front view illustrating the connector 40. FIG. 12 is a sectional view taken on a line 12-12 of FIG. 11. FIG. 13 is a diagram illustrating a mounting process of the cartridge 30. FIG. 14 is a diagram illustrating the mounting state of the cartridge 30.

The connector 40 (shown in FIG. 8) includes a main body member 41, an intermediate member 48 and a supply member 49. Assembling the respective members 41, 48 and 49 forms the connector 40.

The supply member 49 is a tubular member. One end 49A-side of the supply member 49 is mounted to the liquid container body 32 by thermal welding or the like. The other end 49B-side of the supply member 49 fit in the intermediate member 48 via an O-ring (not shown). The supply member 49 forms a flow path 492 which the liquid contained in the liquid container body 32 flows in. The supply member 49 is made of, for example, a synthetic resin such as polyethylene.

The intermediate member 48 is a member located between the main body member 41 and the supply member 49. The intermediate member 48 forms a flow path 482 which the liquid flowing through the flow path 492 of the supply member 49 flows in. The intermediate member 48 is made of, for example, a synthetic resin such as polypropylene. An opposite side portion of the intermediate member 48 that is opposite to the side where the supply member 49 is located is fit in the main body member 41 via an O-ring (not shown).

The main body member 41 is placed in the housing space 21A (shown in FIG. 3) that is inside of the mounting structure 20 in the mounting state. The main body member 41 is provided with a liquid supply portion 42, contact portions CP, a positioning structure 46 and a liquid injection portion 461 as described later. The main body member 41 forms a flow path including the liquid supply portion 42 which the liquid flowing through the flow path 482 of the intermediate member 48 flows in. The main body member 41 is made of, for example, a synthetic resin such as polypropylene. According to another embodiment, the connector 40 may be formed by a single member (for example, the main body member 41).

The main body member 41 (shown in FIGS. 7 and 9) is formed in an approximately rectangular parallelepiped external shape. The main body member 41 includes a first surface (first wall) 411, a second surface (second wall) 412, a third surface (third wall) 413, a fourth surface (fourth wall) 414, a fifth surface (fifth wall) 415 and a sixth surface (sixth wall) 416.

In the mounting state, the first surface 411 forms a +Z-axis direction side end face (upper face). In the mounting state, the second surface 412 forms a −Z-axis direction side end face (bottom face). In the mounting state, the third surface 413 forms a −X-axis direction side end face (one side face). In the mounting state, the fourth surface 414 forms a +X-axis direction side end face (the other side face). In the mounting state, the fifth surface 415 forms a +Y-axis direction side end face (front face). In the mounting state, the sixth surface 416 forms an opening which the intermediate member 48 is fit in. The first surface 411 and the second surface 412 are portions opposed in the Z-axis direction to inner faces of the housing space 21A of the mounting structure 20. The third surface 413 and the fourth surface 414 are portions opposed in the X-axis direction to inner faces of the housing space 21A of the mounting structure 20.

The main body member 41 (shown in FIGS. 7 and 9) has projections 401, 402, 403 and 404. The projections 401, 402, 403 and 404 serve to suppress rotation of the main body member 41 about a center axis 42CT (shown in FIG. 7, described later) in the process of mounting the cartridge 30 to the mounting structure 20 and in the mounting state. More specifically, when the main body member 41 starts rotating about the center axis 42CT, some of the projections 401, 402, 403 and 404 hit against the inner face of the housing space 21A. This configuration suppresses rotation of the main body member 41. This accordingly reduces the possibility that the main body member 41 has position misalignment relative to the mounting structure 20 in the mounting state or in the mounting process.

The projections (first projections) 401 (shown in FIG. 7) are protruded from the first surface 411 in the +Z-axis direction. Two projections 401 are provided to be arranged across the center of the main body member 41 in the X-axis direction. The projections 401 are extended along the Y-axis direction on the first surface 411. The projections (second projections) 402 (shown in FIG. 9) are protruded from the second surface 412 in the −Z-axis direction. Two projections 402 are provided to be arranged across the center of the main body member 31 in the X-axis direction. The projections 402 are extended along the Y-axis direction on the second surface 412. The projections (third projections) 403 (shown in FIG. 7) are protruded from the third surface 413 in the −X-axis direction. Two projections 403 are provided to be arranged across the center of the main body member 41 in the Z-axis direction. The projections 403 are extended along the Y-axis direction on the third surface 413. The projections (fourth projections) 404 (shown in FIG. 9) are protruded from the fourth surface 414 in the +X-axis direction. Two projections 404 are provided to be arranged across the center of the main body member 41 in the Z-axis direction. The projections 404 are extended along the Y-axis direction on the fourth surface 414.

With regard to the Z-axis direction or the X-axis direction described above, the numbers of the projections 401 to 404 provided on the portions (first surface 411 to fourth surface 414) opposed to the inner faces of the mounting structure 20 are not limited to those of the above embodiment. For example, the number of each of the projections 401 to 404 may be only one or may be three or more. In another example, some of the projections 401 to 404 may be omitted. In any of such configurations, at least one of the projections 401 to 404 serves to suppress rotation of the main body member 41 about the center axis 42CT in the process of mounting the cartridge 30 to the mounting structure 20 and in the mounting state.

The main body member 41 (shown in FIG. 7) further includes a liquid supply portion 42, a main body-side electrical mechanism 44, a guide structure 43, a positioning structure 46, a main body-side identification member 408 and a liquid injection portion 461.

The liquid supply portion 42 is detachably connected with the liquid introducing structure 22 (more specifically, the liquid injection needle 223) of the mounting structure 20 to supply the liquid to the liquid introducing structure 22 (more specifically, the liquid injection needle 223). The liquid supply portion 42 is inserted in the mounting structure-side cylindrical member 221 of the liquid introducing structure 22 in the mounting process and in the mounting state of the cartridge 30.

The liquid supply portion 42 (shown in FIG. 7) includes a base end 42A that is connected with the fifth surface 415 and a leading end 42B that forms an opening 42FP configured to receive the liquid introducing structure 22 (more specifically, the liquid injection needle 223). In the non-use state prior to mounting the cartridge 30 to the mounting structure 20, a film FM1 is attached to the opening 42FP to close the opening 42FP. The film FM1 is broken by the liquid injection needle 223 (shown in FIG. 3) in the process of mounting the cartridge 30 to the mounting structure 20. According to another embodiment, the film FM1 may be removed by the user before the cartridge 30 is mounted to the mounting structure 20.

The liquid supply portion 42 also has the center axis 42CT that is extended in a direction (Y-axis direction) along the +Y-axis direction from the base end 42A toward the leading end 42B. The center axis 42CT is a center axis of a flow portion 423 in a cylindrical shape (described later) of the liquid supply portion 42. As shown in FIG. 11, the center axis 42CT is located at a center 41CT of the main body member 41 in the X-axis direction.

The liquid supply portion 42 (shown in FIG. 7) further includes a flow portion 423 and a supply portion protrusion 421. The flow portion 423 is a cylindrical member that forms a flow path which the liquid flows in. The flow portion 423 includes the base end 42A and the leading end 42B of the liquid supply portion 42. The liquid injection needle 223 is inserted in the flow portion 423.

The supply portion protrusion 421 is protruded outward from an outer surface of the flow portion 423 that forms the outer circumference of the flow portion 423 about the center axis 42CT. The supply portion protrusion 421 is formed in a ring shape around the whole circumference of the outer surface of the flow portion 423. The supply portion protrusion 421 works in cooperation with the mounting structure-side cylindrical member 221 to restrict the motion of the flow portion 423 in the process of mounting the cartridge 30 to the mounting structure 20 and in the mounting state of the cartridge 30. More specifically, the supply portion protrusion 421 is inserted in the mounting structure-side cylindrical member 221 across a small clearance from the inner face of the mounting structure-side cylindrical member 221. When the flow portion 423 moves relative to the mounting structure 20 in a radial direction (i.e., a direction that is perpendicular to the center axis 42CT and is along an X-Z plane that is parallel to the X-axis direction and the Z-axis direction), the supply portion protrusion 421 hits against the inner face of the mounting structure-side cylindrical member 221, so as to restrict the motion of the flow portion 421 in the direction perpendicular to the center axis 42CT. This configuration accordingly suppresses position misalignment of the flow portion 423 relative to the liquid injection needle 223 in the mounting process and in the mounting state. Suppressing the position misalignment of the flow portion 423 relative to the liquid injection needle 223 reduces the possibility that the liquid is leaked from the flow portion 423 to outside in the mounting process and in the mounting state.

The liquid supply portion 42 (shown in FIG. 12) further includes a valve mechanism 430 that is placed inside of the flow portion 423 (i.e., in the flow path of the flow portion 423). The valve mechanism 430 serves to open and close the flow path of the flow portion 423. The valve mechanism 430 is provided with a valve seat 427, a valve element 428 and a pressing member 429 that are arranged sequentially from the leading end 42B-side toward the base end 42A-side.

The valve seat 427 is a member in an approximately annular shape. The valve seat 427 is formed by an elastic body of, for example, a rubber or an elastomer. The valve seat 427 is press fit in the flow portion 423. The valve seat 427 forms a valve hole 427H which the liquid flows in.

The valve element 428 is a member in an approximately cylindrical shape. The valve element 428 comes into contact with the valve seat 427 to close the valve hole 427H in the state prior to mounting the cartridge 30 to the mounting structure 20. The valve element 428 is, for example, displaced in the −Y-axis direction by a force (external force) input from the liquid injection needle 223 to be separated from the valve seat 427.

The pressing member 429 is a compression coil spring. The pressing member 429 serves to press the valve element 428 toward the valve seat 427. In the mounting state of the cartridge 30, the liquid injection needle 223 (shown in FIG. 3) presses the valve element 428 in a direction away from the valve seat 427 and causes the valve element 428 to be separated from the valve seat 427. This sets the flow portion 423 in open position.

The main body-side electrical mechanism 44 (shown in FIG. 7) includes a circuit board 443 and a contact portion placement structure 441 provided to place the circuit board 443 including contact portions described later. The contact portion placement structure 441 is formed integrally with the main body member 41. The contact portion placement structure 441 includes a recess 415C that is formed in the fifth surface 415. The circuit board 443 is arranged in the recess 415C such that the direction of a normal vector of a placement surface 443*fa* that is a surface of the circuit board 443 is the +Y-axis direction. The contact portion placement structure 441 also includes an upper protruded portion 445 that is protruded in the +Z-axis direction from the first surface 411. The upper protruded portion 445 is formed in an approximately rectangular parallelepiped external shape that corresponds to the shape of the recess 243 of the mounting structure 20 (shown in FIG. 3). In the mounting state of the cartridge 30, at least part of the upper protruded portion 445 including its upper end is placed in the recess 243. More specifically, in the mounting state, at least part of the upper protruded portion 445 is placed in the recess 243 across a small clearance.

The circuit board 443 (shown in FIG. 10) includes main body-side terminals 442 provided on the placement surface 443*fa* and a storage device (not shown) provided on a rear face. The placement surface 443*fa* and the rear face are both planes. The placement surface 443*fa* is a plane parallel to the X-Z plane that is parallel to the X-axis direction and the Z-axis direction. In other words, the placement surface 443*fa* is a plane perpendicular to a direction along the center axis 42CT (Y-axis direction). The main body-side terminals 442 including contact portions CP described later are placed on the placement surface 443*fa*.

Seven main body-side terminals 442 are provided. When the seven main body-side terminals 442 are to be distinguished from one another, the seven main body-side terminals are expressed by reference signs "442A", "442B", "442C", "442D", "442E", "442F" and "442G". The seven main body-side terminals 442A to 442G denote seven terminals including a power supply terminal, a grounding terminal, a data terminal, a clock terminal, a reset terminal, a first mounting detection terminal and a second mounting detection terminal. Which of the seven terminals (for example, power supply terminal) is to be allocated to each of the main body-side terminals 442A to 442G is determined arbitrarily. The reset terminal receives supply of a reset signal to the storage device. The clock terminal receives supply of a clock signal to the storage device. The power supply terminal receives a power supply voltage VDD (for example, rated voltage of 3.3 V) to the storage device. The grounding terminal receives supply of a grounding voltage VSS (0 V) to the storage device. The data terminal receives supply of a data signal SDA to the storage device. The first mounting detection terminal and the second mounting detection terminal are used to check the quality (good or bad) of electrical contact with the corresponding electrical connecting element 242 and thereby causes the liquid consuming apparatus 10 to detect whether the cartridge 30 is mounted to the mounting structure 20. The number of the main body-side terminals 442 and the functions of the respective terminals may be changed appropriately.

The storage device of the circuit board 443 stores information regarding the cartridge 30 (for example, color information regarding the color of the liquid and information regarding the remaining amount of the liquid) and the like.

Each of the seven main body-side terminals 442A to 442G is formed in an approximately rectangular shape. The seven main body-side terminals 442A to 442G are arranged to form two lines Ln1 and Ln2 at different positions in the Z-axis direction. The lines Ln1 and Ln2 are parallel to the X-axis direction.

Each of the main body-side terminals 442A to 442G has a contact portion CP that is formed in its center and that is configured to come into contact with a corresponding electrical connecting element 242 in the mounting state. In the mounting state, the respective contact portions CP are located on a +Z-axis direction side of the liquid supply portion 42. The cartridge 30 has the liquid supply portion 42 on a −Z-axis direction side or gravity direction side of the contact portions CP. This configuration reduces the possibility that the contact portion CP is stained with the liquid even when the liquid is leaked out from the liquid supply portion 42. This reduces the possibility of a short circuit between a plurality of contact portions CP caused by the liquid adhering to the contact portion CP.

The above lines Ln1 and Ln2 may be regarded as lines formed by a plurality of the contact portions CP. In the mounting state, the contact portions CP are in contact with and are thereby electrically connected with the electrical connecting elements 242. This configuration enables, for example, data signals to be transmitted between the storage device of the circuit board 443 and the controller 16 of the liquid consuming apparatus 10.

The seven contact portions CP are placed at different positions in the X-axis direction. According to this embodiment, the seven contact portions CP are arranged in zigzag in the X-axis direction. Among the seven contact portions CP, a contact portion located on a most +X-axis direction side in the X-axis direction is called first contact portion CP1, and a contact portion located on a most −X-axis direction side in the X-axis direction is called second contact portion CP2. According to this embodiment, the first contact portion CP1 and the second contact portion CP2 are located on the line Ln1 along the X-axis direction. As shown in FIG. 10, when the cartridge 30 is viewed from the +Y-axis direction side, the center of the interval between the first contact portion CP1 and the second contact portion CP2 in the X-axis direction is called center 44CP. More specifically, the center 44CP is the center of the interval in the X-axis direction between a +X-axis direction side end of the first contact portion CP1 and a −X-axis direction side end of the second contact portion CP2.

Among the seven contact portions CP, an odd number of (more specifically, three) contact portions CP along the X-axis direction form the line Ln2. A contact portion located on the center (in the middle) of this odd number of contact portions CP is called "center contact portion CPC". The center contact portion CPC is located at the same position as that of the center 44CP in the X-axis direction. As shown in FIG. 11, the center contact portion CPC is located at the center 41CT of the main body member 41 in the X-axis direction.

The guide structure 43 (shown in FIG. 7) is protruded in the +Y-axis direction from the fifth surface 415. The guide structure 43 serves to guide the electrical connecting elements 242 to the contact portions CP. More specifically, in the mounting process, the guide structure 43 guides the electrical connecting elements 242 to the contact portions CP while restricting the motion of the contact portions CP relative to the electrical connecting elements 242 in the direction perpendicular to the center axis 42CT (i.e., direction along the X-Z plane).

The guide structure 43 is formed in a concave shape that is open on its +Y-axis direction side and +Z-axis direction side. The guide structure 43 includes a first side face (first side wall) 433 (shown in FIG. 9) located on the −X-axis direction side, a second side face (second side wall) 434 (shown in FIG. 7) located on the +X-axis direction side and a bottom face (bottom wall) 432 (shown in FIG. 7) located on the −Z-axis direction side. The fifth surface 415 forms the −Y-axis direction side of the guide structure 43. The placement base 241 (shown in FIG. 3) is inserted in the guide structure 43 in the concave shape.

The guide structure 43 also includes a groove 45A formed in the first side face 433 (shown in FIG. 9) and a groove 45B formed in the second side face 434 (shown in FIG. 7). When the grooves 45A and 45B are not to be distinguished from each other, these grooves are expressed by a reference sign "45". The grooves 45A and 45B are arranged across the contact portions CP in the X-axis direction.

The grooves 45A and 45B are extended along the Y-axis direction. The groove 45A is provided to receive the mounting structure-side projection 245 on the −X-axis direction side (shown in FIG. 3) in the mounting process and in the mounting state. The groove 45B is provided to receive the mounting structure-side projection 245 on the +X-axis direction side (shown in FIG. 3) in the mounting process and in the mounting state. In the mounting process, insertion of the mounting structure-side projections 245 in the grooves 45A and 45B restricts the motion of the contact portions CP relative to the electrical connecting elements 242 in the direction perpendicular to the center axis 42CT (i.e., direction along the X-Z plane), while guiding the electrical connecting elements 242 to the contact portions CP. This configuration suppresses position misalignment of the contact portions CP relative to the electrical connecting elements 242 in the mounting process.

The grooves 45A and 45B (shown in FIG. 10) are formed in the same positions as that of the contact portions CP in the Z-axis direction. The "same position" herein means that at least part of any one of the plurality of contact portions CP is located in a range where the groove 45 is located. According to this embodiment, the grooves 45A and 45B are formed in the same positions as that of the contact portions CP forming the line Ln2 in the Z-axis direction. This configuration further suppresses position misalignment of the contact portions CP relative to the electrical connecting elements 242 in the mounting process.

In the mounting state, the positioning structure 46 (shown in FIG. 7) is located between the liquid supply portion 42 and the circuit board 443 including the contact portions CP in the Z-axis direction. The positioning structure 46 engages with the engagement claws 262 of the engagement structures 26, so as to restrict the motion of the cartridge 30 (more specifically, the main body member 41) relative to the mounting structure 20 in at least the −Y-axis direction. According to this embodiment, the positioning structure 46 serves to restrict the motion of the cartridge 30 (more specifically, the main body member 41) relative to the mounting structure 20 in the −Y-axis direction and in the X-axis direction.

The positioning structure 46 is protruded in the +Y-axis direction from the fifth surface 415. The positioning structure 46 includes positioning projections 463. As shown in FIG. 11, when the cartridge 30 is viewed from the +Y-axis direction side, the center of the positioning structure 46 in the X-axis direction is called "center 46CP".

Two positioning projections 463 (shown in FIG. 7) are provided across the liquid injection portion 461 in the X-axis direction. The positioning projection 463 located on the −X-axis direction side is called "first positioning projection 463A", and the positioning projection 463 located on the +X-axis direction side is called "second positioning projection 463B".

The first positioning projection 463A includes a first engaged element 462A and a first protruded guide element 465A. The first engaged element 462A engages with the engagement claw 262A of the first engagement structure 26A (shown in FIG. 4) in the mounting state. The first engagement structure 26A is a surface that faces in the −Y-axis direction.

The first protruded guide element 465A is formed by a +Y-axis direction side end of the positioning structure 46. The first protruded guide element 465A is formed to be located on the −Y-axis direction side toward the −X-axis direction. The first engaged element 462A is connected with a −X-axis direction side end of the first protruded guide element 465A. The first protruded guide element 465A serves to guide the engagement claw 262A of the first engagement structure 26A to the first engaged element 462A in the mounting process.

A second protruded guide element 465B (shown in FIG. 9) is formed by a +Y-axis direction side end of the positioning structure 46. The second protruded guide element 465B is formed to be located on the −Y-axis direction side toward the +X-axis direction. A second engaged element 462B is connected with a +X-axis direction side end of the second protruded guide element 465B. The second engaged element 462B is arranged to be away from the first engaged element 462A in the X-axis direction. The second protruded guide element 465B serves to guide the engagement claw 262B of the second engagement structure 26B to the second engaged element 462B in the mounting process.

As shown in FIG. 13, in the mounting process, the engagement claw 262A of the first engagement structure 26A comes into contact with the first protruded guide element 465A, and the engagement claw 262B of the second engagement structure 26B comes into contact with the second protruded guide element 465B. When the positioning structure 46 moves in the +Y-axis direction relative to the mounting structure with the progress of the mounting process, the engagement claw 262A comes into contact with the first protruded guide element 465A and is guided toward the first engaged element 462A, while the engagement claw 262B comes into contact with the second protruded guide element 465B and is guided toward the second engaged element 462B. In this process, compression coil springs 266 of the engagement structures 26 are compressed, so that the two engagement claws 262A and 262B are displaced in the X-axis direction to be away from each other about supporting points 267 of the engagement structures 26 that abut on a support wall 286 protruded from the mounting structure fifth surface 215.

As shown in FIG. 14, when the engagement claws 262A and 262B reach the first engaged element 462A and the second engaged element 462B, the pressing forces of the compression coil springs 266 displace the engagement claw 262A in the +X-axis direction and displace the engagement claw 262B in the −X-axis direction. This causes the first engaged element 462A to be engaged with the engagement claw 262A and causes the second engaged element 462B to be engaged with the engagement claw 262B. Such engagement restricts the motion of the cartridge 30 relative to the mounting structure 20 in the −Y-axis direction. In the mounting state, the pressing forces of the compression coil springs 266 cause forces in the mutually approaching directions to be applied to the first engagement structure 26A and to the second engagement structure 26B. In the mounting process and in the mounting state, this causes the positioning structure 46 to be placed between the first engagement structure 26A and the second engagement structure 26B in the X-axis direction and thereby restricts the motion of the cartridge 30 relative to the mounting structure 20 in the X-axis direction.

As shown in FIGS. 12 and 14, the engagement positions of the positioning structure 46 with the engagement structures 26 are called "engagement positions 46PT".

The liquid injection portion 461 (shown in FIG. 7) is formed integrally with the positioning structure 46. According to another embodiment, the liquid injection portion 461 may be formed separately from the positioning structure 46. The liquid injection portion 461 is a cylindrical member that is extended along the Y-axis direction. The liquid injection portion 461 is arranged to communicate with the liquid container body 32 that is inside of the cartridge 30, via the flow path 482 and the flow path 492 (shown in FIG. 8). The liquid injection portion 461 is used to inject the liquid into the liquid container body 32 in the manufacturing process of the cartridge 30. After injection of the liquid into the liquid container body 32, the liquid injection portion 461 is closed by a film FM2, in order to prevent leakage of the liquid to outside. A valve mechanism similar to the valve mechanism 430 placed inside the flow portion 423 may be placed in the liquid injection portion 461. The liquid injection portion 461 and the positioning structure 46 are arranged at the same position in the Z-axis direction. The "same position" herein is not limited to the case where the center of the positioning structure 46 and the center of the liquid injection portion 461 are located at the same position in the Z-axis direction but also includes the case where the center of the positioning structure 46 in the Z-axis direction is located in a range where the liquid injection portion 461 is located. The configuration of arranging the liquid injection portion 461 and the positioning structure 46 at the same position in the Z-axis direction provides the liquid injection portion 461 with suppressing size expansion of the cartridge 30 in the Z-axis direction.

The main body-side identification member 408 (shown in FIG. 7) is a member that is fit in the mounting structure-side identification member 28 (shown in FIG. 3) in the mounting process, so as to identify the type of the liquid contained in the liquid container body 32 that is inside of the cartridge 30. The main body-side identification member 408 includes at least one projection 409. The main body-side identification member 408 differs in at least one of the number of the projections 409, the shape of the projection 409 and the position of the projection 409 according to the type of the liquid contained in the liquid container body 32. In other words, the main body-side identification member 408 has a different shape pattern formed by the projections according to the type of the liquid contained in the liquid container body 32. According to this embodiment, four projections 409 are provided, and the mounting structure-side identification member 28 is fit in between the two inner-side projections 409. The projection 409 is a plate-like member that is parallel to the Y-axis direction and the Z-axis direction. The main body-side identification member 408 serves to prevent the cartridge 30 from being mistakenly inserted into a mounting structure 20 that is different from the correct mounting structure 20. According to this embodiment, the plurality of projections 409 are arranged with respect to a virtual straight line Ls as the center such that two projections 409 and other two projections 409 are respectively located at the equidistant positions from the virtual straight line Ls on the left side of the virtual straight line Ls and on the right side of the virtual straight line Ls. The arrangement of the projections 409 is, however, not limited to the configuration of this embodiment. For example, the arrangement may employ different distances from the virtual straight line Ls or different distances between the adjacent projections 409. Each of the plurality of projections 409 is not necessarily limited to the plate-like member that is parallel to the Y-axis direction and the Z-axis direction but may be formed in a different shape.

As shown in FIG. 11, when the cartridge 30 is viewed from the +Y-axis direction side, the virtual straight line Ls is a line that passes through the center axis 42CT of the liquid supply portion 42 and is parallel to the Z-axis direction. As shown in FIG. 10, the center 44CP is located on the virtual straight line Ls. As shown in FIG. 11, when the cartridge 30 is viewed from the +Y-axis direction side, the center 46CP of the positioning structure 46 is located on the virtual straight line Ls. When the cartridge 30 is viewed from the +Y-axis direction side, the first engaged element 462A and the second engaged element 462B are located across the virtual straight line Ls.

Figure 15:
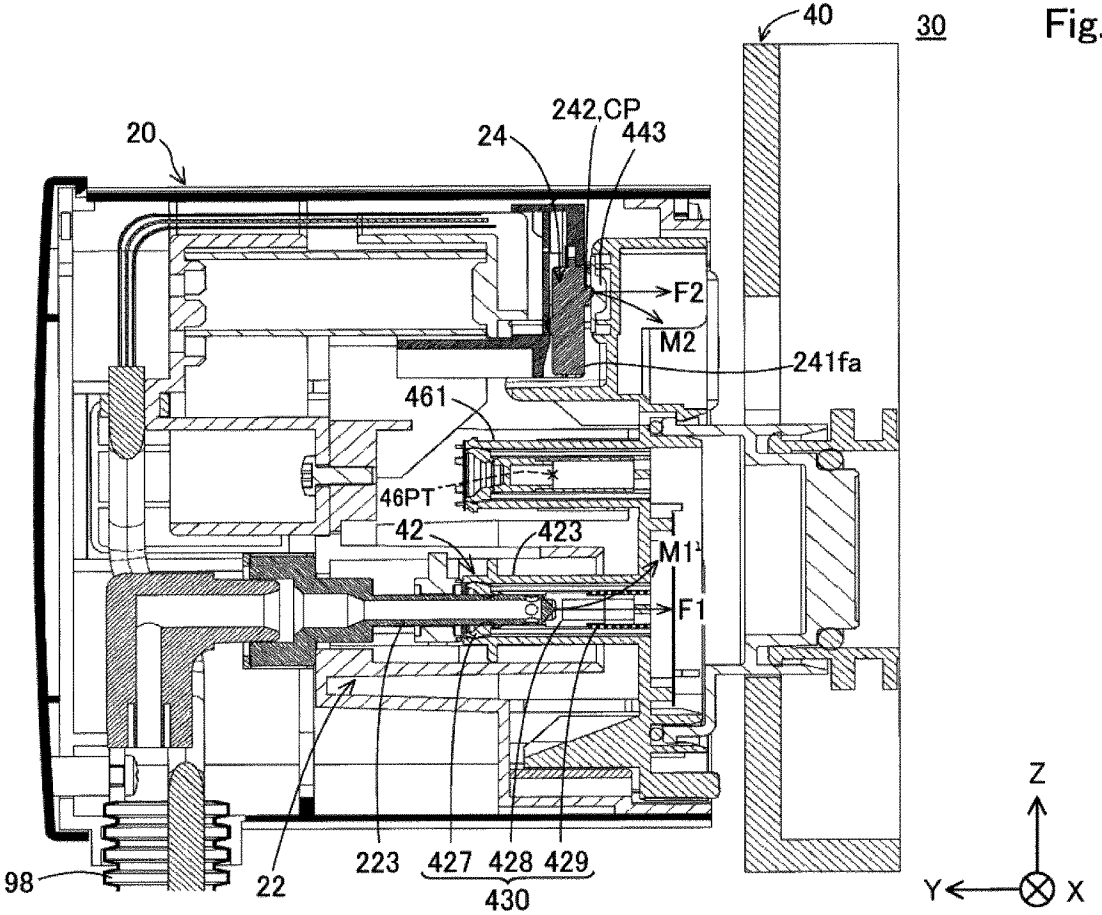
FIG. 15 is a sectional view taken on a line 15-15 in FIG. 11.

FIG. 15 is a sectional view taken on a line 15-15 in FIG. 11. The illustration of FIG. 15 also includes the mounting structure 20. FIG. 15 illustrates the mounting state that the cartridge 30 is mounted to the mounting structure 20. In the mounting process and in the mounting state, the liquid injection needle 223 is inserted into the flow portion 423, so that the liquid supply portion 42 is connected with the liquid introducing structure 22. In the state that the liquid supply portion 42 is connected with the liquid introducing structure 22, the valve element 428 is pressed by the liquid injection needle 223 and is thereby displaced in the −Y-axis direction such as to be separated from the valve seat 427. This displacement compresses the pressing member 429. In other words, the liquid supply portion 42 is configured to receive a first external force F1 in the −Y-axis direction when the liquid supply portion 42 is connected with the liquid introducing structure 22.

In the mounting state, the electrical connecting elements 242 come into contact with the contact portions CP in the state that electrical connecting elements 242 are pressed in and displaced from the surface 241*fa* by the circuit board 443. In the mounting process, at a stage immediately before the mounting state, the electrical connecting elements 242 are similarly pressed in from the surface 241*fa* by the circuit board 443. In the state that the electrical connecting elements 242 are pressed in from the surface 241*fa*, the electrical connecting elements 242 apply a second external force F2 of a −Y-axis direction component to the contact portions CP. In other words, the contact portions CP are configured to receive the second external force F2 in the −Y-axis direction from the electrical connecting elements 242 when the contact portions CP come into contact with the electrical connecting elements 242.

A-4. Advantageous Effects

As shown in FIG. 15, in the mounting state, the first external force F1 causes a first moment M1 in a first rotating direction having a −Y-axis direction component to be generated about the engagement position 46PT of the positioning structure 46 as a supporting point in the connector 40 of the cartridge 30. In the mounting state, the second external force F2 causes a second moment M2 in a second rotating direction having a −Y-axis direction component to be generated about the engagement position 46PT of the positioning structure 46 as a supporting point in the connector 40 of the cartridge 30. The first rotating direction and the second rotating direction are opposite rotating directions, so that the first moment M1 in the first rotating direction and the second moment M2 in the second rotating direction are applied to the connector 40 in the directions of cancelling each other. In the mounting state, this configuration suppresses rotation of the connector 40 about the X axis and thereby reduces the possibility of position misalignment of the cartridge 30 (more specifically, the connector 40) relative to the mounting structure 20.

In the mounting process, the first external force F1 causes the first moment M1 in the first rotating direction having the −Y-axis direction component to be generated about the abutting position of the positioning structure 46 and the engagement structure 26 as a supporting point in the connector 40 of the cartridge 30. In the mounting process, the second external force F2 causes the second moment M2 in the second rotating direction having the −Y-axis direction component to be generated about the abutting position of the positioning structure 46 and the engagement structure 26 as a supporting point in the connector 40 of the cartridge 30. The first rotating direction and the second rotating direction are opposite rotating directions, so that the first moment M1 in the first rotating direction and the second moment M2 in the second rotating direction are applied to the connector 40 in the directions of cancelling each other. In the mounting process, this configuration suppresses rotation of the connector 40 about the X axis and thereby reduces the possibility of position misalignment of the cartridge 30 (more specifically, the connector 40) relative to the mounting structure 20.

Figure 16:
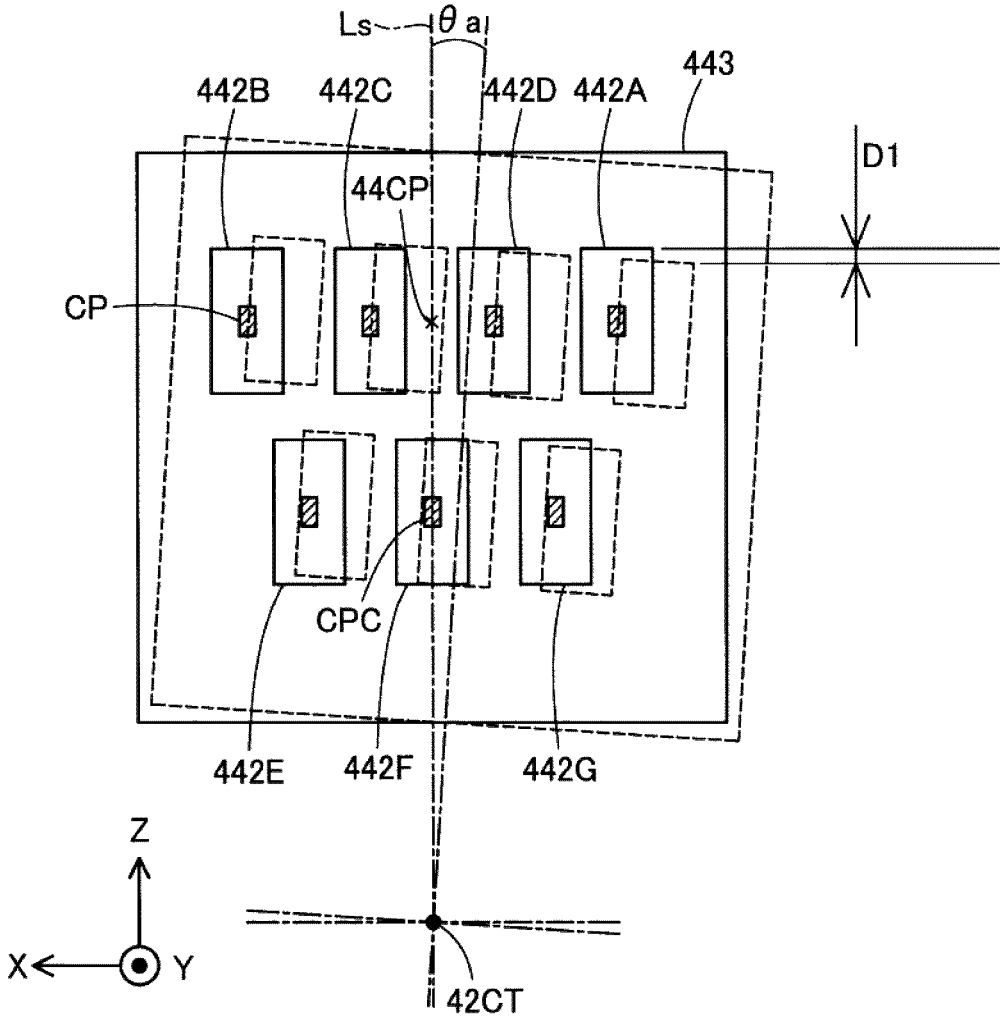
FIG. 16 is a diagram illustrating advantageous effects of the embodiment.
Figure 17:
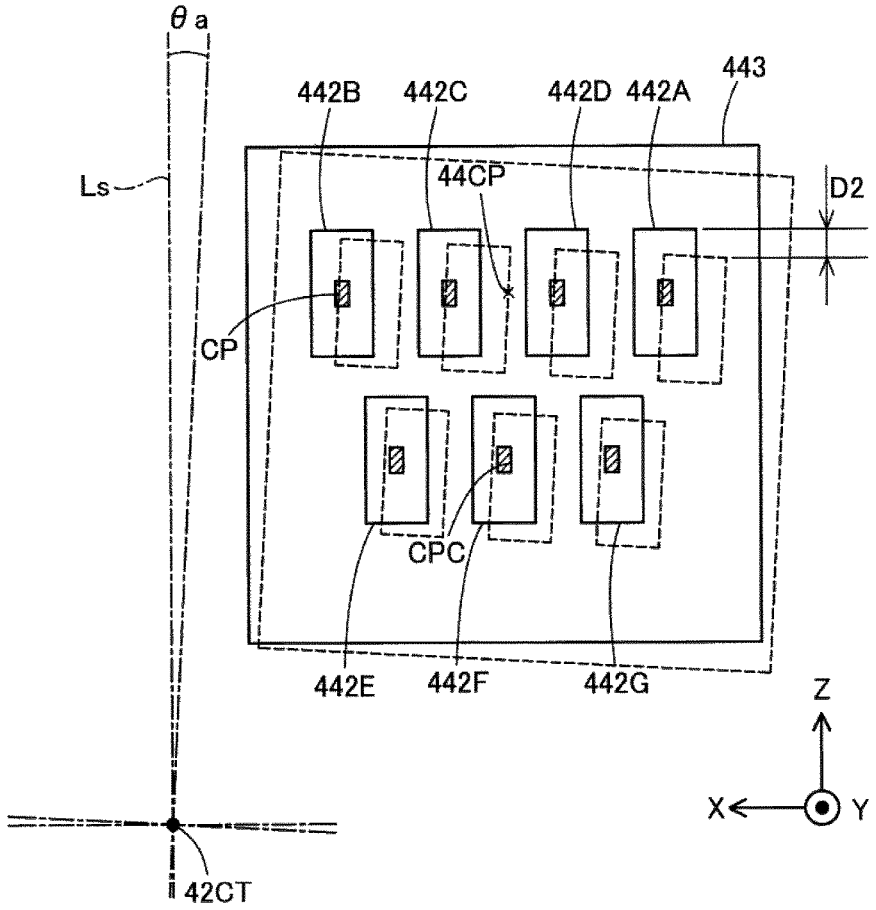
FIG. 17 is a diagram illustrating a comparative example.

FIG. 16 is a diagram illustrating advantageous effects of the embodiment. FIG. 17 is a diagram illustrating a comparative example. A first state that the liquid supply portion 42 is inserted into the mounting structure-side cylindrical member 221 of the liquid introducing structure 22 or a second state that the liquid injection needle 223 is inserted in the flow portion 423 of the liquid supply portion 42 may arise in the mounting process and in the mounting state. In the first state or in the second state, the cartridge is likely to have position misalignment relative to the mounting structure 20 as described below.

It is assumed that the cartridge 30 starts rotating about the center axis 42CT relative to the mounting structure 20 on and along the X-Z plane that is parallel to the X-axis direction and the Z-axis direction as shown in FIG. 16. Such rotation may be caused by, for example, an external force applied by the user in the mounting process or a vibration in the mounting state. With regard to the cartridge 30 of the embodiment, it is assumed that the cartridge 30 is rotated about the center axis 42CT relative to the mounting structure 20 by an angle θa along the X-Z plane. In this case, a displacement amount along the Z-axis direction of the main body-side terminals 442A to 442G including the contact portions CP is specified as a value D1.

It is, on the other hand, assumed that the cartridge 30 is rotated about the center axis 42CT relative to the mounting structure 20 by the angle θa along the X-Z plane in the case where the center 44CP and the center contact portion CPC are located at positions deviated from the virtual straight line Ls as shown in FIG. 17. In this case, a displacement amount along the Z-axis direction of the main body-side terminals 442A to 442G including the contact portions CP is specified as a value D2.

The value D2 is smaller than the value D1. The configuration that the center 44CP is located on the virtual straight line Ls suppresses position misalignment of the plurality of contact portions CP relative to the electrical connecting elements 242 on the X-Z plane even when the cartridge 30 is rotated about the center axis 42CT relative to the mounting structure 20 along the X-Z plane that is parallel to the X-axis direction and the Z-axis direction and has position misalignment relative to the mounting structure 20 on the X-Z plane. The state that "the center 44CP is located on the virtual straight line Ls" herein is not limited to the case where the center 44CP is located exactly on the virtual straight line Ls but includes the case where there is a slight deviation of the center 44CP from the virtual straight line Ls by taking into account the capability of suppressing position misalignment of the contact portions CP relative to the electrical connecting elements 242 on the X-Z plane.

According to the above embodiment, the center contact portion CPC and the center axis 42CT are located at the center 41CT of the main body member 41 (as shown in FIG. 11). This configuration suppresses position misalignment of the contact portions CP relative to the electrical connecting elements 242 on the X-Z plane even when the cartridge 30 is rotated about the center axis 42CT relative to the mounting structure 20.

According to the above embodiment, in the mounting process and in the mounting state, the projections 409 of the main body-side identification member 408 are fit in the mounting structure-side identification member 28. This configuration causes the main body-side identification member 408 to hit against the mounting structure-side identification member 28 when the cartridge 30 starts rotating about the center axis 42CT relative to the mounting structure 20. This configuration further reduces the possibility of position misalignment of the cartridge 30 relative to the mounting structure 20.

According to the above embodiment, when the cartridge 30 is viewed from the +Y-axis direction side, the center 46CP of the positioning structure 46 in the X-axis direction is located on the virtual straight line (as shown in FIG. 11). In the mounting process and in the mounting state, even when the cartridge 30 is rotated about the center axis 42CT relative to the mounting structure 20, the positioning structure 46 restricts the motion of the cartridge 30 relative to the mounting structure 20 in the X-axis direction and thereby further suppresses position misalignment of the contact portions CP relative to the electrical connecting elements 242. The state that "the center 46CP is located on the virtual straight line Ls" herein is not limited to the case where the center 46CP is located exactly on the virtual straight line Ls but includes the case where there is a slight deviation of the center 46CP from the virtual straight line Ls by taking into account the capability of suppressing position misalignment of the contact portions CP relative to the electrical connecting elements 242.

According to the above embodiment, the first engaged element 462A and the second engaged element 462B are located across the virtual straight line Ls (as shown in FIG. 11). This configuration suppresses position misalignment of the cartridge 30 by the first external force F1 and the second external force F2 and position misalignment of the contact portions CP about the center axis 42CT.

According to the above embodiment, the cartridge 30 is provided with the first protruded guide element 465A and the second protruded guide element 465B. This configuration causes the first engagement structure 26A and the second engagement structure 26B to be respectively guided to the first engaged element 462A and to the second engaged element 462B in the process of mounting the cartridge 30 to the mounting structure 20. This configuration accordingly ensures engagement of the first engagement structure 26A with the first engaged element 462A and engagement of the second engagement structure 26B with the second engaged element 462B with higher reliability.

According to the above embodiment, in the mounting process and in the mounting state, placing the upper protruded portion 445 (shown in FIG. 11) in the recess 243 of the mounting structure 20 (shown in FIG. 3) causes the upper protruded portion 445 to hit against the wall surface of the recess 243 when the cartridge 30 starts rotating about the center axis 42CT. This configuration suppresses such rotation of the cartridge 30 and thereby further reduces the possibility of position misalignment of the cartridge 30 relative to the mounting structure 20 in the mounting state.

According to the above embodiment, the contact portions CP are located on the placement surface 443*fa* parallel to the X-Z plane that is parallel to the X-axis direction and the Z-axis direction (as shown in FIG. 7). The placement surface 443*fa* is accordingly arranged to be perpendicular to the +Y-axis direction that is the moving direction of the cartridge 30 relative to the mounting structure 20. This configuration reduces the possibility of significant misalignment of the contact position of the contact portions CP with the electrical connecting elements 242. The term "parallel" herein is not limited to the arrangement that the placement surface 443*fa* does not intersect with the X-Z plane but also includes the arrangement that the placement surface 443*fa* is inclined to the X-Z plane in a range of greater than 0 degree and smaller than 10 degrees by taking into account the capability of reducing the position misalignment of the contact position.

B. Second Embodiment

Figure 18:
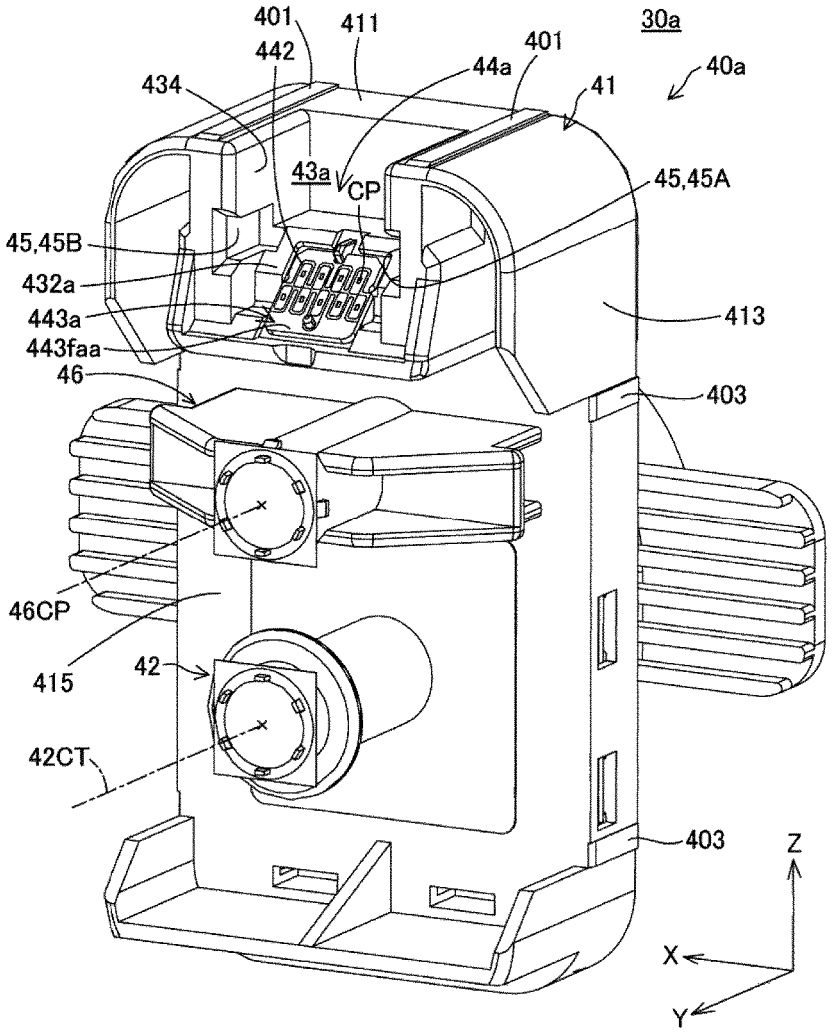
FIG. 18 is a perspective view illustrating a cartridge according to a second embodiment of the present disclosure.

FIG. 18 is a perspective view illustrating a cartridge 30*a* according to a second embodiment of the present disclosure. The perspective view illustrates only a connector 40*a* of the cartridge 30*a*. The cartridge 30*a* of the second embodiment differs from the cartridge 30 of the first embodiment (shown in FIG. 7) by only the configuration of a main body-side electrical mechanism 44*a*. Otherwise the configuration of the cartridge 30*a* of the second embodiment is similar to the configuration of the cartridge 30 of the first embodiment. The like components are expressed by the like reference signs to those used in the first embodiment, and their description is omitted. Like the cartridge 30 of the first embodiment, the cartridge 30*a* of the second embodiment includes a liquid container case 31 and a liquid container body 32 (shown in FIG. 6). The cartridge 30*a* of the second embodiment is also detachably mounted to a mounting structure of the liquid consuming apparatus 10.

The main body-side electrical mechanism 44*a* includes a circuit board 443*a*. The circuit board 443*a* is placed on a bottom face 432*a* of a guide structure 43*a*. Like the first embodiment, the guide structure 43*a* is formed in a concave shape that is open on its +Y-axis direction side and +Z-axis direction side. The bottom face 432*a* is arranged to intersect with an X-Y plane that is parallel to the X-axis direction and the Y-axis direction and with a Y-Z plane that is parallel to the Y-axis direction and the Z-axis direction. According to this embodiment, the direction of a normal vector of the bottom face 432*a* is a direction including a +Z-axis direction component and a +Y-axis direction component. Nine main body-side terminals 442 are placed on a placement surface 443*faa* that is a surface of the circuit board 443*a*. The placement surface 443*faa* is arranged to intersect with the X-Y plane that is parallel to the X-axis direction and the Y-axis direction and with the Y-Z plane that is parallel to the Y-axis direction and the Z-axis direction. According to this embodiment, the direction of a normal vector of the placement surface 443*faa* is a direction including a +Z-axis direction component and a +Y-axis direction component.

The nine main body-side terminals 442 include seven main body-side terminals having the same functions as those of the seven main body-side terminals 442A to 442G (shown in FIG. 10) on the circuit board 443 of the first embodiment and two short circuit detection terminals. The controller 16 of the liquid consuming apparatus 10 detects a short circuit occurring in the main body-side terminals 442, based on generation or non-generation of an excess voltage in the two short circuit detection terminals. Each of the nine main body-side terminals 442 has a contact portion CP that is formed in its center and that is configured to come into contact with a corresponding electrical connecting element 242 in the mounting state. The nine main body-side terminals 442 are arranged to form two lines at different positions in the Z-axis direction. These two lines are respectively parallel to the X-axis direction. The upper line consists of four main body-side terminals 442, and the lower line consists of five main body-side terminals 442. The nine main body-side terminals 442 (more specifically, their contact portions CP) are arranged alternately at the positions of half the pitch between the main body-side terminals 442 in the X-axis direction or, in other words, are arranged in zigzag. The contact portions CP are located on the placement surface 443*faa*.

The mounting structure which the cartridge 30*a* of the second embodiment is mounted to has a different configuration from that of the mounting structure 20 of the first embodiment, corresponding to the configuration of the main body-side electrical mechanism 44*a* of the cartridge 30*a*. More specifically, the difference from the mounting structure 20 of the first embodiment (shown in FIG. 3) is a configuration that nine electrical connecting elements 242 are provided and that a surface 241*fa* (shown in FIG. 3) is inclined to face the placement surface 443*faa*.

The cartridge 30*a* of the second embodiment described above receives an external force from the mounting structure of the liquid consuming apparatus 10 as described below. More specifically, the liquid supply portion 42 receives a first external force in the −Y-axis direction from the liquid introducing structure 22 when the liquid supply portion 42 is connected with the liquid introducing structure 22. The contact portions CP receive a second external force in a direction including a −Y-axis direction component from the electrical connecting elements 242 when the contact portions CP come into contact with the electrical connecting elements 242.

The second embodiment described above has the similar configuration to the configuration of the first embodiment and accordingly has similar advantageous effects to those of the first embodiment. A first moment in a first rotating direction generated by the first external force and a second moment in a second rotating direction generated by the second external force are applied to the cartridge 30*a* in the directions of cancelling each other. This configuration reduces the possibility of position misalignment of the cartridge 30*a* relative to the mounting structure in the mounting process and in the mounting state. The liquid supply portion 42 is provided on a −Z-axis direction side or gravity direction side of the contact portions CP. This configuration reduces the risk that the contact portion CP is stained with the liquid even when the liquid is leaked out from the liquid supply portion 42.

According to the above second embodiment, the contact portions CP are located on the placement surface 443*faa* arranged to intersect with the X-Y plane that is parallel to the X-axis direction and the Y-axis direction and with the Y-Z plane that is parallel to the Y-axis direction and the Z-axis direction. The contact surface 443*faa* with the contact portions CP placed thereon is arranged to intersect with the X-Y plane and with the Y-Z plane and is accordingly inclined to the +Y-axis direction that is the moving direction of the cartridge 30*a* relative to the mounting structure. This configuration causes the electrical connecting elements 242 and the contact portions CP to slightly rub against each other immediately before completion of mounting of the cartridge 30*a* to the mounting structure. Even when there is any extraneous substance (for example, dust) in the neighborhood of the electrical connecting elements 242 or the contact portions CP, this configuration exerts the effect of discharging the extraneous substance from between the electrical connecting elements 242 and the contact portions CP (wiping effect).

C. Preferable Relationship Between Liquid Introducing Structure 22 and Liquid Supply Portion 42

C-1. Preferable First Relationship

Figure 19:
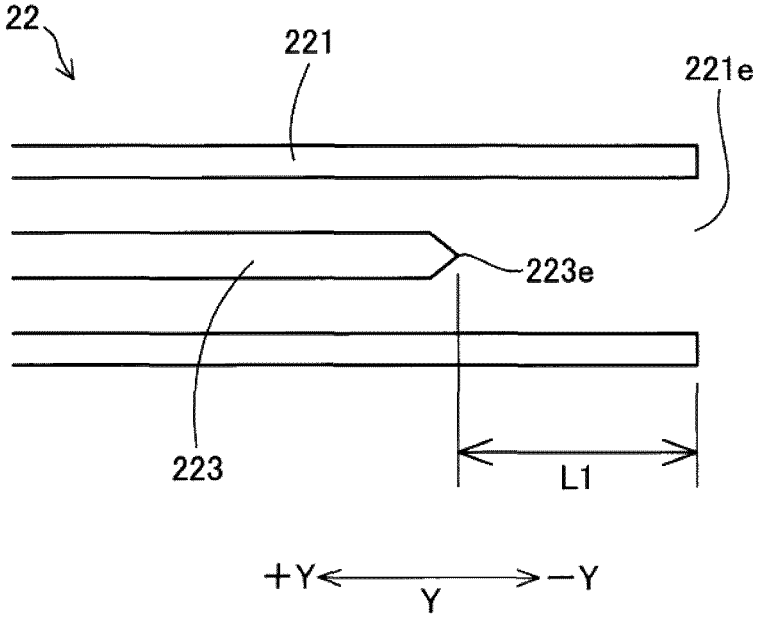
FIG. 19 is a diagram illustrating a liquid introducing structure.
Figure 20:
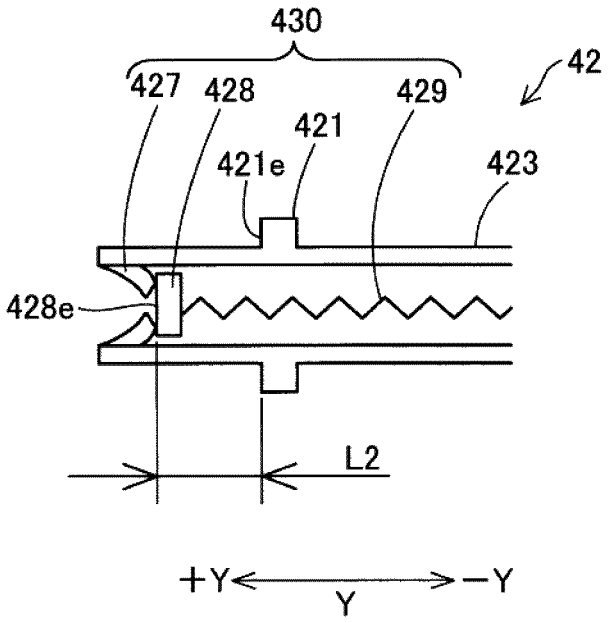
FIG. 20 is a diagram illustrating a liquid supply portion.

A preferable first relationship between the liquid introducing structure 22 and the liquid supply portion 42 in each of the above embodiments is described with reference to FIGS. 19 and 20. FIG. 19 is a diagram illustrating the liquid introducing structure 22. FIG. 20 is a diagram illustrating the liquid supply portion 42.

As shown in FIG. 19, a distance L1 denotes a distance between a −Y-axis direction side end 221*e* of the mounting structure-side cylindrical member 221 and the liquid injection needle 223 (more specifically, a leading end 223*e* that is a −Y-axis direction side end of the liquid injection needle 223) in the Y-axis direction.

As shown in FIG. 20, a distance L2 denotes a distance between a +Y-axis direction side end 421*e* of the supply portion protrusion 421 and a +Y-axis direction side end 428*e* of the valve element 428. In the state prior to mounting, the end 428*e* is located on a +Y-axis direction side of the end 421*e*.

It is preferable that the distance L2 is shorter than the distance L1. This configuration causes the supply portion protrusion 421 to be located in the mounting structure-side cylindrical member 221 before the liquid injection needle 223 comes into contact with the valve element 428 in the process of mounting the cartridge 30 or 30*a* to the mounting structure 20. This configuration suppresses position misalignment of the flow portion 423 relative to the liquid injection needle 223 when the liquid injection needle 223 presses in the valve element 428 in the mounting process. This configuration accordingly reduces the possibility of leakage of the liquid from the flow portion 423 to outside in the mounting process.

C-2. Preferable Second Relationship

Figure 21:
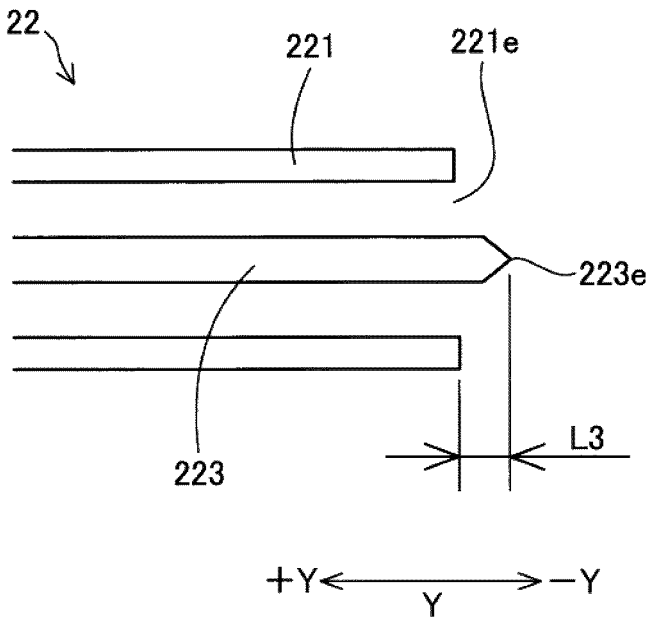
FIG. 21 is a diagram illustrating the liquid introducing structure.
Figure 22:
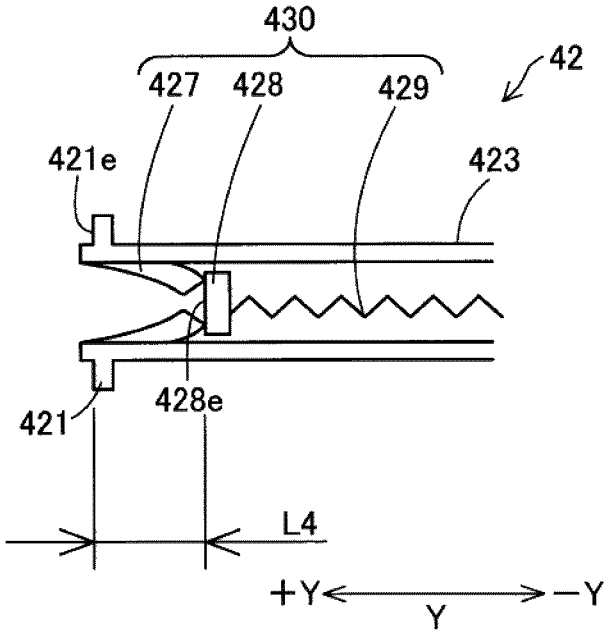
FIG. 22 is a diagram illustrating the liquid supply portion.

A preferable second relationship between the liquid introducing structure 22 and the liquid supply portion 42 in each of the above embodiments is described with reference to FIGS. 21 and 22. FIG. 21 is a diagram illustrating the liquid introducing structure 22. FIG. 22 is a diagram illustrating the liquid supply portion 42.

As shown in FIG. 21, a distance L3 denotes a distance between the −Y-axis direction side end 221*e* of the mounting structure-side cylindrical member 221 and the liquid injection needle 223 (more specifically, the leading end 223*e* that is the −Y-axis direction side end of the liquid injection needle 223) in the Y-axis direction. The leading end 223*e* is protruded to the −Y-axis direction side of the mounting structure-side cylindrical member 221.

As shown in FIG. 22, a distance L4 denotes a distance between the +Y-axis direction side end 421*e* of the supply portion protrusion 421 and the +Y-axis direction side end 428*e* of the valve element 428. The end 428*e* is located on a −Y-axis direction side of the end 421*e*.

It is preferable that the distance L4 is longer than the distance L3. This configuration causes the supply portion protrusion 421 to be located in the mounting structure-side cylindrical member 221 before the liquid injection needle 223 comes into contact with the valve element 428 in the process of mounting the cartridge 30 or 30*a* to the mounting structure 20. This configuration suppresses position misalignment of the flow portion 423 relative to the liquid injection needle 223 when the liquid injection needle 223 presses in the valve element 428 in the mounting process. This configuration accordingly reduces the possibility of leakage of the liquid from the flow portion 423 to outside in the mounting process.

D. Various Modifications of Cartridge 30 or 30*a*

The cartridge 30 of the first embodiment or the cartridge 30*a* of the second embodiment described above may be provided with a mechanism of refilling the liquid container body 32 with the liquid or replacing the liquid container body 32. The following describes concrete examples of this mechanism.

D-1. First Concrete Example

Figure 23:
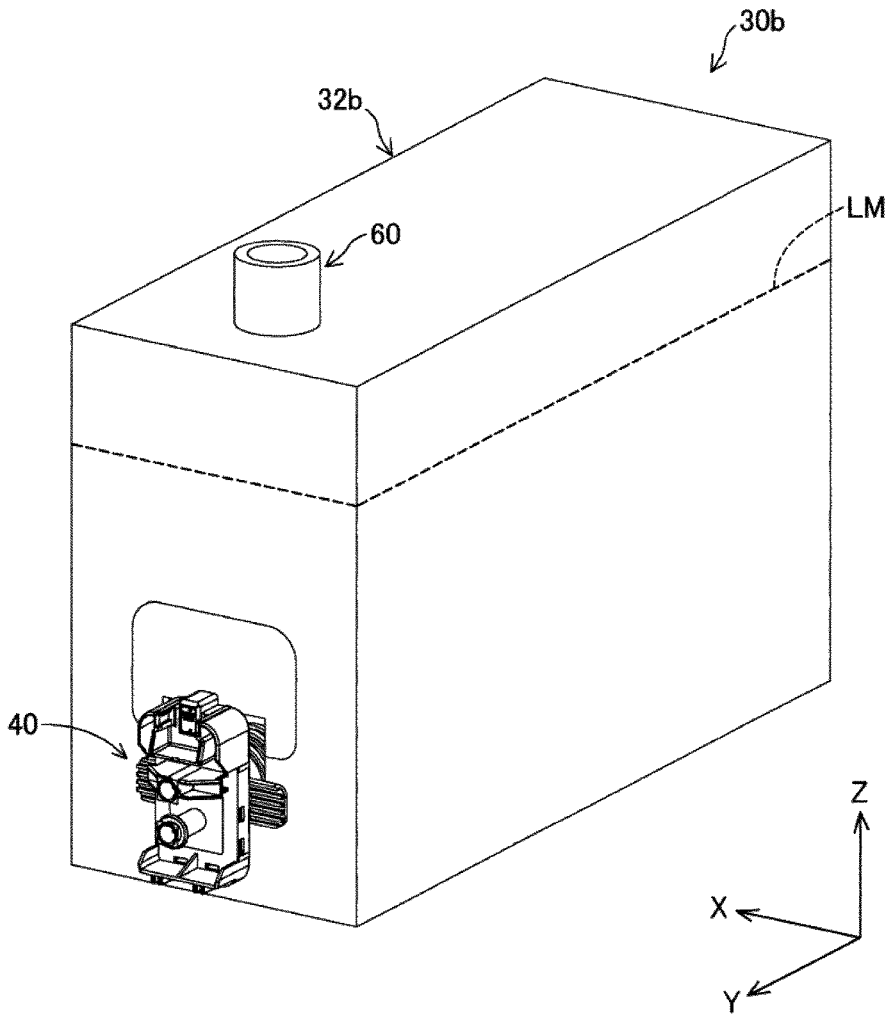
FIG. 23 is a diagram illustrating a first concrete example.

FIG. 23 is a diagram illustrating a first concrete example. The like components to those of the above first embodiment or second embodiment are expressed by the like reference signs, and their description is omitted. A cartridge 30*b* is configured to include a liquid container body 32*b*. The liquid container body 32*b* is made of a synthetic resin such as polypropylene or polyethylene and forms an outer shell of the cartridge 30*b*. The liquid container body 32*b* is formed in an approximately rectangular parallelepiped external shape. The cartridge 30*b* has a fill port 60 which the liquid is injected from. The fill port 60 is provided on an upper face of the liquid container body 32*b*. The fill port 60 is formed to pass through the wall of the liquid container body 32*b* and communicate with the liquid container body 32*b*. When a liquid level LM in the liquid container body 32*b* is lowered to decrease the remaining amount of the liquid, the user is allowed to refill the liquid container body 32*b* with the liquid through the fill port 60.

D-2. Second Concrete Example

Figure 24:
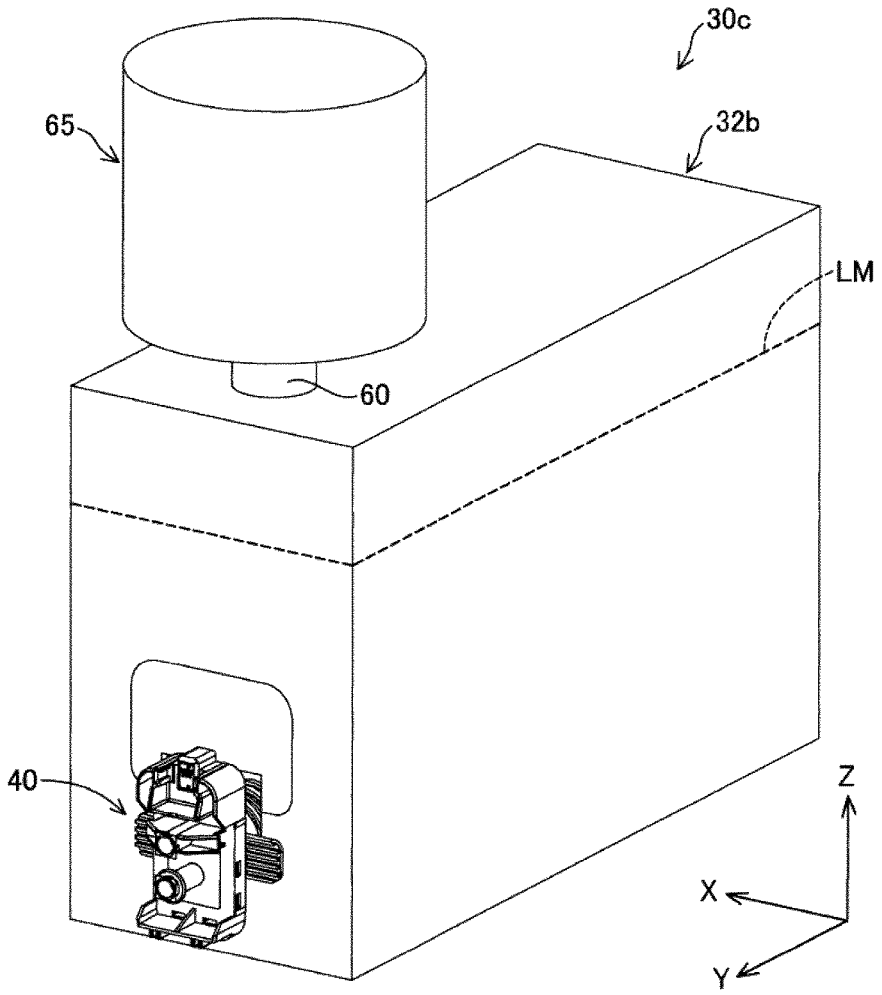
FIG. 24 is a diagram illustrating a second concrete example.

FIG. 24 is a diagram illustrating a second concrete example. A cartridge 30*c* shown in FIG. 24 differs from the cartridge 30*b* shown in FIG. 23 by the configuration that the cartridge 30*c* is additionally provided with an external liquid container 65. The external liquid container 65 is a container configured to contain the liquid that is to be injected into the liquid container body 32*b*. The external liquid container 65 is detachably attached to the fill port 60. When the liquid level LM in the liquid container body 32*b* is lowered to decrease the remaining amount of the liquid, the user is allowed to refill the liquid container body 32*b* with the liquid by attachment of the external liquid container 65 to the fill port 60.

D-3. Third Concrete Example

Figure 25:
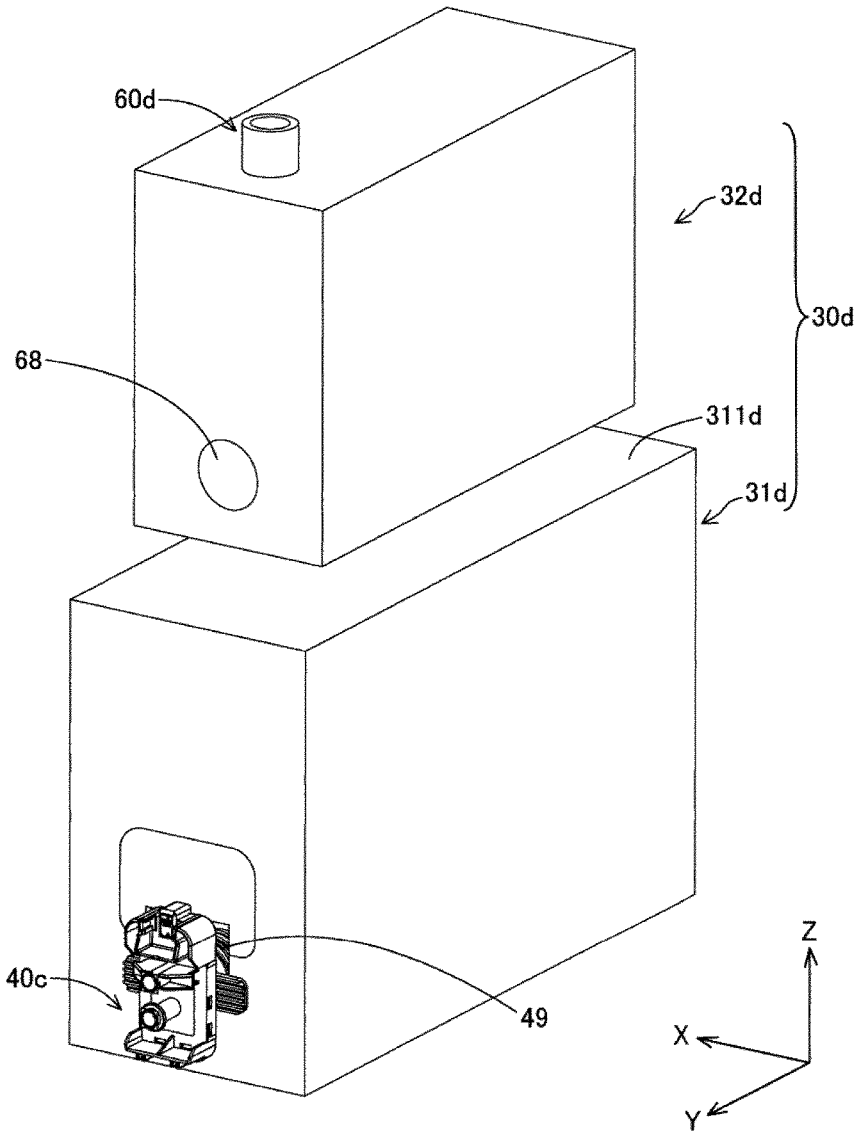
FIG. 25 is a diagram illustrating a third concrete example.

FIG. 25 is a diagram illustrating a third concrete example. A cartridge 30*d* is configured to include an adapter 32*d* and a liquid container case 31*d* provided to place the adapter 32*d* therein. A connector 40 is fixed to the liquid container case 31*d*.

The adapter 32*d* is configured to contain the liquid that is to be supplied to the liquid consuming apparatus 10. The adapter 32*d* is placed in the liquid container case 31*d* in a demountable manner. For example, the adapter 32*d* is inserted through an upper opening 311*d* of the liquid container case 31*d* to be placed in the liquid container case 31*d*.

The adapter 32*d* is configured to include a connection opening 68 and a fill port 60*d*. The connection opening 68 is arranged to communicate with inside of the adapter 32*d* and causes the liquid contained in the adapter 32*d* to be flowed to outside. A liquid retaining member is placed in the connection opening 68 to suppress leakage of the liquid to outside. The liquid retaining member may be, for example, a sponge that is a porous member. The liquid retaining member may be replaced with a valve mechanism. The connection opening 68 is connectable with a supply member 49 of the connector 40. The user connects the connection opening 68 with the supply member 49 when the adapter 32*d* is placed into the liquid container case 31*d*. This enables the liquid contained in the adapter 32*d* to be flowed through the connection opening 68 to the connector 40—side.

The fill port 60*d* is provided on an upper face of the adapter 32*d*. The fill port 60*d* is formed to pass through the wall of the adapter 32*d* and communicate with the adapter 32*d*. When a liquid level in the adapter 32*d* is lowered to decrease the remaining amount of the liquid, the user is allowed to refill the adapter 32*d* with the liquid through the fill port 60*d*.

According to the third concrete example, the connector 40 is provided on the liquid container case 31*d*-side. There is accordingly no need to provide the connector 40 in the adapter 32*d* that is consumable and that is configured to contain the liquid inside thereof. The cartridge 30*d* can thus be manufactured at a low cost.

D-4. Fourth Concrete Example

Figure 26:
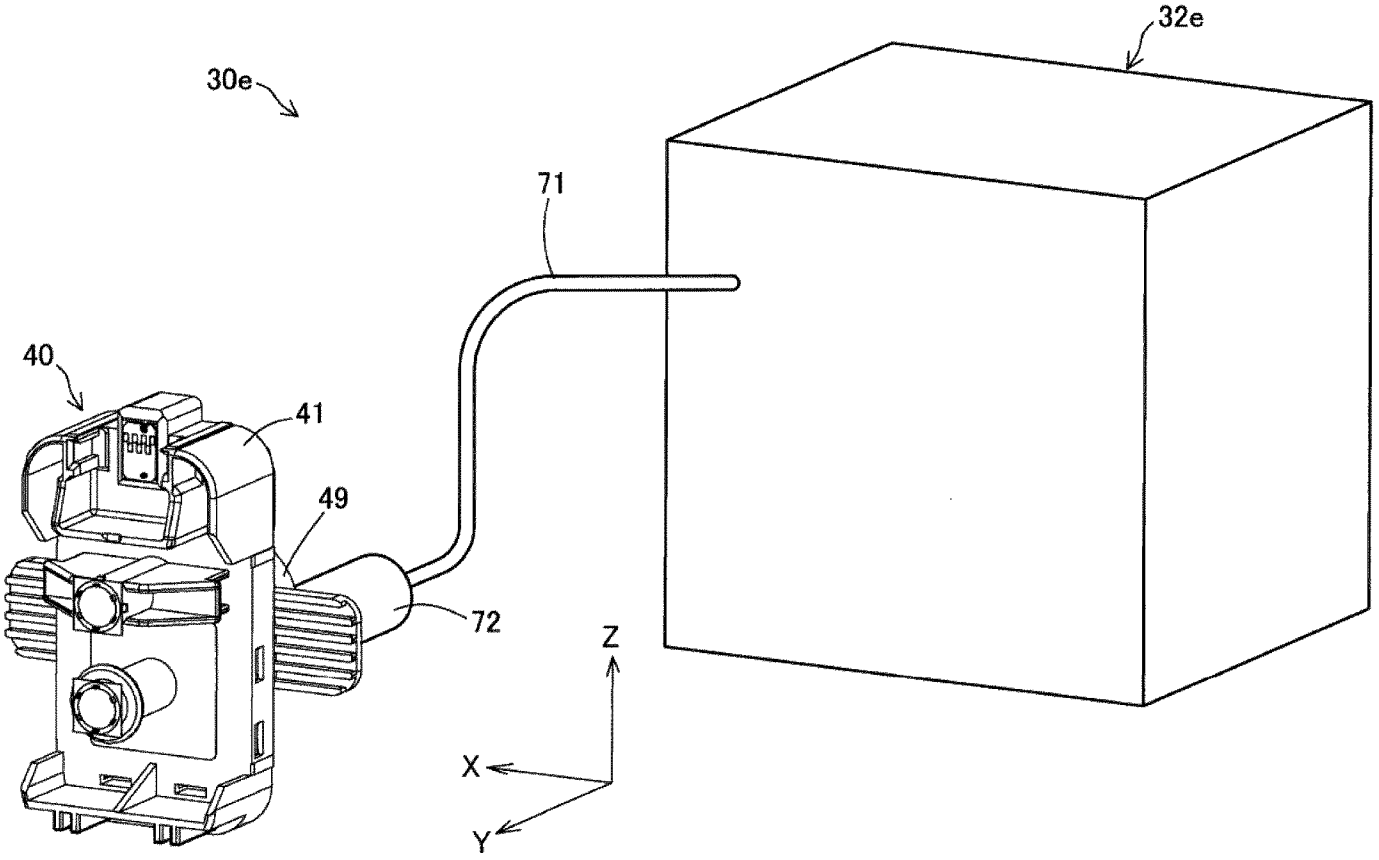
FIG. 26 is a diagram illustrating a fourth concrete example.

FIG. 26 is a diagram illustrating a fourth concrete example. A cartridge 30*e* is configured to include an external container 32*e* provided as an external liquid supply source and a tube 71 provided to connect the external container 32*e* with a connector 40. The liquid that is to be supplied to the connector 40 is contained in the external container 32*e*. It is preferable that the external container 32*e* has a larger capacity of containing the liquid than the capacity of the liquid container body 32 of the first embodiment or the second embodiment described above. Using the external container 32*e* of the large capacity reduces the frequency of replacement of the external container 32*e*. The external container 32*e* may be placed on the main placement rack 19 (shown in FIG. 1) or may be placed in another location. The external container 32*e* may be provided with a fill port through which the liquid is injectable into the external container 32*e*. One end 72 of the tube 71 is detachably connected with a supply member 49 of the connector 40. The liquid contained in the external container 32*e* is supplied through the tube 71 to the connector 40.

E. Third Embodiment

E-1. Configuration of Mounting Structure

Figure 27:
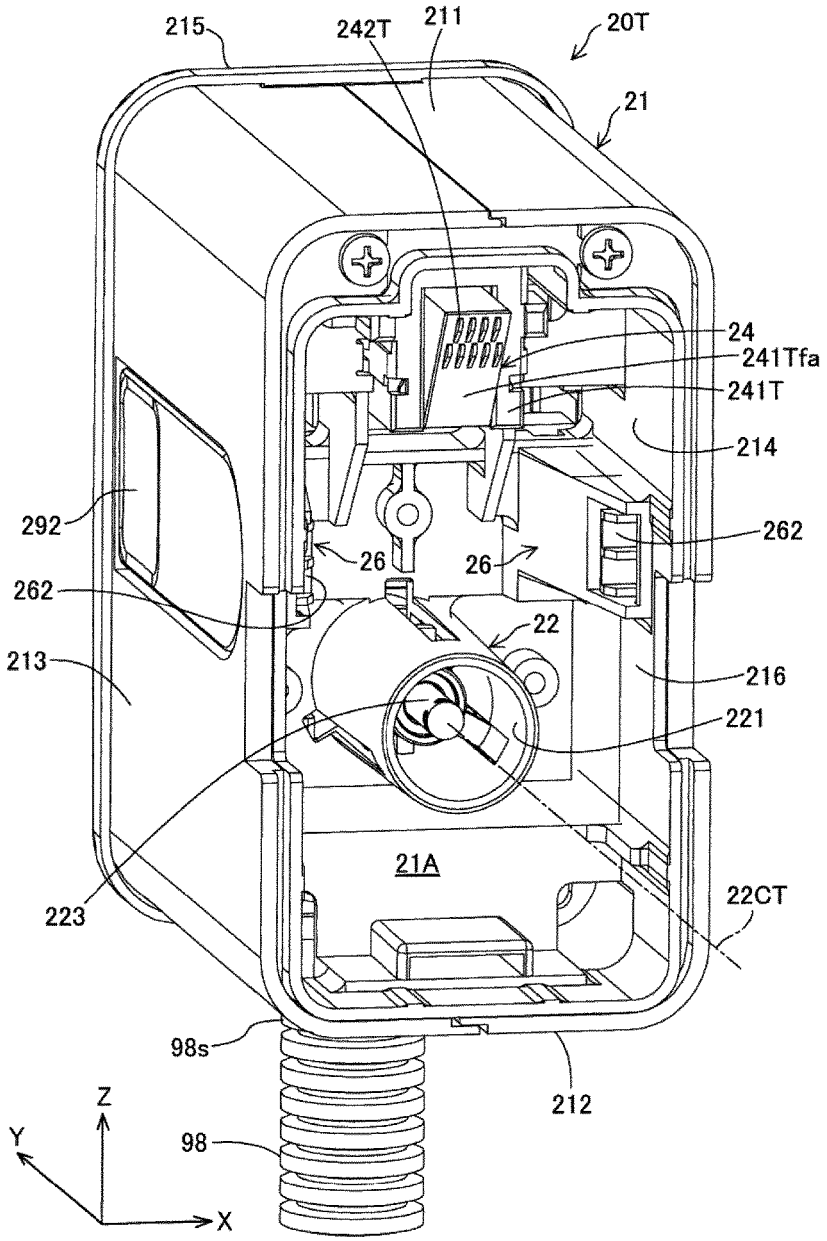
FIG. 27 is a perspective view illustrating a mounting structure according to a third embodiment.

FIG. 27 is a perspective view illustrating a mounting structure 20T according to a third embodiment. A one end 98*s*-side of a first tube 98 is also illustrated in FIG. 27, in order to facilitate understanding. The like components to those of the first embodiment described above are expressed by the like reference signs, and their description is appropriately omitted. The mounting structure 20T of the third embodiment is used for a liquid consuming apparatus 10 that is similar to that of the first embodiment. A liquid container 30T is mounted to the mounting structure 20T, in place of the liquid container 30 of the first embodiment.

Each of electrical connecting elements 242T is a metal plate-like member that is elastically deformable. Part of the electrical connecting element 242T is exposed on a surface 241Tfa of a placement base 241T. The direction of a normal vector of the surface 241Tfa includes a −Z-axis direction component and a −Y-axis direction component. Nine electrical connecting elements 242T are provided. The electrical connecting elements 242T are electrically connected with the controller 16 (shown in FIG. 1) by wiring (not shown).

Two engagement structures 26 are provided. In the mounting state of the liquid container 30T, each of the engagement structures 26 includes an engagement claw 262 on its −Y-axis direction side end. The engagement structures 26 engage with part of the liquid container 30, so as to restrict the motion of the liquid container 30T relative to the mounting structure 20T in at least the Y-axis direction.

Pressing release elements 292 (only one release element is shown in FIG. 27) provided on a mounting structure third surface 213 and a mounting structure fourth surface 214 causes the engagement claws 262 to be displaced outward in a housing space 21A and thereby releases the engagement of the engagement structures 26 with the liquid container 30T.

E-2. Configuration of Liquid Container

Figure 28:
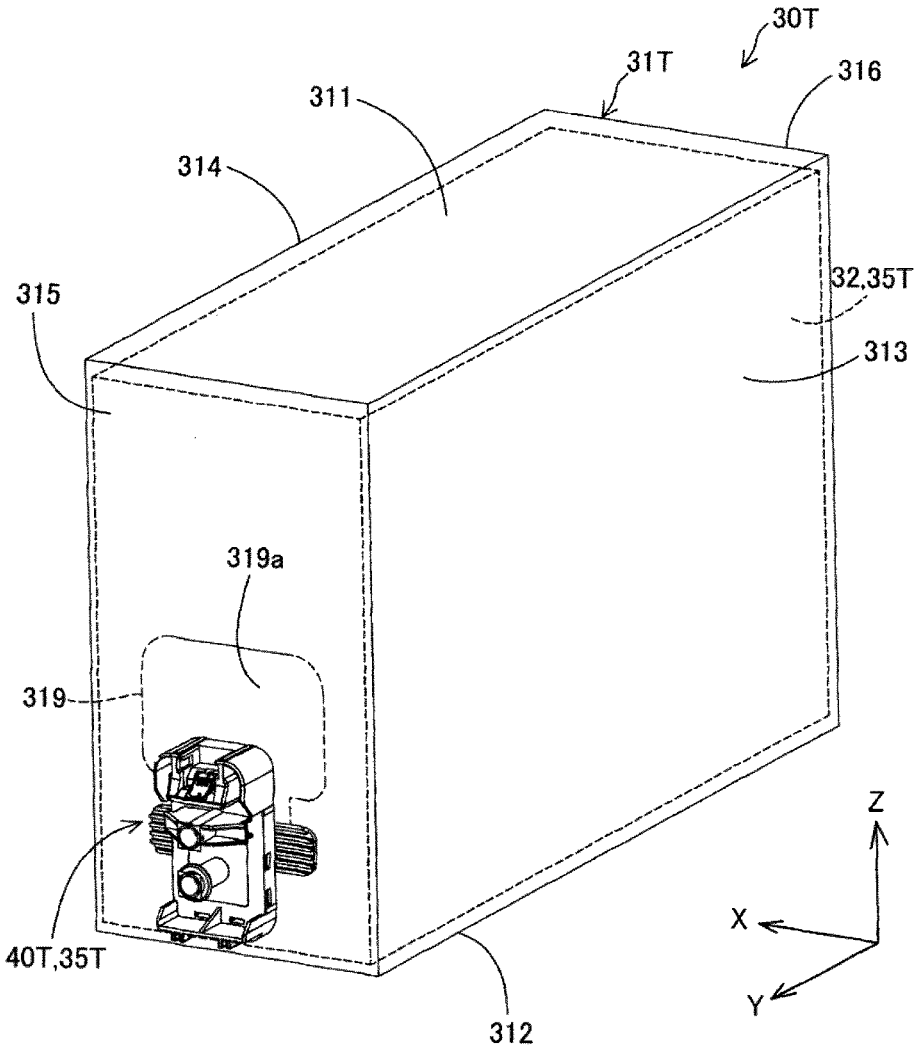
FIG. 28 is a perspective view illustrating a liquid container.
Figure 29:
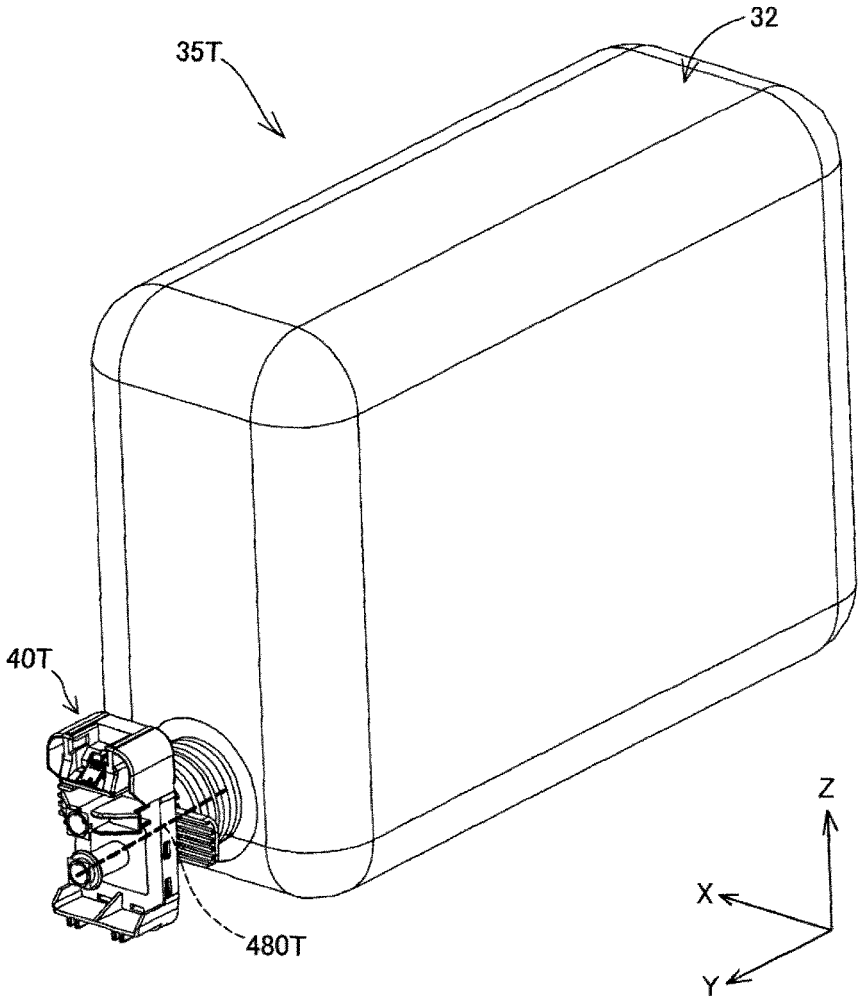
FIG. 29 is a perspective view illustrating a liquid container body.
Figure 30:
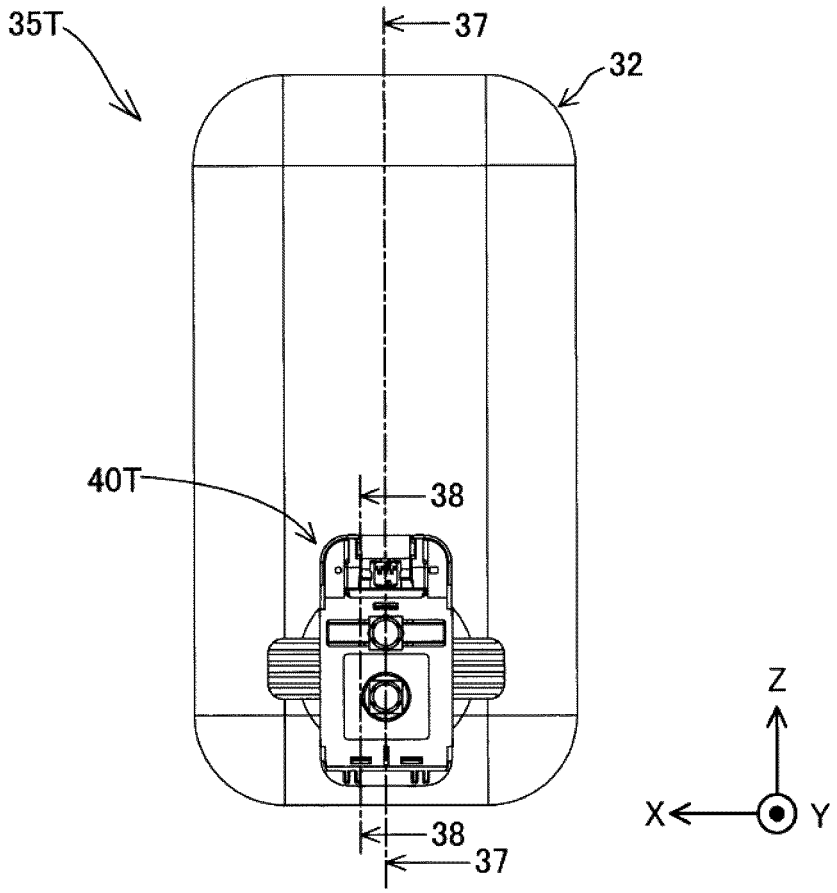
FIG. 30 is a front view illustrating the liquid container body.

FIG. 28 is a perspective view illustrating the liquid container 30T. FIG. 29 is a perspective view illustrating a liquid container body 35T. FIG. 30 is a front view illustrating the liquid container body 35T.

The liquid container 30T (shown in FIG. 28) includes a liquid container body 35T and a case 31T. The liquid container body 35T includes a liquid supply source 32 and a connector 40T. The liquid supply source 32 is configured to contain a liquid (ink) that is to be supplied to the mounting structure 20T. The liquid supply source 32 is a bag body that is filled with the liquid. The liquid supply source 32 is arranged to communicate with a liquid supply portion of the connector 40T described later. When the liquid contained in the liquid supply source 32 is consumed and used up to no remaining amount or little remaining amount, the liquid container body 35T is replaced with new one.

The connector 40T (shown in FIG. 29) is detachably mounted to the mounting structure 20T. The connector 40T includes a supply flow path 480T that is formed to supply the liquid from the liquid supply source 32 to the mounting structure 20T. The connector 40T is connected with the liquid supply source 32. The connector 40T is electrically connected with the electrical connecting elements 242T of the mounting structure 20T and is connected with a liquid injection needle 223 of the mounting structure 20T. This configuration enables the liquid container 30T to transmit electrical signals to and from the controller 16 (shown in FIG. 1) and causes the liquid contained in the liquid supply source 32 to be supplied to the liquid consuming portion 14. The detailed configuration of the connector 40T will be described later.

The case 31T (shown in FIG. 28) is configured to place the liquid supply source 32 therein in a demountable manner. The case 31T is formed in an approximately rectangular parallelepiped external shape. According to this embodiment, the case 31T is made of cardboard like the first embodiment described above. The case 31T may be made of, for example, a material that mainly consists of cellulose as a primary component. According to another embodiment, the case 31T may be made of another material (for example, a synthetic resin such as polypropylene or polyethylene). The case 31T includes a case first surface (case first wall) 311, a case second surface (case second wall) 312, a case third surface (case third wall) 313, a case fourth surface (case fourth wall) 314, a case fifth surface (case fifth wall) 315, and a case sixth surface (case sixth wall) 316.

In the mounting state of the liquid container 30T, the case first surface 311 forms an upper face, the case second surface 312 forms a bottom face. The case third surface 313 forms one side face, and the case fourth surface 314 forms the other side face. The case fifth surface 315 forms a front face that is opposed to the mounting structure 20T, and the case sixth surface 316 form a rear face. The case first surface 311 and the case second surface 312 are opposed to each other in the Z-axis direction. The case third surface 313 and the case fourth surface 314 are opposed to each other in the X-axis direction. The case fifth surface 315 and the case sixth surface 316 are opposed to each other in the Y-axis direction. The connector 40T is inserted through the case fifth surface 315. This configuration causes part of the connector 40T to be exposed outside. In non-use of the liquid container 30T, for example, during transportation of the liquid container 30T, the entire connector 40T may be placed inside of the case 31T. For example, the connector 40T may be placed inside of the case 31T by opening an openable lid 319*a* provided by a cut line 319 formed in the case fifth surface 315. According to another embodiment, the liquid container 30T may not be provided with the case 31T.

Figure 31:
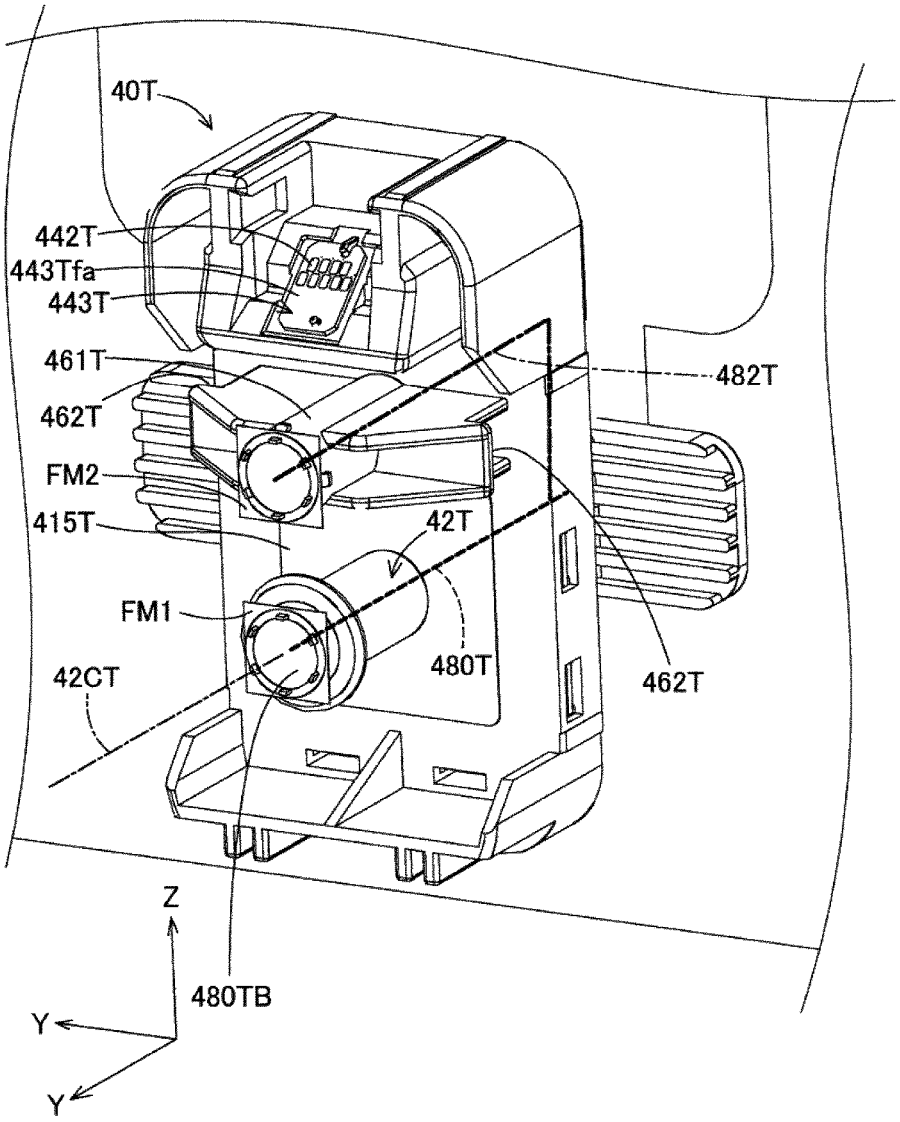
FIG. 31 is a partial enlarged view of FIG. 28.

FIG. 31 is a partial enlarged view of FIG. 28. The connector 40T includes a liquid supply portion 42T, a circuit board 443T, a liquid injection portion 461T and engaged elements 462T. The respective components 42T, 443T, 461T and 462T are placed on a surface (front face) 415T-side of the connector 40T that is opposed to the mounting structure 20T.

The liquid supply portion 42T is detachably connected with a liquid introducing structure 22 (more specifically, the liquid injection needle 223) of the mounting structure 20T to supply the liquid to the liquid introducing structure 22 (more specifically, the liquid injection needle 223). The liquid supply portion 42T is inserted in a mounting structure-side cylindrical member 221 of the liquid introducing structure 22 in the mounting process and in the mounting state of the liquid container 30T.

The liquid supply portion 42T is a cylindrical member that is extended from the surface 415T. An opening 480TB is formed on a leading end of the liquid supply portion 42T to receive the liquid injection needle 223 therein. The opening 480TB is provided at a downstream end of the supply flow path 480T in the flow direction of the liquid that flows from the connector 40T toward the mounting structure 20T (supply flow path direction). The opening 480TB is thus also called the downstream end 480TB. In the non-use state prior to mounting the liquid container 30T to the mounting structure 20T, a film FM1 is attached to the opening 480TB to close the opening 480TB. The film FM1 is broken by the liquid injection needle 223 (shown in FIG. 27) in the process of mounting the liquid container 30T to the mounting structure 20T. According to another embodiment, the film FM1 may be removed by the user before the liquid container 30T is mounted to the mounting structure 20T. The liquid supply portion 42T also includes a center axis 42CT that is extended in a direction (Y-axis direction) along the +Y-axis direction.

The liquid supply portion 42T further includes a valve mechanism (not shown) that is placed in the flow path and that is configured to open and close the supply flow path 480T. The valve mechanism is opened when the liquid injection needle 223 is inserted into the liquid supply portion 42T.

The circuit board 443T includes main body-side terminals 442T provided on a placement surface 443Tfa and a storage device (not shown) provided on a rear face. The storage device of the circuit board 443T stores information regarding the liquid container 30T (for example, color information regarding the color of the liquid and information regarding the remaining amount of the liquid) and the like.

The direction of a normal vector of the placement surface 443Tfa includes a +Z-axis direction component and a +Y-axis direction component. Nine main body-side terminals 442T are placed on this placement surface 443Tfa. The nine main body-side terminals 442T respectively come into contact with the corresponding electrical connecting elements 242T (shown in FIG. 27) in the mounting state. This configuration enables signals to be transmitted between the controller 16 (shown in FIG. 1) and the storage device.

The engaged elements 462*t* are engaged with the engagement claws 262 (shown in FIG. 27) in the mounting state. Such engagement restricts the motion of the connector 40T is a direction of detachment from the mounting structure 20T (i.e., in the −Y-axis direction). Two engagement claws 262 are provided. The engagement claw 262 is a surface that faces in the −Y axis direction.

The liquid injection portion 461T is a cylindrical member that is extended along the Y-axis direction. The liquid injection portion 461T forms part of an injection flow path 482T that joins the supply flow path 480T. The injection flow path 482T is a flow path arranged to cause the liquid to be flowed from outside toward the liquid supply source 32. The liquid is injected from the liquid injection portion 461T through the injection flow path 482T into the liquid supply source 32. After injection of the liquid into the liquid supply source 32, the liquid injection portion 461T is closed by a film FM2, in order to prevent leakage of the liquid to outside. A valve mechanism may be provided in the liquid injection portion 461T, in order to prevent leakage of the liquid to outside.

E-3. Detailed Configuration of Connector

Figure 32:
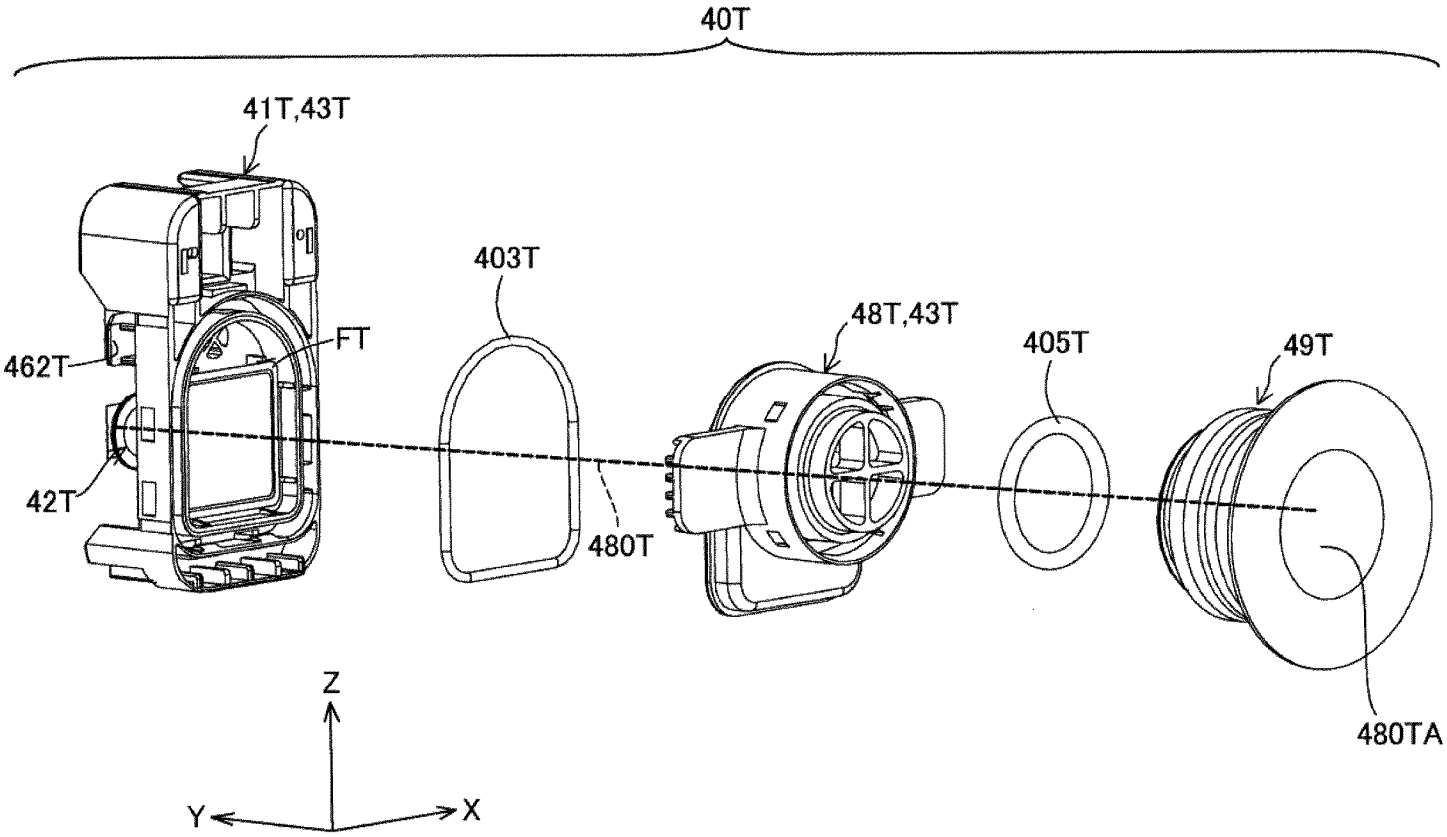
FIG. 32 is an exploded perspective view illustrating a connector.

FIG. 32 is an exploded perspective view illustrating the connector 40T. The connector 40T includes a supply member 49T, a connection main body member 43T, a first elastic seal member 405T, a second elastic seal member 403T and a filter FT. A third elastic seal member (described later) is placed in an intermediate member 48T and is not illustrated in FIG. 32.

The supply member 49T forms an upstream end 480TA of the supply flow path 480T in the flow direction of the liquid that flows from the connector 40T toward the mounting structure 20T. The supply member 49T is made of a synthetic resin. According to this embodiment, the supply member 49T is made of a material that mainly consists of polyethylene (PE) as a primary component. According to this embodiment, the primary component means a component that has a weight percent of higher than 50% by weight in the material.

The connection main body member 43T forms the downstream end 480TB of the supply flow path 480T (shown in FIG. 31). The connection main body member 43T includes the liquid supply portion 42T and is connected with the liquid injection needle 223 of the mounting structure 20T in the mounting state.

The connection main body member 43T includes an intermediate member 48T and a connection member 41T. The connection main body member 43T is formed by fitting the intermediate member 48T and the connection member 41T each other. Accordingly the connection member 41T is connected with the intermediate member 48T. The intermediate member 48T is located between the connection member 41T and the supply member 49T. The intermediate member 48T and the connection member 41T are respectively made of a synthetic resin. According to this embodiment, the intermediate member 48T and the connection member 41T are respectively made of a material that mainly consists of polypropylene (PP) as a primary component. In general, polypropylene has a higher hardness than polyethylene. Using polypropylene reduces the possibility of plastic deformation of the intermediate member 48T and the connection member 41T caused by a stress generated in a location where the intermediate member 48T and the connection member 41T are fit each other. Polypropylene is also generally a material of high versatility and is inexpensive. Using polypropylene accordingly reduces the manufacturing cost of the connector 40T.

The connector 40T is formed by fitting the connection member 41T and the intermediate member 48T (more specifically, one side of the intermediate member 48T) each other and fitting the intermediate member 48T (more specifically, the other side of the intermediate member 48T) and the supply member 49T each other.

The first elastic seal member 405T is provided to seal a gap between the intermediate member 48T and the supply member 49T fit each other. The first elastic seal member 405T has a ring-like shape and is placed to surround the circumference of the supply flow path 480T. The first elastic seal member 405T serves to suppress the liquid flowing in the supply flow path 480T from leaking out from the gap between the intermediate member 48T and the supply member 49T to outside. The first elastic seal member 405T is made of a material that has elasticity and that mainly consists of, for example, polybutadiene as a primary component.

The second elastic seal member 403T is provided to seal a gap between the connection member 41T and the intermediate member 48T fit each other. The second elastic seal member 403T has a frame-like shape and is placed to surround the circumference of the supply flow path 480T. The second elastic seal member 403T serves to suppress the liquid flowing in the supply flow path 480T from leaking out from the gap between the connection member 41T and the intermediate member 48T to outside. The second elastic seal member 403T is made of a material that has elasticity and that mainly consists of, for example, polybutadiene as a primary component.

The filter FT is placed in the middle of the supply flow path 480T. The filter FT is a plate-like member that is made of a metal such as stainless steel. The filter FT is attached to part of the connection member 41T. A method employable for attachment may, for example, thermally fuse part of the connection member 41T and press the fused part into part of openings of the filter FT to be cured. The filter FT has a rectangular external shape. The filter FT has a net-like structure with openings of such a size that allows the liquid flowing in the supply flow path 480T to pass through but prohibits external substances such as dust in the liquid from passing through. The filter FT serves to suppress extraneous substances in the liquid flowing in the supply flow path 480T from passing through. Even when some extraneous substance is mixed into the liquid that flows from the upstream side of the filter FT toward the downstream side of the filter FT in the flow direction, this configuration reduces the possibility that the extraneous substance reaches the mounting structure 20T. This accordingly reduces the possibility that the ejection head of the liquid consuming portion 14 (shown in FIG. 1) is clogged by the extraneous substance. The material of the filter FT is not necessarily limited to the metal but may be another material such as a synthetic resin.

Figure 33:
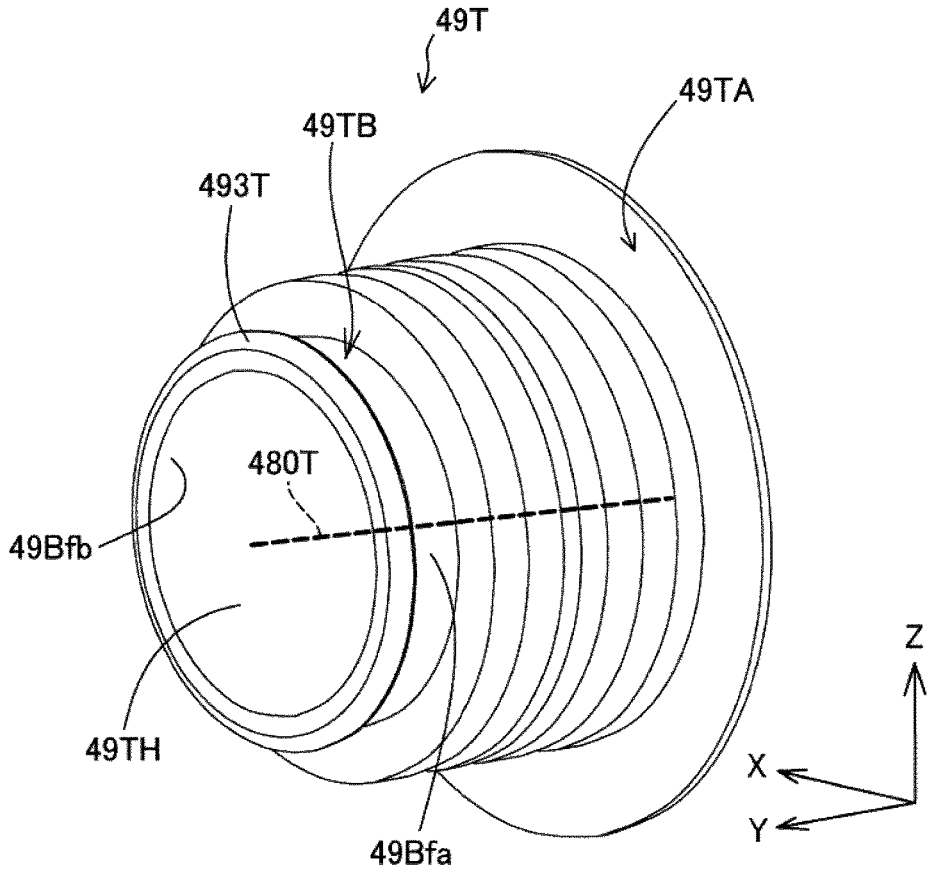
FIG. 33 is a perspective view illustrating a supply member.
Figure 34:
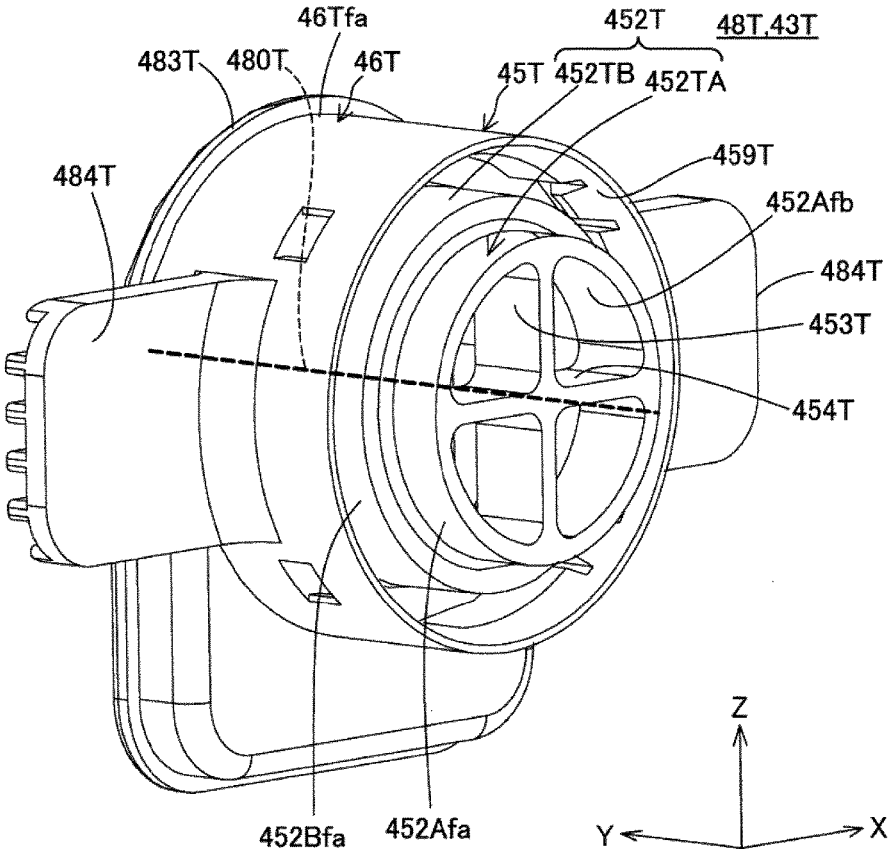
FIG. 34 is a perspective view illustrating an intermediate member.
Figure 35:
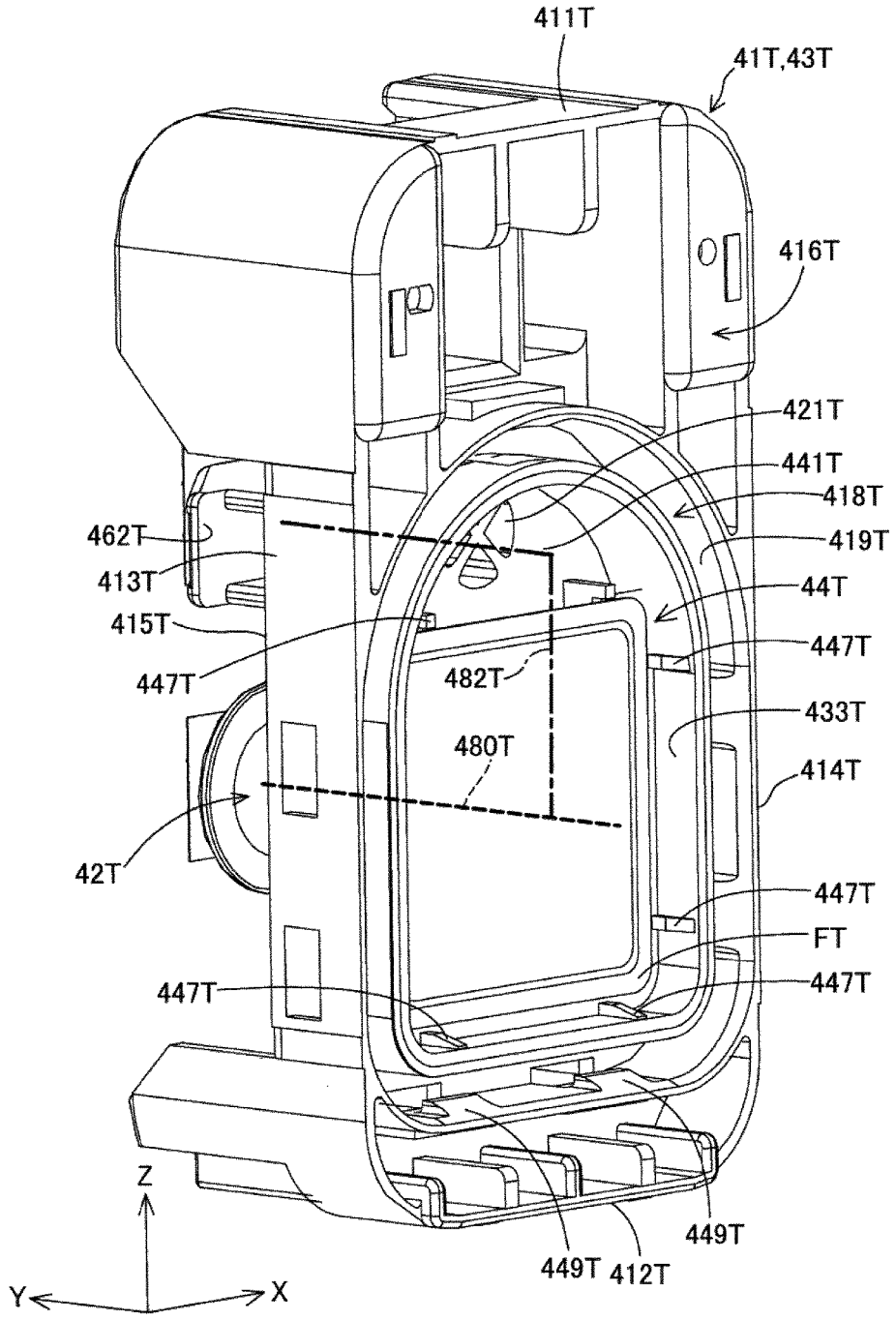
FIG. 35 is a perspective view illustrating a connection member.
Figure 36:
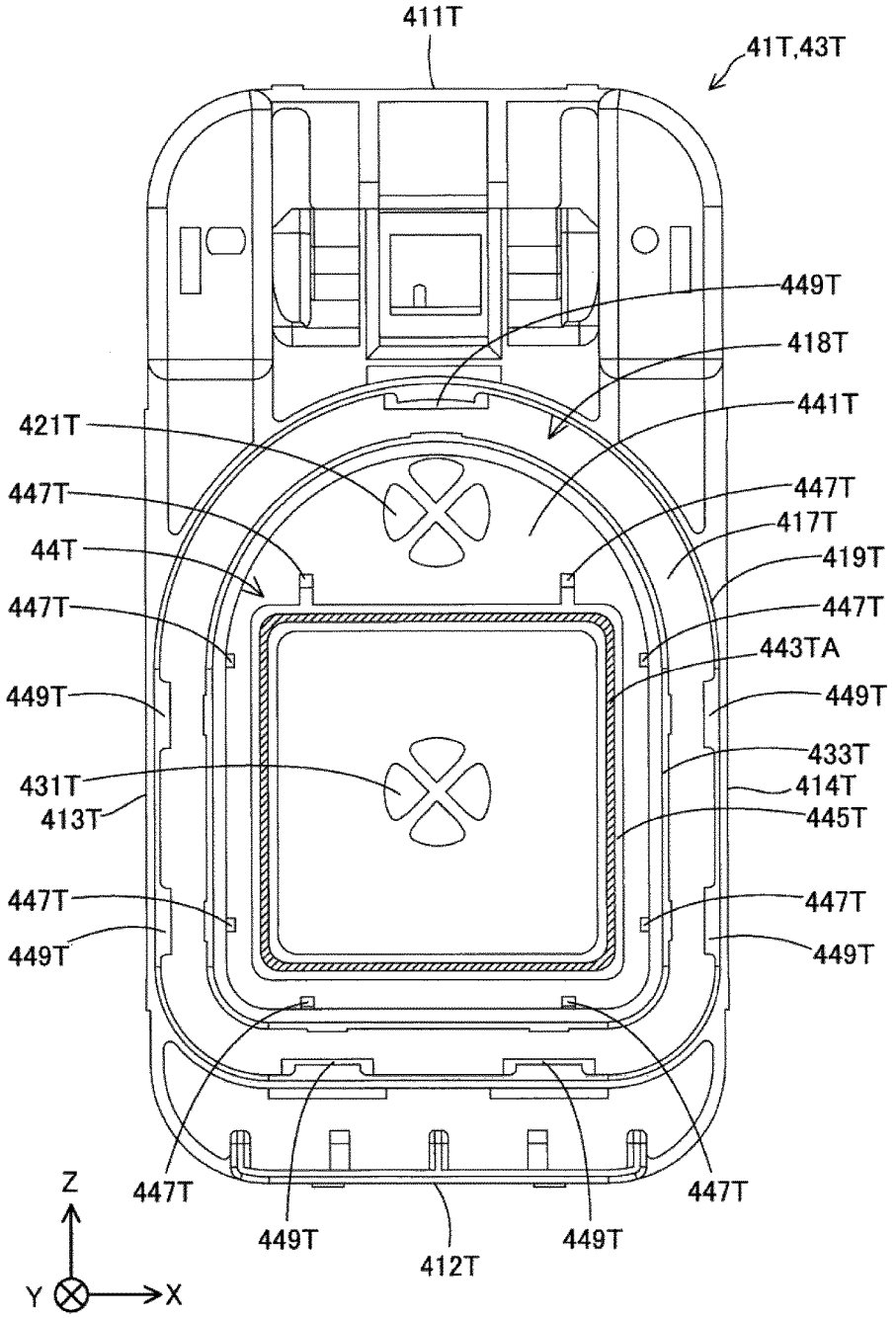
FIG. 36 is a rear view illustrating the connection member.
Figure 37:
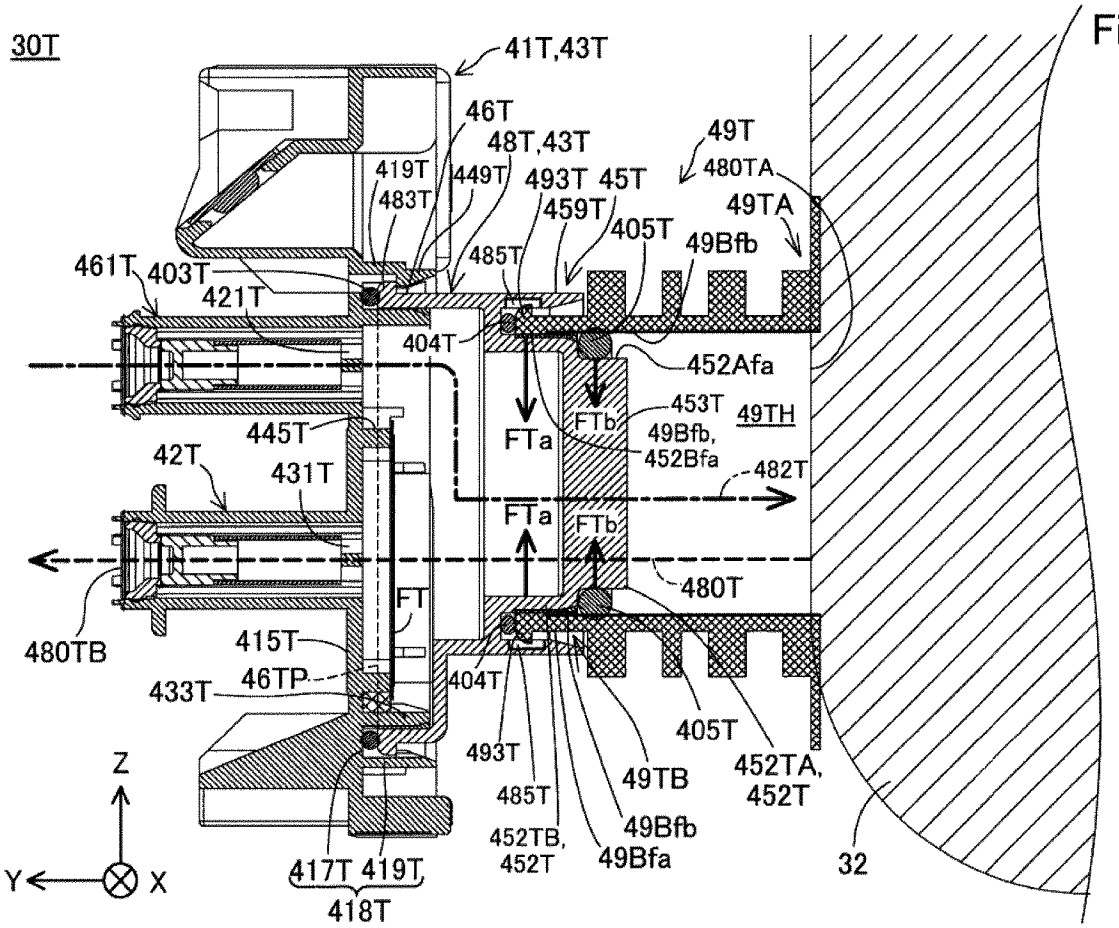
FIG. 37 is a sectional view taken on a line 37-37 in FIG. 30.
Figure 38:
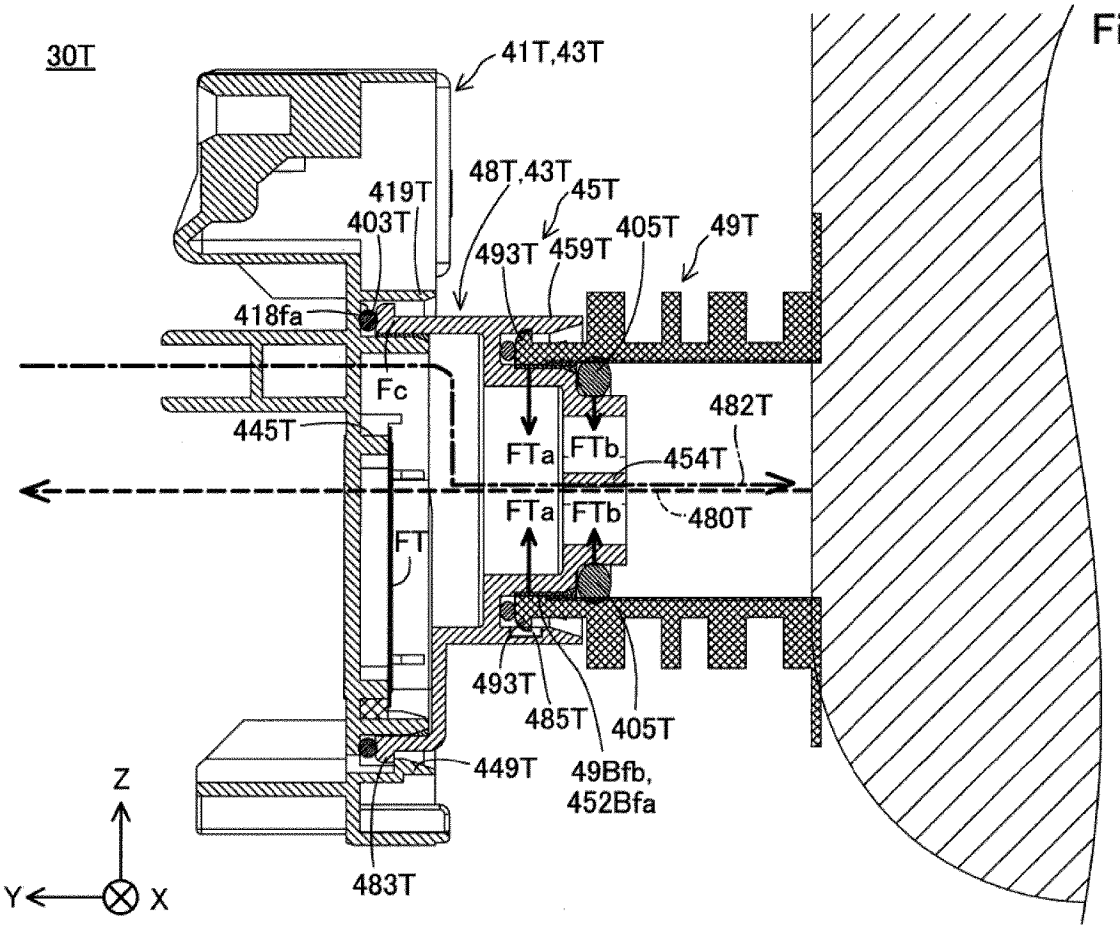
FIG. 38 is a sectional view taken on a line 38-38 in FIG. 30.

FIG. 33 is a perspective view illustrating the supply member 49T. FIG. 34 is a perspective view illustrating the intermediate member 48T. FIG. 35 is a perspective view illustrating the connection member 41T. FIG. 36 is a rear view illustrating the connection member 41T. FIG. 36 illustrates the connection member 41T after removal of the filter FT. FIG. 37 is a sectional view taken on a line 37-37 in FIG. 30. FIG. 38 is a sectional view taken on a line 38-38 in FIG. 30.

The supply member 49T (shown in FIG. 33) is a tubular member and has a through hole 49TH that forms part of the supply flow path 480T. The through hole 49TH is extended along the Y-axis direction.

The supply member 49T includes a first supply opening portion 49TA that is one end portion and a second supply opening portion 49TB that is the other end portion. The first supply opening portion 49TA has a ring-like shape. The first supply opening portion 49TA is connected with the liquid supply source 32 by thermal welding, laser welding or the like. The first supply opening portion 49TA includes the upstream end 480TA of the supply flow path 480T (shown in FIG. 37). The liquid supplied from the liquid supply source 32 to the connector 40T first passes through the upstream end 480TA.

The second supply opening portion 49TB (shown in FIG. 33) is located on the downstream side of the first supply opening portion 49TA. The second supply opening portion 49TB has a tubular shape. The second supply opening portion 49TB is provided with an engagement claw 493T that is protruded outward in the radial direction from an outer circumferential surface 49Bfa. The engagement claw 493T is formed around the entire circumference of the outer circumferential surface 49BFa. Part of the intermediate member 48T (more specifically, an insertion structure 452T described later) is fit in the second supply opening portion 49TB (as shown in FIG. 37). The second supply opening portion 49TB is fit in another part of the intermediate member 48T (more specifically, a sealing main body structure 459T described later). The engagement claw 493T is engaged with the intermediate member 48T to suppress the supply member 49T from being detached from the intermediate member 48T. The configuration of connection between the supply member 49T and the intermediate member 48T will be described later. An inner circumferential surface 49Bfb of the second supply opening portion 49TB has an entire circumferential part that is in surface contact with the intermediate member 48T.

The intermediate member 48T (shown in FIG. 34) has one end portion 46T on a +Y-axis direction side that is connected with the connection member 41T and the other end portion 45T on a −Y-axis direction side that is connected with the supply member 49T. The intermediate member 48T internally forms part of the supply flow path 480T. The other end portion 45T of the intermediate member 48T includes an insertion structure 452T and a sealing main body structure 459T.

The insertion structure 452T (shown in FIG. 37) is inserted in the second supply opening portion 49TB to form part of the supply flow path 480T. The insertion structure 452T (shown in FIG. 34) includes a first insertion portion 452TA in a tubular shape and a second insertion portion 452TB in a tubular shape having a larger diameter than the diameter of the first insertion portion 452TA. The first insertion portion 452TA is located on the upstream end 480TA-side of the second insertion portion 452TB.

The sealing main body structure 459T is provided to surround the outer circumference of the insertion structure 452T. The sealing main body structure 459T is an annular member. The sealing main body structure 459T (shown in FIG. 37) has an engaged element 485T that is formed in the circumferential direction in an inner circumferential surface. According to this embodiment, the engaged element 485T is a groove. According to another embodiment, the engaged element 485T may be a through hole that passes through the sealing main body structure 459T in the circumferential direction. The engaged element 485T is engaged with the engagement claw 493T of the supply member 49T. The second supply opening portion 49TB of the supply member 49T is inserted in between the insertion structure 452T and the sealing main body structure 459T that surrounds the outer circumference of the insertion structure 452T, so that the sealing main body structure 459T presses the second supply opening portion 49TB toward the side where the insertion structure 452T is located (i.e., inward in the radial direction). This causes an external force FTa to be applied inward in the radial direction from the second supply opening portion 49TB to the second insertion portion 452TB. This external force FTa serves to cause an outer circumferential surface 452Bfa of the insertion structure 452T (more specifically, the second insertion portion 452TB) to be in surface contact with the inner circumferential surface 49Bfb of the second supply opening portion 49TB in the circumferential direction. A third elastic seal member 404T is placed around the circumference of the engagement claw 493T to seal a gap between the engagement claw 493T and the other end portion 45T of the intermediate member 48T. The third elastic seal member 404T has a ring-like shape.

As shown in FIGS. 37 and 38, the first elastic seal member 405T is located on the first supply opening portion 49TA-side of the contact position of the outer circumferential surface 452Bfa of the second insertion portion 450TB with the inner circumferential surface 49Bfb of the second supply opening portion 49TB. According to this embodiment, the first elastic seal member 405T is placed along an outer circumferential surface 452Afa of the first insertion portion 452TA. The first elastic seal member 405T is located between the outer circumferential surface 452Afa of the first insertion portion 452TA and the inner circumferential surface 49Bfb of the second supply opening portion 49TB, so as to seal a gap between the outer circumferential surface 452Afa and the inner circumferential surface 49Bfb. In other words, the first elastic seal member 405T is pressed in the radial direction of the insertion structure 452T by the outer circumferential surface 452Afa and the inner circumferential surface 49Bfb. The first elastic seal member 405T accordingly applies an external force FTb inward in the radial direction to the insertion structure 452T.

The first insertion portion 452TA (shown in FIG. 34) includes an insertion structure inner circumferential surface 452Afb that defines part of the supply flow path 480T, a first rib 453T having respective ends that are connected with the insertion structure inner circumferential surface 452Afb, and a second rib 454T having respective ends that are connected with the insertion structure inner circumferential surface 452Afb. The insertion structure inner circumferential surface 452Afb is located on the opposite side to the outer circumferential surface 452Afa of the insertion structure 452T where the first elastic seal member 405T is located. The second rib 454T is arranged to intersect with the first rib 453T. The first rib 453T and the second rib 454T are plate-like members that intersect at right angles and respectively pass through the center of the flow path of the first insertion portion 452TA. The presence of the first rib 453T and the second rib 454T provided in the first insertion portion 452TA of the insertion structure 452T suppresses deformation of the insertion structure 452T caused by the external force FTb applied from the first elastic seal member 405T to the insertion structure 452T (more specifically, the first insertion portion 452TA). This configuration accordingly reduces the possibility of a variation in sealing degree by the first elastic seal member 405T and thereby reduces the possibility of leakage of the liquid from the gap between the insertion structure 452T and the supply member 49T to outside.

The one end portion 46T of the intermediate member 48T (shown in FIGS. 34 and 37) has an opening 46TP that has a larger opening area than that of the other end portion 45T. As shown in FIG. 37, the opening 46TP forms part of the supply flow path 480T and the injection flow path 482T. The one end portion 46T has an engagement claw 483T that is protruded outward in the radial direction from an outer circumferential surface 46Tfa. The engagement claw 483T is formed around the entire circumference of the outer circumferential surface 46Tfa. The engagement claw 483T is engaged with the connection member 41T when the one end portion 46T is fit in the connection member 41T.

The intermediate member 48T (shown in FIG. 34) also includes a pair of restriction elements 484T that are protruded along the X-axis direction from an outer circumferential surface between the one end portion 46T and the other end portion 45T. The pair of restriction elements 484T are respectively plate-like members and are provided to be opposed to the case 31T so as to restrict the motion of the connector 40T inward of the case 31T.

The connection member 41T (shown in FIG. 35) is formed in an approximately rectangular parallelepiped external shape. The connection member 41T includes a first surface (first wall) 411T, a second surface (second wall) 412T, a third surface (third wall) 413T, a fourth surface (fourth wall) 414T, a fifth surface (fifth wall) 415T and a sixth surface (sixth wall) 416T.

In the mounting state, the first surface 411T forms a +Z-axis direction side end face (upper face). In the mounting state, the second surface 412T forms a −Z-axis direction side end face (bottom face). In the mounting state, the third surface 413T forms a −X-axis direction side end face (one side face). In the mounting state, the fourth surface 414T forms a +X-axis direction side end face (the other end face). In the mounting state, the fifth surface 415T forms a +Y-axis direction side end face (front face). The first surface 411T and the second surface 412T are portions that are opposed in the Z-axis direction to the inner circumferential surface forming the housing space 21A of the mounting structure 20T. The third surface 413T and the fourth surface 414T are portions that are opposed in the X-axis direction to the inner circumferential surface forming the housing space 21A of the mounting structure 20T.

The connection member 41T includes the liquid supply portion 42T that is protruded from the fifth surface 415T. In other words, the connection member 41T forms the downstream end (opening) 480TB in the flow direction. The connection ember 41T also has the injection flow path 482T including the liquid injection portion 461T.

The connection member 41T of the connection main body member 43T includes a recess 44T and a groove 418T provided to surround the outer circumference of the recess 44T. The recess 44T and the groove 418T are formed in the sixth surface 416T.

The recess 44T (shown in FIG. 359 includes a bottom wall 441T opposed to the upstream end 480TA and a frame-like side wall 433T rising from the outer periphery of the bottom wall 441T. The bottom wall 441T (shown in FIG. 36) includes a supply path opening 431T that forms the supply flow path 480T and an injection path opening 421T that forms the injection flow path 482T. The supply path opening 431T and the injection path opening 421T are through holes that are formed to pass through the bottom wall 441T. The side wall 433T rises from the outer periphery of the bottom wall 441T toward the −Y-axis direction side (i.e., toward the upstream end 480TA-side).

The recess 44T (shown in FIG. 369 further includes a partition wall 445T in a frame-like shape that rises from the bottom wall 441T to surround the supply path opening 431T. The partition wall 445T rises from the bottom wall 441T toward the −Y-axis direction side at an inner position of the side wall 433T. The injection path opening 421T is located outside of the partition wall 445T in the frame-like shape. A filter FT is attached air-tightly at an end 443TA of the partition wall 445T opposite to the side where the bottom wall 441T is located. An area filled with single hatching in FIG. 36 indicates a portion of the end 443TA which the filter FT is attached to. As shown in FIG. 37, the filter FT is placed on the downstream side of the insertion structure 452T in the supply flow path 480T.

The connection member 41T of the connection main body member 43T (shown in FIGS. 35 and 369 further includes first projections 447T that are provided in the recess 44T and that are located on the outer circumference of the filter FT. Eight first projections 447T are provided. Two first projections 447T are provided on each of the four sides of the filter FT in a rectangular shape, such that two first projections 447T on one side are opposed to two first projections 447T on the opposed side. The first projections 447T serve to restrict the motion of the filter FT in a direction perpendicular to the flow direction in the supply flow path 480T (i.e., the direction parallel to the X-axis direction and the Z-axis direction). For example, the first projections 447T restrict the motion of the filter FT and thereby suppress position misalignment of the filter FT when the filter FT is placed at the end 443TA and is attached to the end 443TA. When the filter FT attached to the end 443TA starts moving in a direction parallel to the X-axis direction and the Z-axis direction, the filter FT hits against the first projections 447T. This configuration suppresses position misalignment of the filter FT. Suppressing position misalignment of the filter FT results in reducing the possibility that a gap is formed between the filter FT and the end 443TA. The filter FT serves to suppress any extraneous substance from passing through and thereby reduces the possibility that the extraneous substance reaches the mounting structure 20T.

The groove 418T (shown in FIG. 36) is arranged to be adjacent the recess 44T. The groove 418T (shown in FIG. 36) includes a bottom wall 417T and a side wall 419T and the side wall 433T that rise from the outer periphery of the bottom wall 417T. The side wall 433T is shared by the recess 44T and the groove 418T. The bottom wall 417T is opposed to the one end portion 46T of the intermediate member 48T (as shown in FIG. 37). The side wall 319T is formed in a frame-like shape and is located on the outer edge of the groove 418T. The side wall 419T is provided with second projections 449T that are protruded inward in the groove 418T. Seven second projections 449T are provided to be arranged at some intervals. The second projections 449T are portions that are engaged with the engagement claw 483T of the intermediate member 48T (shown in FIG. 37). The second projections 449T are engaged with the engagement claw 483T so as to be connected with the intermediate member 48T. One second projection 449T is provided on the +Z-axis direction side of the recess 44T. Two second projections 449T are provided below (on the −Z-axis direction side of) the recess 44T. Two second projections 449T are provided on the +X-axis direction side of the recess 44T. Two second projections 449T are provided on the −X-axis direction side of the recess 44T. The number of the second projections 449T is necessarily not limited to this embodiment but may be any number that allows the second projections 449T to stably maintain the engagement with the engagement claw 483T of the intermediate member 48T. For example, one second projection 449T may be provided on the +Z-axis direction side, on the −Z-axis direction side, on the +X-axis direction side and on the −X-axis direction side of the recess 44T. In another example, a series of second projections 449T may be formed sequentially along the shape of the groove 418T.

The second elastic seal member 403T (shown in FIG. 37) is placed in the groove 418T. More specifically, the second elastic seal member 403T is pressed in the axial direction of the intermediate member 48T (thrust direction: flow direction of the supply flow path 480T) by the bottom wall 417T of the groove 418T and the one end portion 46T of the intermediate member 48T opposed to the bottom wall 417T, so as to seal a gap between the groove 418T of the connection member 41T and the intermediate member 48T. The second elastic seal member 403T is placed to surround the circumference of the supply flow path 480T and the injection flow path 482T. The presence of the second elastic seal member 403T reduces the possibility of leakage of the liquid from the supply flow path 480T or the injection flow path 482T to outside.

The second projections 449T (shown in FIG. 37) described above are located on the intermediate member 48T-side of the second elastic seal member 403T.

The injection flow path 482T (shown in FIGS. 37 and 38) joins the supply flow path 480T on the upstream side of the filter FT in the flow direction of the supply flow path 480T. In other words, the injection flow path 482T shares the upstream-side flow path with the supply flow path 480T in the flow direction of the supply flow path 480T and branches off at the injection path opening 421T. The branch flow path is formed inside of the liquid injection portion 461T.

E-4. Advantageous Effects

According to the third embodiment described above, the connector 40T configured to form the supply flow path 480T which the liquid from the liquid supply source 32 flows in includes the sealing main body structure 459T and the first elastic seal member 405T (as shown in FIG. 37). The sealing main body structure 459T causes the outer circumferential surface 452Bfa of the insertion structure 452T (more specifically, the second insertion portion 452TB) and the inner circumferential surface 49Bfb of the second supply opening portion 49TB to come into contact with each other in the circumferential direction (as shown in FIG. 37). The first elastic seal member 405T serves to seal the gap between the outer circumferential surface 452Afa of the insertion structure 452T (more specifically, the first insertion portion 452TA) and the inner circumferential surface 49Bfb of the second supply opening portion 49TB. This configuration suppresses leakage of the liquid to outside by the narrower required space (i.e., by the space where the connector 40T is located), compared with a configuration that the liquid supply source 32 and the connector 40T are covered by a sealed case to suppress leakage of the liquid to outside. This configuration accordingly reduces the possibility of a failure to sufficiently exert the function of suppressing leakage of the liquid to outside, due to position misalignment between the members or a tolerance of the member. The connector 40T has the seal structure formed by the first elastic seal member 405T and the seal structure of surface contact in the circumferential direction between the outer circumferential surface 452Bfa of the second insertion portion 452TB and the inner circumferential surface 49Bfb of the second supply opening portion 49TB, which is formed by the sealing main body structure 459T. This configuration more effectively suppresses leakage of the liquid to outside.

According to the third embodiment described above, the first elastic seal member 405T is placed to apply the external force FTb inward in the radial direction to the insertion structure 452T (as shown in FIG. 37). This causes an external force (reaction force) to be applied outward in the radial direction to the second supply opening portion 49TB of the supply member 49T by the first elastic seal member 405T. The inner circumferential surface 49Bfb of the second supply opening portion 49TB receives this reaction force in the circumferential direction, so as to distribute the reaction force. This reduces the possibility of deformation of the supply member 49T including the engagement claw 493T and thereby prevents formation of a gap between the supply member 49T and the intermediate member 48T. This configuration accordingly reduces the possibility of leakage of the liquid flowing in the connector 40T to outside.

According to the third embodiment described above, the connector 40T includes the groove 418T that is provided to surround the outer circumference of the recess 44T with the supply path opening 431T and the injection path opening 421T formed therein (as shown in FIGS. 35 and 36). The second elastic seal member 403T is pressed by the groove 418T and the intermediate member 48T to seal the gap between the groove 418T and the intermediate member 48T. This configuration reduces the possibility of leakage of the liquid to outside when the liquid flows in the injection flow path 482T and when the liquid from the liquid supply source flows in the supply flow path 480T.

According to the third embodiment described above, a plurality of (seven in the embodiment) second projections 449T are provided at some intervals (as shown in FIG. 36) to be engaged with the engagement claw 487T of the intermediate member 48T (shown in FIG. 37). This configuration enables the engagement claw 487T of the intermediate member 48T to be readily pressed into the groove 418T, compared with a configuration that the second projection 449T is provided continuously along the circumferential direction of the groove 418T. This ensures smooth engagement (connection) between the engagement claw 487T with the second projections 449T during manufacture of the connector 40T. The configuration that enables the engagement claw 487T of the intermediate member 48T to be readily pressed into the groove 418T reduces the external force applied to the intermediate member 48T and to the supply member 49T during manufacture and thereby suppresses deformation (for example, plastic deformation of the intermediate member 48T and the supply member 49T.

According to the third embodiment described above, the supply flow path 480T of the connector 40T is formed by the three members, i.e., the supply member 49T, the intermediate member 48T and the connection member 41T (as shown in FIG. 32). This configuration enhances the flexibility of design. For example, even when the configuration of the connection member 41T is changed according to the shape of the mounting structure 20T or according to the size of the filter FT, the same supply member 49T may be applied to the connection member 41T after the change.

F. Fourth Embodiment

Figure 39:
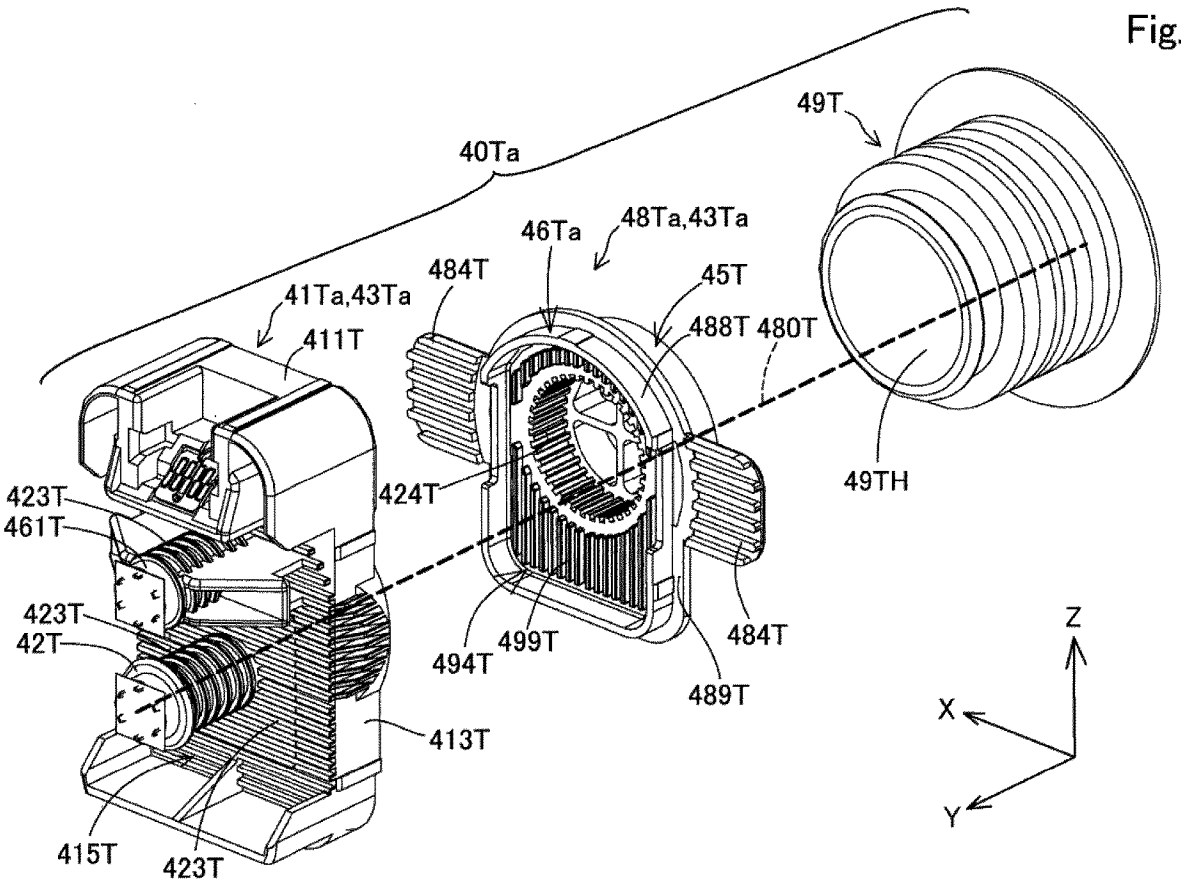
FIG. 39 is an exploded perspective view illustrating a connector according to a fourth embodiment.
Figure 40:
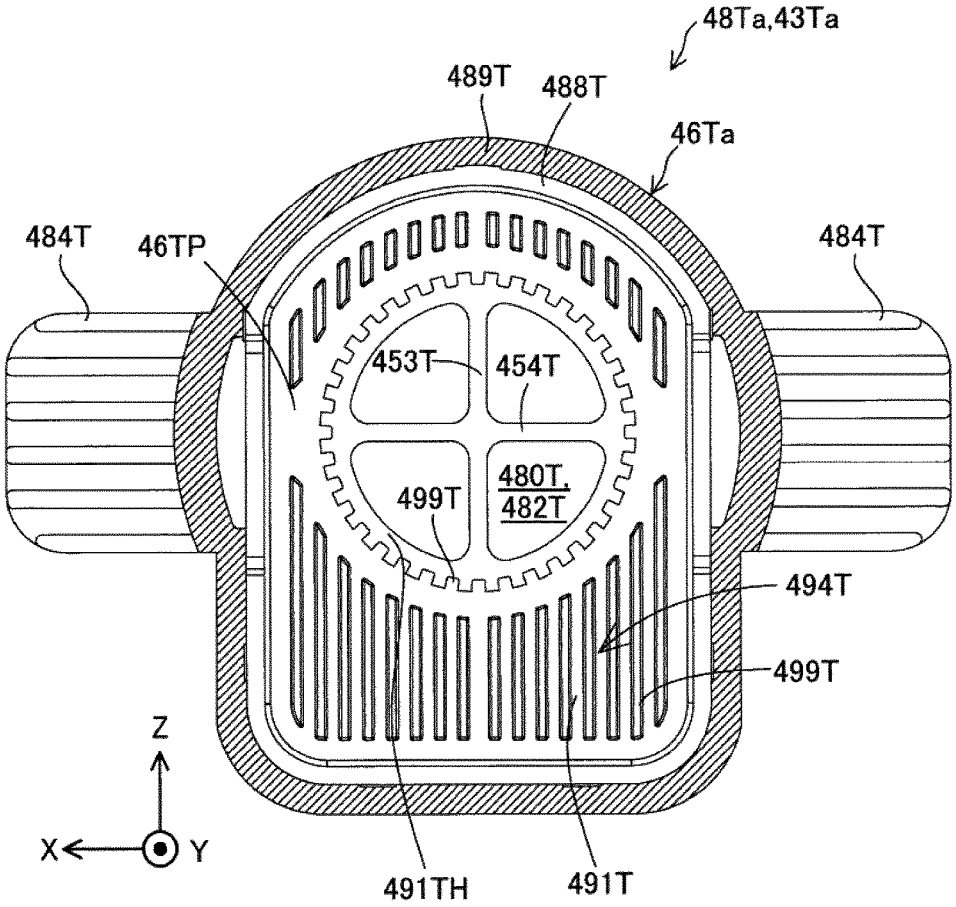
FIG. 40 is a rear view illustrating an intermediate member.
Figure 41:
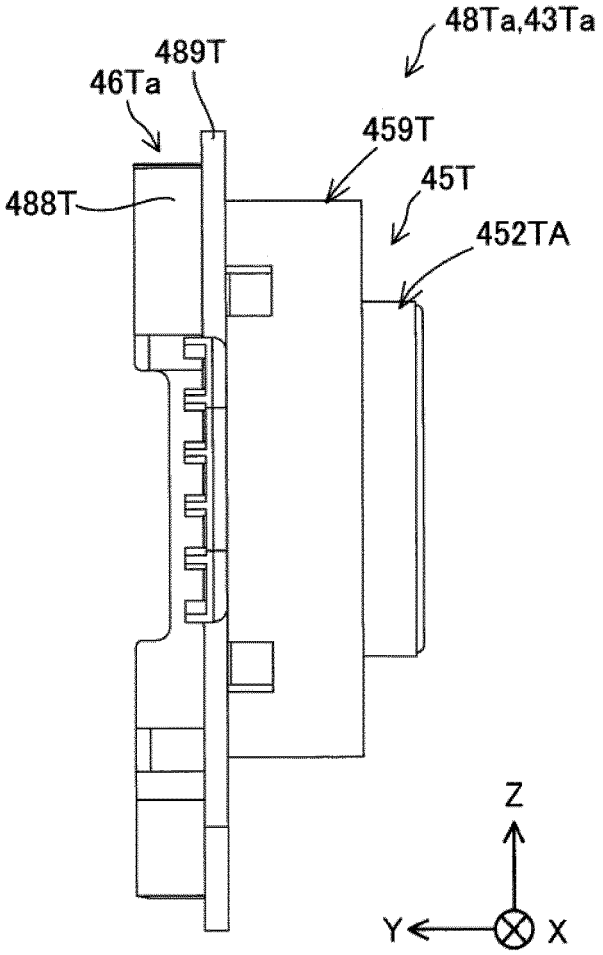
FIG. 41 is a side view illustrating the intermediate member.
Figure 42:
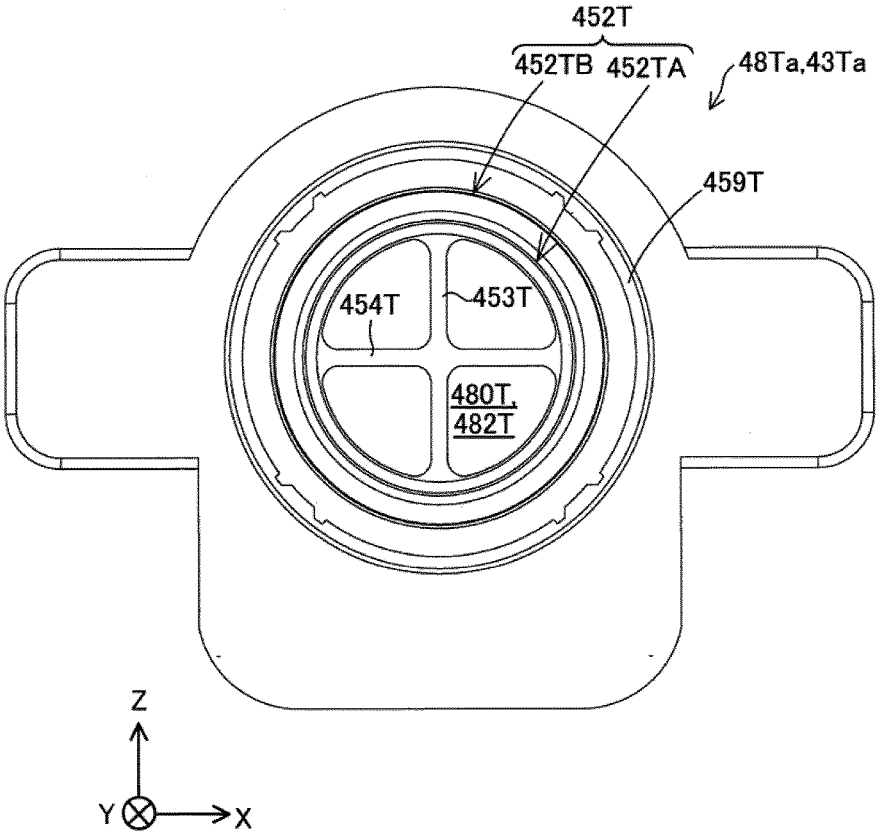
FIG. 42 is a front view illustrating the intermediate member.
Figure 43:
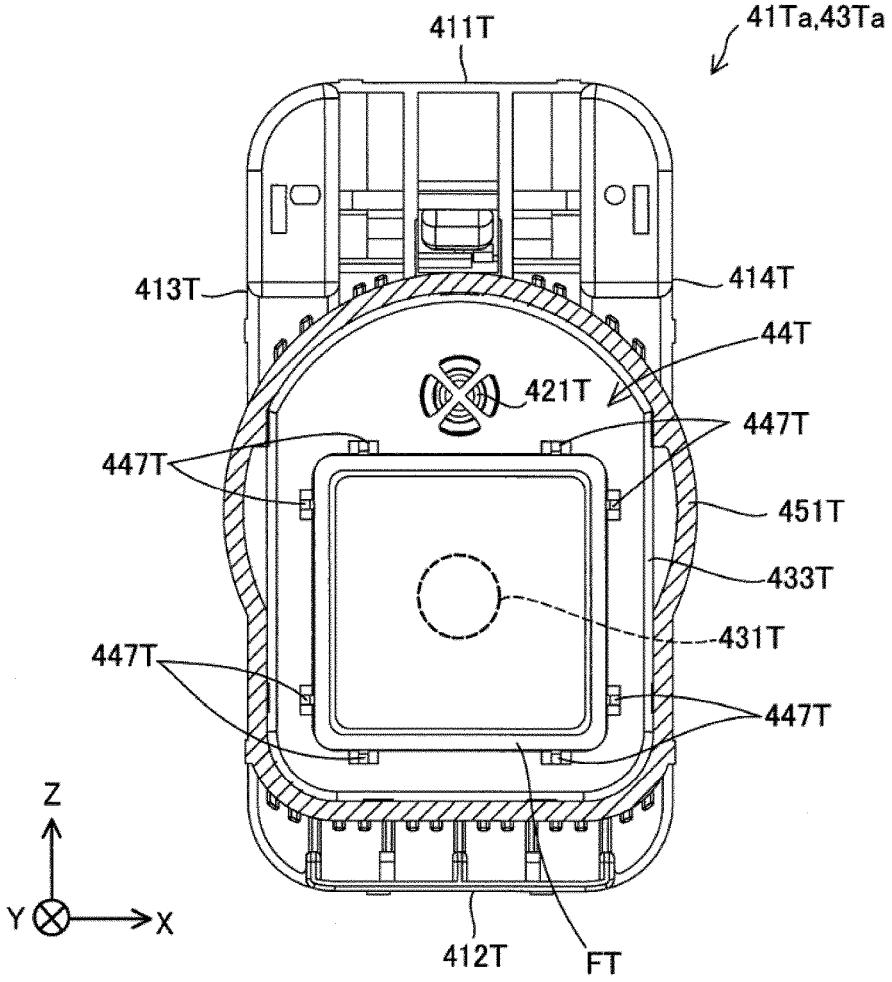
FIG. 43 is a rear view illustrating a connection member.
Figure 44:
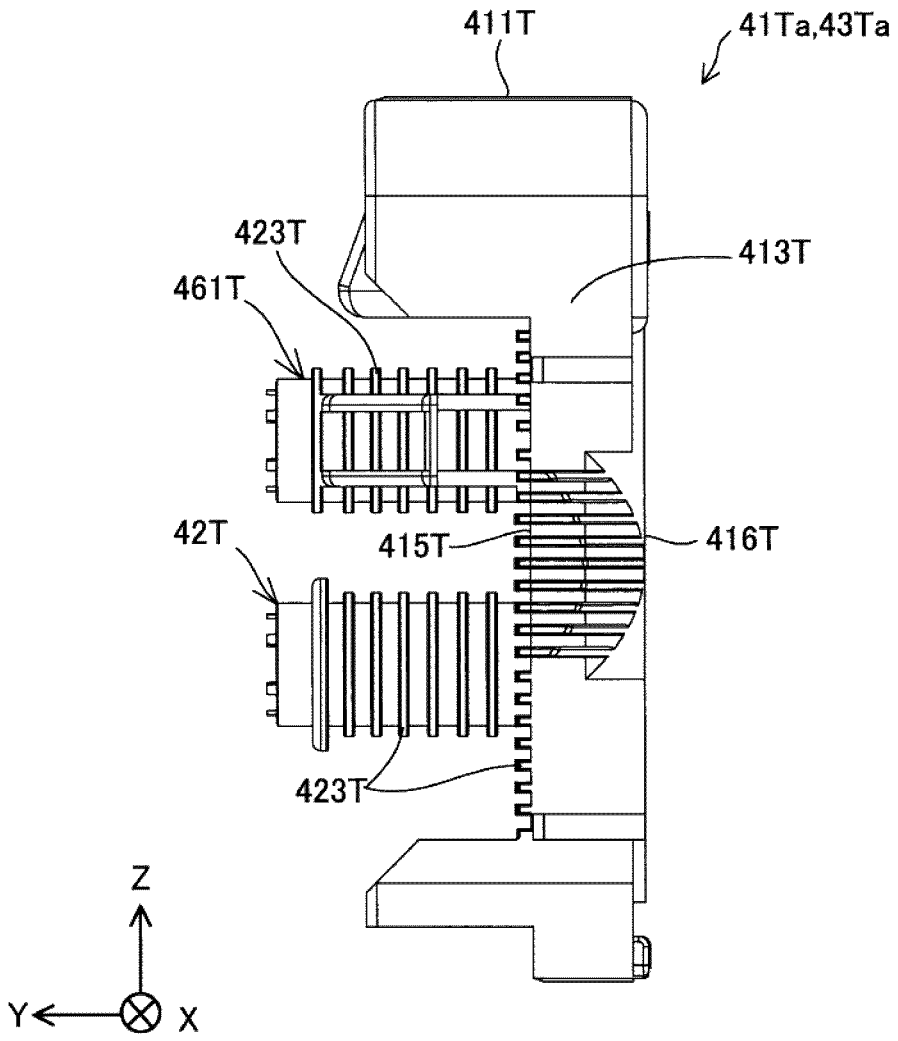
FIG. 44 is a side view illustrating the connection member.

FIG. 39 is an exploded perspective view illustrating a connector 40Ta according to a fourth embodiment. FIG. 40 is a rear view illustrating an intermediate member 48Ta. FIG. 41 is a side view illustrating the intermediate member 48Ta. FIG. 42 is a front view illustrating the intermediate member 48Ta. FIG. 43 is a rear view illustrating a connection member 41Ta. FIG. 44 is a side view illustrating the connection member 41Ta. The like components to those of the connector 40T (shown in FIG. 32) of the third embodiment described above are expressed by the like reference signs, and their description is omitted. The illustration of the first elastic seal member 405T (shown in FIG. 32) and the third elastic seal member 404T (shown in FIG. 37) is omitted from the connector 40Ta illustrated in FIG. 39. The connector 40Ta differs from the connector 40T (shown in FIG. 32) by that the connection member 41Ta and the intermediate member 48Ta are welded to each other in a connection main body member 43Ta and that a plurality of projections 423T and 499T are provided on the surface and on the inner face of the connection member 41Ta and the intermediate member 48Ta.

The intermediate member 48Ta is made of, for example, a thermoplastic resin such as polypropylene (PP). The intermediate member 48Ta (shown in FIG. 39) is connected with the connection member 41Ta by welding a one end portion 46Ta on its +Y-axis direction side to the connection member 41Ta and is connected with the supply member 49T by fitting the other end portion 45T on its −Y-axis direction side in the supply member 49T. The intermediate member 48Ta internally forms part of the supply flow path 480T. The other end portion 45T of the intermediate member 48Ta (shown in FIG. 42) includes an insertion structure 452T and a sealing main body structure 459T, like the third embodiment.

The one end portion 46Ta of the intermediate member 48Ta (shown in FIG. 40) has an opening 46TP having a larger opening area than that of the other end portion 45T. The one end portion 46Ta has a recess 494T that forms part of the injection flow path 482T and the supply flow path 480T. The recess 494T includes a bottom wall 491T that is opposed to the connection member 41Ta and a side wall 488T that rise from the outer periphery of the bottom wall 491T toward the connection member 41Ta-side (i.e., toward the +Y-axis direction side). A through hole 491TH is formed in the bottom wall 491T to pass through the bottom wall 491T in the Y-axis direction. This through hole 491TH forms part of the injection flow path 482T and the supply flow path 480T. The side wall 488T is inserted into a recess 44T of the connection member 41Ta described later.

The one end portion 46Ta of the intermediate member 48Ta (shown in FIG. 40) also includes a first welding portion 489T provided to surround the outer circumference of the side wall 488T. The first welding portion 489T is welded airtightly to the connection member 41Ta. The first welding portion 489T is a surface that faces toward the connection member 41Ta-side and intersects with the flow direction of the supply flow path 480T. The first welding portion 489T is shown by single hatching in FIG. 40, in order to facilitate understanding.

A plurality of projections 499T are formed on the bottom wall 491T and on the inner circumferential surface of the through hole 491TH of the intermediate member 48Ta. The plurality of projections 499T are respectively extended linearly. Providing the projections 499T increases the average wall thickness of the intermediate member 48Ta and thereby enhances the water barrier properties and the gas barrier properties. This configuration accordingly suppresses water and gas from being transmitted through the intermediate member 48Ta and leaking to outside.

The connection member 41Ta (shown in FIG. 43) is made of, for example, a thermoplastic resin such as polypropylene (PP). According to the embodiment, for example, the thermoplastic resin used for the connection member 41Ta may be the same type of thermoplastic resin as that used for the intermediate member 48Ta or may be a different type of thermoplastic resin. The connection member 41Ta includes a recess 44T and a second welding portion 451T provided to surround the outer circumference of the recess 44T. The second welding portion 451T is a surface that faces toward the intermediate member 48Ta-side. The second welding portion 451T is shown by single hatching in FIG. 43, in order to facilitate understanding.

A plurality of projections 423T are formed on the fifth surface 415T of the connection member 41Ta, on the outer circumferential surface of the liquid supply portion 42T and on the outer circumferential surface of the liquid injection portion 461T (as shown in FIGS. 39 and 44). The plurality of projections 423T formed on the liquid supply portion 42T and on the liquid injection portion 461T are respectively formed in a ring shape, and the plurality of projections 423T formed on the fifth surface 415T are respectively extended linearly. Providing the projections 423T increases the average wall thickness of the connection member 41Ta and thereby enhances the water barrier properties and the gas barrier properties. This configuration accordingly suppresses water and gas from being transmitted through the connection member 41Ta and leaking to outside.

The first welding portion 489T of the intermediate member 48Ta and the second welding portion 451T of the connection member 41Ta are welded to each other to surround the periphery of the supply flow path 480T and the injection flow path 482T. This configuration reduces the possibility that the liquid flowing in the supply flow path 480T or in the injection flow path 482T is leaked from the boundary between the intermediate member 48Ta and the connection member 41Ta to outside. The configuration of the connector 40Ta of the fourth embodiment has the improved sealing properties and thereby further reduces the possibility of leakage of the liquid to outside, compared with a configuration that the gap between the intermediate member 48Ta and the connection member 41Ta is sealed by using a separate elastic seal member.

Any of various welding techniques may be employed as the method of welding the first welding portion 489T and the second welding portion 451T to each other. For example, any of laser welding, vibration welding, ultrasonic welding and thermal welding techniques may be employed. Employing the laser welding technique more effectively reduces vibration during welding compared with the other welding techniques and thereby reduces the possibility that the intermediate member 48Ta and the connection member 41Ta are damaged by vibration. Employing the vibration welding technique or the ultrasonic welding technique has the smaller power consumption compared with the laser welding technique and the thermal welding technique and thereby reduces the manufacturing cost of the connector 40Ta. Employing the thermal welding technique implements welding by using an apparatus of the simpler configuration, compared with the laser welding technique, the vibration welding technique and the ultrasonic welding technique.

G. Fifth Embodiment

Figure 45:
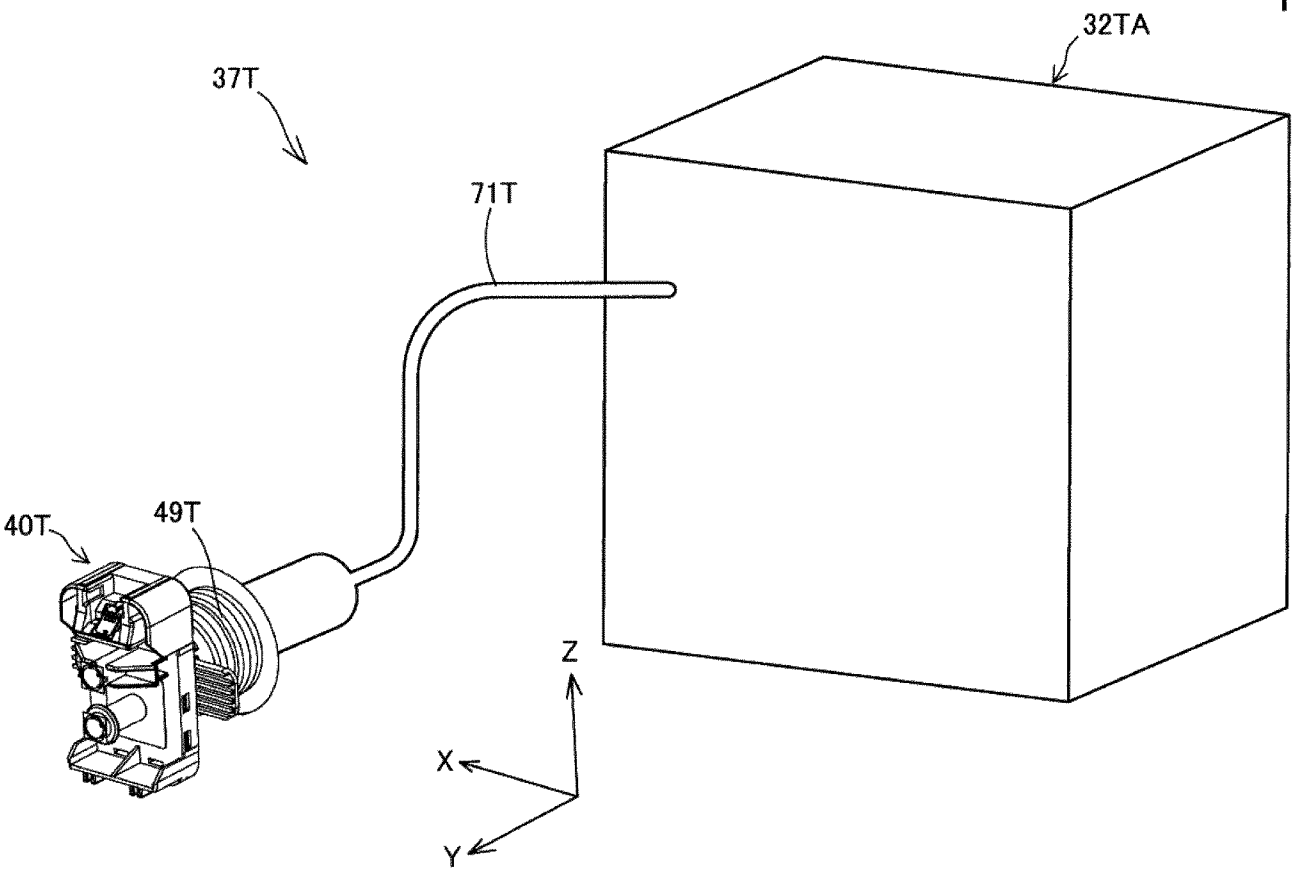
FIG. 45 is a diagram illustrating a liquid supply system according to a fifth embodiment.

FIG. 45 is a diagram illustrating a liquid supply system 37T according to a fifth embodiment. The liquid supply system 37T of the fifth embodiment differs from the liquid container 30T of the third embodiment described above by that the liquid supply system 37T does not include a case 31T and that a liquid supply source 32TA is connected with a connector 40T by means of a tube 71T. Otherwise the configuration of the fifth embodiment is similar to the configuration of the third embodiment. The like components are expressed by the like reference signs, and their description is omitted.

The liquid supply system 37T includes the connector 40T, the tube 71T and the liquid supply source 32TA. The tube 71T is connected with the connector 40T and with the liquid supply source 32TA, so as to cause the supply flow path 480T and the injection flow path 482T of the connector 40T to communicate with the liquid supply source 32TA. It is preferable that the liquid supply source 32TA has a larger capacity of containing the liquid therein than the capacity of the liquid supply source 32 of the third embodiment described above. This reduces the frequency of replacement of the liquid supply source 32TA. The liquid supply source 32TA may be placed on the main placement rack 19 (shown in FIG. 1) or may be placed in another location. The liquid supply source 32TA may be provided with a fill port through which the liquid is injected in. One end of the tube 71T is detachably connected with the supply member 49T of the connector 40T.

The configuration of the fifth embodiment that is similar to the configuration of the third embodiment described above has the similar advantageous effects. For example, the connector 40T configured to form the supply flow path 480T which the liquid from the liquid supply source 32TA flows in includes the sealing main body structure 459T and the first elastic seal member 405T (as shown in FIG. 37). The sealing main body structure 459T causes the outer circumferential surface 452Bfa of the insertion structure 452T (more specifically, the second insertion portion 452TB) and the inner circumferential surface 49Bfb of the second supply opening portion 49TB to come into contact with each other in the circumferential direction (as shown in FIG. 37). The first elastic seal member 405T serves to seal the gap between the outer circumferential surface 452Afa of the insertion structure 452T (more specifically, the first insertion portion 452TA) and the inner circumferential surface 49Bfb of the second supply opening portion 49TB. This configuration suppresses leakage of the liquid to outside by the narrower required space (i.e., by the space where the connector 40T is located), compared with a configuration that the liquid supply source 32TA and the connector 40T are covered by a sealed case to suppress leakage of the liquid to outside. This configuration accordingly reduces the possibility of a failure to sufficiently exert the function of suppressing leakage of the liquid to outside, due to position misalignment between the members or a tolerance of the member.

H. Sixth Embodiment

Figure 46:
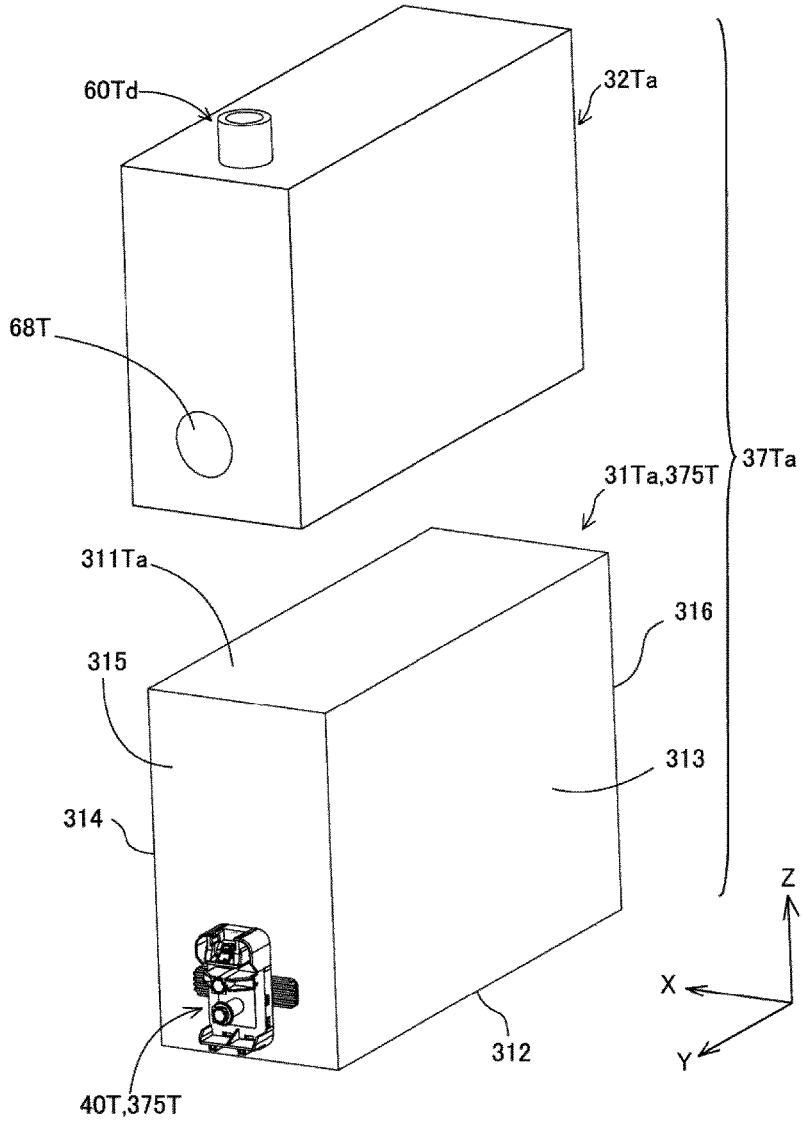
FIG. 46 is a diagram illustrating a liquid supply system according to a sixth embodiment.

FIG. 46 is a diagram illustrating a liquid supply system 37Ta according to a sixth embodiment. The liquid supply system 37Ta of the sixth embodiment differs from the liquid container 30T of the third embodiment described above by that a connector 40T is attached to a case 31Ta in the liquid supply system 37Ta and that a liquid supply source 32Ta is detachably connected with the connector 40T. Otherwise the configuration of the sixth embodiment is similar to the configuration of the third embodiment. The like components are expressed by the like reference signs, and their description is omitted.

A connector unit 375T includes the connector 40T and the case 31Ta. The connector 40T is attached to the case 31Ta.

The liquid supply source 32Ta is configured to contain the liquid that is to be supplied to the liquid consuming apparatus 10. The liquid supply source 32Ta is placed in the case 31Ta in a demountable manner. For example, the liquid supply source 32Ta may be placed in the case 31Ta through an upper face opening 311Ta of the case 31Ta.

The liquid supply source 32Ta includes a connection opening 68T and a fill port 60Td. The connection opening 68T is arranged to communicate with inside of the liquid supply source 32Ta and causes the liquid contained in the liquid supply source 32Ta to be flowed to outside. A liquid retaining member is placed in the connection opening 68T to suppress leakage of the liquid to outside. The liquid retaining member may be, for example, a sponge that is a porous member. The liquid retaining member may be replaced with a valve mechanism. The connection opening 68T is connectable with a supply member 49T of the connector 40T. The user connects the connection opening 68T with the supply member 49T when the liquid supply source 32Ta is placed into the case 31Ta. This enables the liquid contained in the liquid supply source 32Ta to be flowed through the connection opening 68T to the connector 40T-side.

The fill port 60Td is provided on an upper face of the liquid supply source 32Ta. The fill port 60Td is formed to pass through the wall of the liquid supply source 32Ta and communicate with the liquid supply source 32Ta. When a liquid level in the liquid supply source 32Ta is lowered to decrease the remaining amount of the liquid, the user is allowed to refill the liquid supply source 32Ta with the liquid through the fill port 60Td.

The configuration of the sixth embodiment that is similar to the configuration of the third embodiment described above has the similar advantageous effects. For example, the connector 40T configured to form the supply flow path 480T which the liquid from the liquid supply source 32Ta flows in includes the sealing main body structure 459T and the first elastic seal member 405T (as shown in FIG. 37). The sealing main body structure 459T causes the outer circumferential surface 452Bfa of the insertion structure 452T (more specifically, the second insertion portion 452TB) and the inner circumferential surface 49Bfb of the second supply opening portion 49TB to come into contact with each other in the circumferential direction (as shown in FIG. 37). The first elastic seal member 405T serves to seal the gap between the outer circumferential surface 452Afa of the insertion structure 452T (more specifically, the first insertion portion 452TA) and the inner circumferential surface 49Bfb of the second supply opening portion 49TB. This configuration suppresses leakage of the liquid to outside by the narrower required space (i.e., by the space where the connector 40T is located), compared with a configuration that the liquid supply source 32Ta and the connector 40T are covered by a sealed case to suppress leakage of the liquid to outside. This configuration accordingly reduces the possibility of a failure to sufficiently exert the function of suppressing leakage of the liquid to outside, due to position misalignment between the members or a tolerance of the member.

I. Modifications

The disclosure is not limited to any of the embodiments and the examples described above but may be implemented by a diversity of other aspects without departing from the scope of the disclosure. Some of possible modifications are given below.

I-1. First Modification

According to the first and the second embodiments described above, the cartridge 30 or 30*a* includes the liquid container body 32 (as shown in FIG. 6). According to a modification, the cartridge 30 or 30*a* may not include the liquid container body 32. Accordingly, the cartridge 30 or 30*a* may be configured to include only the connector 40 that is detachably mounted to the mounting structure 20 of the liquid consuming apparatus 10. In this modification, for example, as shown in FIG. 26, the connector 40 may be provided with the external container 32*e* and the tube 71 to supply the liquid from outside.

I-2. Second Modification

According to the first and the second embodiments described above, the supply portion protrusion 421 is formed in a ring shape around the whole circumference of the outer surface of the flow portion 423. The supply portion protrusion 421 is, however, not limited to this configuration but may have any configuration that works in cooperation with the mounting structure-side cylindrical member 221 to restrict the motion of the flow portion 423 on the X-Z plane. For example, the supply portion protrusion 421 may be formed by a plurality of projections arranged at predetermined intervals along the circumferential direction of the surface of the flow portion.

I-3. Third Modification

According to the first and the second embodiments described above, the contact portions CP are placed on the placement surface 443*fa* or 443*faa* that is the surface of the circuit board 443 or 443*a* (as shown in FIGS. 10 and 18). This configuration is, however, not essential. For example, the contact portions CP may be placed on a foldable (flexible) film or may be placed on a surface having a level difference. The circuit board 443 or 443*a* may not be provided with a storage device. The circuit board 443 or 443*a* may be a circuit board including a flexible cable, such as a flexible printed circuit board (FPC). This circuit board has contact portions that are located on one end thereof and that are arranged to come into contact with the electrical connecting elements 242. The other end of the circuit board is connected with, for example, a reset unit. The placement surface which the contact portions CP are placed on may be a real plane or may be a virtual plane which three or more contact portions CP are arranged to go through. The configuration of the main body-side terminals 442 of the circuit board 443 or 443*a* is not limited to those of the respective embodiments described above but may be any other configuration including the contact portions CP formed at such positions as to come into contact with the electrical connecting elements 242. For example, the main body-side terminals 442 may have irregular shapes.

I-4. Fourth Modification

In the connector 40T or 40Ta of any of the third to the sixth embodiments described above, at least one of the circuit board 443T, the injection flow path 482T including the liquid injection portion 461T, the second elastic seal member 403T, the third elastic seal member 404T, the first rib 453T, the second rib 454T, the filter FT, the first projections 447T and the second projections 449T may be omitted.

I-5. Fifth Modification

The disclosure is not limited to the textile printing machine or the cartridge (liquid container) configured to supply ink (liquid) to the textile printing machine but is also applicable to any liquid consuming apparatus and a cartridge detachably mounted to a mounting structure of the liquid consuming apparatus. For example, the disclosure may be applied to any of various liquid consuming apparatuses described below and their cartridges and connectors:

(1) image recording apparatus such as facsimile machine;

(2) color material consuming (ejecting) apparatus used for manufacturing color filters for image display apparatuses such as liquid crystal displays;

(3) electrode material consuming apparatus used for forming electrodes of, for example, organic EL (electroluminescence) displays and field emission displays (FED);

(4) liquid consuming apparatus configured to eject a bioorganic material-containing liquid used for manufacturing biochips;

(5) sample consuming apparatus used as precision pipette;

(6) consuming (ejecting) apparatus of lubricating oil;

(7) consuming (ejecting) apparatus of resin solutions;

(8) liquid consuming apparatus for pinpoint ejection of lubricating oil on precision machines such as watches and cameras;

(9) liquid consuming apparatus configured to eject transparent resin solutions, such as ultraviolet curable resin solution, onto substrates to manufacture hemispherical microlenses (optical lenses) used for, for example, optical communication elements;

(10) liquid consuming apparatus configured to eject acidic or alkaline etching solutions to etch substrates and the like; and

(11) liquid consuming apparatus equipped with a liquid ejection head configured to eject a very small volume of droplets of any other liquid.

The "droplet" herein means the state of liquid ejected from the liquid consuming apparatus and may be in a granular shape, a teardrop shape or a tapered threadlike shape. The "liquid" herein may be any material ejectable from the liquid consuming apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with solvents. Typical examples of the liquid include ink described in the above embodiments and liquid crystal. The ink herein includes general water-based inks and oil-based inks, as well as various liquid compositions, such as gel inks and hot-melt inks.

The present disclosure is not limited to any of the embodiments, the examples and the modifications described above but may be implemented by a diversity of configurations without departing from the scope of the disclosure. For example, the technical features of any of the embodiments, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

The present application claims priority from Japanese patent applications 2016-193100 and 2016-193083 filed on Sep. 30, 2016, the entireties of the disclosures of which are hereby incorporated by reference into this application.

The invention claimed is:

1. A cartridge detachably mounted to a mounting structure of a liquid consuming apparatus that is provided with a liquid introducing structure, an electrical connecting element and an engagement structure, wherein an X axis, a Y axis and a Z axis are three spatial axes that are orthogonal to one another; an X-axis direction is a direction along the X axis, a Y-axis direction is a direction along the Y axis, and a Z-axis direction is a direction along the Z axis; and in a mounting state that the cartridge is mounted to the mounting structure, a direction of gravity is defined as −Z-axis direction, an opposite direction of gravity is defined as +Z-axis direction, one direction in the X-axis direction is defined as +X-axis direction, and the other direction in the X-axis direction is defined as −X-axis direction, the cartridge comprising:

a liquid supply portion detachably connected with the liquid introducing structure to supply a liquid to the liquid introducing structure, the liquid supply portion including a base end portion, a leading end portion that forms an opening to receive the liquid introducing structure in the liquid supply portion, and a center axis that is extended in a direction along a +Y-axis direction from the base end portion toward the leading end portion;

a contact portion that is located on the +Z-axis direction side of the liquid supply portion and that is arranged to contact with the electrical connecting element in the mounting state; and a positioning structure that is located between the liquid supply portion and the contact portion in the Z-axis direction and that is engaged with the engagement structure to restrict motion of the cartridge relative to the mounting structure in the mounting state, wherein:

the liquid supply portion is configured to receive a first external force in the −Y-axis direction from the liquid introducing structure when the liquid supply portion is connected with the liquid introducing structure, the contact portion is configured to receive a second external force in a direction including the −Y-axis direction component from the electrical connecting element when the contact portion contacts with the electrical connecting element, a plurality of the contact portions are respectively provided at different positions in the X-axis direction, the plurality of the contact portions includes a first contact portion that is located on a most +X-axis direction side and a second contact portion that is located on a most −X-axis direction side in the X-axis direction among the plurality of the contact portions, when the cartridge is viewed from the +Y-axis direction side, a center of an interval between the first contact portion and the second contact portion in the X-axis direction is located on a virtual straight line that runs through the center axis of the liquid supply portion and is parallel to the Z-axis direction, the engagement structure includes a first engagement structure and a second engagement structure, the positioning structure includes:

a first engaged element that is engaged with the first engagement structure in the mounting state; and a second engaged element that is arranged to be away from the first engaged element across an interval in the X-axis direction and that is engaged with the second engagement structure in the mounting state, and when the cartridge is viewed from the +Y-axis direction side, the first engaged element and the second engaged element are located across the virtual straight line.

2. The cartridge according to claim 1, wherein the positioning structure is engaged with the engagement structure to restrict motion of the cartridge relative to the mounting structure in the X-axis direction, wherein when the cartridge is viewed from the +Y-axis direction side, a center of the positioning structure in the X-axis direction is located on the virtual straight line.

3. The cartridge according to claim 1, wherein the positioning structure includes:

a first protruded guide element that is formed to be located on a −Y-axis direction side toward the −X-axis direction and that is configured to guide the first engagement structure to the first engaged element; and a second protruded guide element that is formed to be located on the −Y-axis direction side toward the +X-axis direction and that is configured to guide the second engagement structure to the second engaged element, wherein the first engaged element is connected with a −X-axis direction side end of the first protruded guide element, and the second engaged element is connected with a +X-axis direction side end of the second protruded guide element.

4. The cartridge according to claim 1, further comprising:

a liquid injection portion that is configured to inject the liquid into the cartridge and that is located at an identical position in the Z-axis direction with the positioning structure.

5. The cartridge according to claim 1, further comprising:

a main body member that is placed inside of the mounting structure in the mounting state and that is provided with the liquid supply portion, the contact portion and the positioning structure, wherein an odd number of the contact portions are arranged along the X-axis direction, and a center contact portion that is located at a center among the odd number of the contact portions and the center axis are located at a center of the main body member in the X-axis direction.

6. A connector detachably mounted to a mounting structure of a liquid consuming apparatus that is provided with a liquid introducing structure, an electrical connecting element and an engagement structure, wherein an X axis, a Y axis and a Z axis are three spatial axes that are orthogonal to one another; an X-axis direction is a direction along the X axis, a Y-axis direction is a direction along the Y axis, and a Z-axis direction is a direction along the Z axis; and in a mounting state the connector is mounted to the mounting structure, a direction of gravity is defined as −Z-axis direction, an opposite direction of gravity is defined as +Z-axis direction, one direction in the X-axis direction is defined as +X-axis direction, and the other direction in the X-axis direction is defined as −X-axis direction, the connector comprising:

a liquid supply portion that is detachably connected with the liquid introducing structure to supply a liquid to the liquid introducing structure;

a contact portion that is located on the +Z-axis direction side of the liquid supply portion and that is arranged to contact with the electrical connecting element in the mounting state;

a positioning structure that is located between the liquid supply portion and the contact portion in the Z-axis direction and that is engaged with the engagement structure to restrict motion of the connector relative to the mounting structure in the mounting state; and a liquid injection portion that is configured to inject the liquid into the connector and that is located at an identical position in the Z-axis direction with the positioning structure, wherein the liquid supply portion includes a leading end portion that forms an opening to receive the liquid introducing structure in the liquid supply portion, the liquid supply portion is configured to receive a first external force in a direction including a −Y-axis direction component when the liquid supply portion is connected with the liquid introducing structure, and the contact portion is configured to receive a second external force in a direction including the −Y-axis direction component when the contact portion contacts with the electrical connecting element.

7. The connector according to claim 6, wherein a plurality of the contact portions are respectively provided at different positions in the X-axis direction, the plurality of the contact portions includes a first contact portion that is located on a most +X-axis direction side and a second contact portion that is located on a most −X-axis direction side in the X-axis direction among the plurality of the contact portions, when the cartridge is viewed from the +Y-axis direction side, a center of an interval between the first contact portion and the second contact portion in the X-axis direction is located on a virtual straight line that runs through a center axis of the liquid supply portion and is parallel to the Z-axis direction, the positioning structure is engaged with the engagement structure to restrict motion of the cartridge relative to the mounting structure in the X-axis direction, wherein when the cartridge is viewed from the +Y-axis direction side, a center of the positioning structure in the X-axis direction is located on the virtual straight line.

8. The connector according to claim 6, a plurality of the contact portions are respectively provided at different positions in the X-axis direction, the plurality of the contact portions includes a first contact portion that is located on a most +X-axis direction side and a second contact portion that is located on a most −X-axis direction side in the X-axis direction among the plurality of the contact portions, when the cartridge is viewed from the +Y-axis direction side, a center of an interval between the first contact portion and the second contact portion in the X-axis direction is located on a virtual straight line that runs through a center axis of the liquid supply portion and is parallel to the Z-axis direction, the engagement structure includes a first engagement structure and a second engagement structure, the positioning structure includes:

a first engaged element that is engaged with the first engagement structure in the mounting state; and a second engaged element that is arranged to be away from the first engaged element across an interval in the X-axis direction and that is engaged with the second engagement structure in the mounting state, when the cartridge is viewed from the +Y-axis direction side, the first engaged element and the second engaged element are located across the virtual straight line, and wherein the positioning structure further includes:

a first protruded guide element that is formed to be located on a −Y-axis direction side toward the −X-axis direction and that is configured to guide the first engagement structure to the first engaged element; and a second protruded guide element that is formed to be located on the −Y-axis direction side toward the +X-axis direction and that is configured to guide the second engagement structure to the second engaged element, the first engaged element is connected with a −X-axis direction side end of the first protruded guide element, and the second engaged element is connected with a +X-axis direction side end of the second protruded guide element.

9. The connector according to claim 6, further comprising:

a main body member that is placed inside of the mounting structure in the mounting state and that is provided with the liquid supply portion, the contact portion and the positioning structure, wherein an odd number of the contact portions are arranged along the X-axis direction, and a center contact portion that is located at a center among the odd number of the contact portions and a center axis of the liquid supply portion are located at a center of the main body member in the X-axis direction.

10. A cartridge detachably mounted to a mounting structure of a liquid consuming apparatus that is provided with a liquid introducing structure, an electrical connecting element and an engagement structure, wherein an X axis, a Y axis and a Z axis are three spatial axes that are orthogonal to one another; an X-axis direction is a direction along the X axis, a Y-axis direction is a direction along the Y axis, and a Z-axis direction is a direction along the Z axis; and in a mounting state that the cartridge is mounted to the mounting structure, a direction of gravity is defined as −Z-axis direction, an opposite direction of gravity is defined as +Z-axis direction, one direction in the X-axis direction is defined as +X-axis direction, and the other direction in the X-axis direction is defined as −X-axis direction, the cartridge comprising:

a liquid supply portion detachably connected with the liquid introducing structure to supply a liquid to the liquid introducing structure, the liquid supply portion including a base end portion, a leading end portion that forms an opening to receive the liquid introducing structure in the liquid supply portion, and a center axis that is extended in a direction along a +Y-axis direction from the base end portion toward the leading end portion;

a contact portion that is located on the +Z-axis direction side of the liquid supply portion and that is arranged to contact with the electrical connecting element in the mounting state;

a positioning structure that is located between the liquid supply portion and the contact portion in the Z-axis direction and that is engaged with the engagement structure to restrict motion of the cartridge relative to the mounting structure in the mounting state; and a liquid injection portion that is configured to inject the liquid into the cartridge and that is located at an identical position in the Z-axis direction with the positioning structure, wherein the liquid supply portion is configured to receive a first external force in the −Y-axis direction from the liquid introducing structure when the liquid supply portion is connected with the liquid introducing structure, and the contact portion is configured to receive a second external force in a direction including the −Y-axis direction component from the electrical connecting element when the contact portion contacts with the electrical connecting element.

11. The cartridge according to claim 10, wherein a plurality of the contact portions are respectively provided at different positions in the X-axis direction, the plurality of the contact portions includes a first contact portion that is located on a most +X-axis direction side and a second contact portion that is located on a most −X-axis direction side in the X-axis direction among the plurality of the contact portions, the cartridge is viewed from the +Y-axis direction side, a center of an interval between the first contact portion and the second contact portion in the X-axis direction is located on a virtual straight line that runs through the center axis of the liquid supply portion and is parallel to the Z-axis direction, the positioning structure is engaged with the engagement structure to restrict motion of the cartridge relative to the mounting structure in the X-axis direction, and when the cartridge is viewed from the +Y-axis direction side, a center of the positioning structure in the X-axis direction is located on the virtual straight line.

12. The cartridge according to claim 10, wherein:

a plurality of the contact portions are respectively provided at different positions in the X-axis direction, the plurality of the contact portions includes a first contact portion that is located on a most +X-axis direction side and a second contact portion that is located on a most −X-axis direction side in the X-axis direction among the plurality of the contact portions, when the cartridge is viewed from the +Y-axis direction side, a center of an interval between the first contact portion and the second contact portion in the X-axis direction is located on a virtual straight line that runs through the center axis of the liquid supply portion and is parallel to the Z-axis direction, the engagement structure includes a first engagement structure and a second engagement structure, the positioning structure includes:

a first engaged element that is engaged with the first engagement structure in the mounting state; and a second engaged element that is arranged to be away from the first engaged element across an interval in the X-axis direction and that is engaged with the second engagement structure in the mounting state, when the cartridge is viewed from the +Y-axis direction side, the first engaged element and the second engaged element are located across the virtual straight line, the positioning structure further includes:

a first protruded guide element that is formed to be located on a −Y-axis direction side toward the −X-axis direction and that is configured to guide the first engagement structure to the first engaged element; and a second protruded guide element that is formed to be located on the −Y-axis direction side toward the +X-axis direction and that is configured to guide the second engagement structure to the second engaged element, the first engaged element is connected with a −X-axis direction side end of the first protruded guide element, and the second engaged element is connected with a +X-axis direction side end of the second protruded guide element.

13. The cartridge according to claim 10, further comprising:

a main body member that is placed inside of the mounting structure in the mounting state and that is provided with the liquid supply portion, the contact portion and the positioning structure, wherein an odd number of the contact portions are arranged along the X-axis direction, and a center contact portion that is located at a center among the odd number of the contact portions and the center axis are located at a center of the main body member in the X-axis direction.

* * * * *